US006874876B2

(12) United States Patent
Ishizawa et al.

(10) Patent No.: US 6,874,876 B2
(45) Date of Patent: Apr. 5, 2005

(54) INK CARTRIDGE FOR USE WITH RECORDING APPARATUS AND INK JET RECORDING APPARATUS

(75) Inventors: Taku Ishizawa, Nagano (JP); Atsushi Kobayashi, Nagano (JP); Hitotoshi Kimura, Nagano (JP); Yoshiharu Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/228,924

(22) Filed: Aug. 28, 2002

(65) Prior Publication Data

US 2002/0196312 A1 Dec. 26, 2002

Related U.S. Application Data

(62) Division of application No. 09/937,130, filed on Jan. 29, 2002.

(30) Foreign Application Priority Data

| | | |
|---|---|---|
| Jan. 21, 2000 | (JP) | P2000-012461 |
| Jan. 21, 2000 | (JP) | P2000-012462 |
| Jun. 20, 2000 | (JP) | P2000-184002 |
| Jul. 4, 2000 | (JP) | P2000-201982 |
| Sep. 7, 2000 | (JP) | P2000-270929 |
| Oct. 12, 2000 | (JP) | P2000-311746 |
| Dec. 18, 2000 | (JP) | P2000-383527 |
| Dec. 22, 2000 | (JP) | P2000-391539 |
| Dec. 22, 2000 | (JP) | P2000-391540 |

(51) Int. Cl.[7] ..... B41J 2/175
(52) U.S. Cl. ..... 347/86; 347/85
(58) Field of Search ..... 347/85, 86, 87; 401/40

(56) References Cited

U.S. PATENT DOCUMENTS

| | | | | | |
|---|---|---|---|---|---|
| 3,720,473 | A | * | 3/1973 | Nakata | 401/40 |
| 4,514,742 | A | * | 4/1985 | Suga et al. | 347/85 |
| 5,138,344 | A | | 8/1992 | Ujita | |
| 5,666,146 | A | | 9/1997 | Mochizuki et al. | |
| 5,856,840 | A | | 1/1999 | Barinaga et al. | |
| 6,015,209 | A | * | 1/2000 | Barinaga et al. | 347/86 |
| 6,276,788 | B1 | * | 8/2001 | Hilton | 347/86 |
| 6,332,481 | B1 | * | 12/2001 | Shinada et al. | 141/18 |

FOREIGN PATENT DOCUMENTS

| | | |
|---|---|---|
| EP | 0 440 261 A2 | 1/1991 |
| EP | 0 516 088 A2 | 2/1992 |

(Continued)

*Primary Examiner*—Anh T. N. Vo
(74) *Attorney, Agent, or Firm*—Sughrue Mion, PLLC

(57) ABSTRACT

An ink cartridge in which on one surface of a cartridge case, there are provided a positioning means used in case that the ink cartridge is attached to a recording apparatus, an ink outlet port from an ink pack, an inlet port of the pressurized air and a connection terminal of a circuit board having a data storage means that stores ink information of the cartridge therein, and an ink jet recording apparatus provided with its ink cartridge are provided.

According to the ink cartridge of this mode, since the cartridge is exactly positioned and fixed to a holder three-dimentionally by the positioning means, mechanical positional adjustment and electrical connection can be exactly performed, so that operation reliability of the recording apparatus can be improved. Further, in the recording apparatus of this mode, in a state where the cartridge has been mounted on the recording apparatus by the positioning means, the connection terminal of the board is located at the upper portion of the ink outlet port. Hereby, even if ink leaks from the ink outlet port, the connection terminal can be prevented from being stained with the ink.

22 Claims, 36 Drawing Sheets

FOREIGN PATENT DOCUMENTS

| | | | |
|---|---|---|---|
| EP | 0 498 117 | A2 | 8/1992 |
| EP | 0 715 958 | A2 | 12/1996 |
| JP | 5-16379 | | 1/1983 |
| JP | 60-198256 | | 10/1985 |
| JP | 3-227650 | | 10/1991 |
| JP | H04-214360 | A | 8/1992 |
| JP | H07-148940 | A | 6/1995 |
| JP | 10-114085 | | 5/1998 |
| JP | 10-138506 | A | 5/1998 |
| JP | 2000-37879 | A | 2/2000 |
| JP | 2000-343723 | | 12/2000 |
| WO | WO 00/58100 | A1 | 10/2000 |

* cited by examiner

INK CARTRIDGE FOR USE WITH RECORDING APPARATUS AND INK JET RECORDING APPARATUS

This is a divisional of application Ser. No. 09/937,130 filed Jan. 29, 2002; the disclosure of which is incorporated herein by reference.

TECHNICAL FIELD

The present invention relates to an ink cartridge which is detachably mounted on a recording apparatus and supplies ink to a recording head, and an ink jet recording apparatus for mounting the ink cartridge thereon.

BACKGROUND ART

An ink-jet recording apparatus is usually equipped with an ink-jet recording head which is mounted on a carriage and moved in the widthwise direction of recording paper, and paper feed means for moving the recording paper in the direction orthogonal to the traveling direction of the recording head. On the basis of print data, ink droplets are ejected from the recording head, thus recording the data on the recording paper.

The recording head is mounted on the carriage, and is capable of ejecting ink droplets of, for example, black, yellow, cyan, magenta, etc. Accordingly, the ink-jet recording apparatus enables full-color printing by changing the proportions of ink types, as well as effecting text printing with black ink.

Incidentally, in order to effect a comparatively-high volume of printing, a recording apparatus of this type supplied for, for example, an office or business purpose, requires use of high-volume ink cartridges. To this end, there has been provided a recording apparatus, in which ink cartridges (referred to also as main tanks) are fitted to a cartridge holder provided, for example, to an apparatus main body.

In the recording apparatus, sub-tanks are disposed on the carriage having the recording head, and the respective sub-tanks are replenished with ink from corresponding ink cartridges by way of ink supply tubes. The sub-tanks, in turn, supply ink to the recording head.

Recently, growing demand exists for a large-size recording apparatus capable of effecting printing on larger-size paper, in which a carriage travels a longer scan distance. In order to improve throughput of such a recording apparatus, a larger number of nozzles are provided in a recording head.

Further, demand exists for a recording apparatus which sequentially supplies ink to the respective sub-tanks mounted on the carriage from corresponding ink cartridges while performing printing operation, in order to improve throughput, and which stably supplies ink from the respective sub-tanks to the recording head.

In such a recording apparatus, since the carriage travels over a longer scan distance, the lengths of respective ink supply tubes for connecting the ink cartridges to the sub-tanks correspondingly to ink types inevitably increase.

Further, as mentioned above, a larger number of nozzles are provided in the recording head. Hence, such a recording apparatus encounters a technical problem of deficient ink supply to the sub-tanks because the recording head consumes a large quantity of ink, and an increase in the dynamic pressure (i.e., pressure loss) of ink is likely to occur within each of the ink supply tubes interconnecting the ink cartridges and the sub-tanks.

As one measure to prevent this technical problem, there maybe employed, for example, a construction in which air pressure is applied to the ink cartridges to forcibly inducing ink flows from the ink cartridges to the sub-tanks under air pressure. This construction makes it possible to supply a sufficient amount of ink to the sub-tanks.

An ink cartridge used in the thus constructed recording apparatus can preferably adopt such constitution that a case defining an outer shell of the ink cartridge is formed so that the inside of the case is hermetically sealed, and an ink pack formed from flexible material and sealingly filled with ink is housed in the case.

The ink pack in the thus constructed ink cartridge acts so that ink is pushed out by pressurized air applied to the inside of the case and fed out to the recording head mounted on the carriage.

DISCLOSURE OF THE INVENTION

Recently, a field in which this kind of recording apparatus is used is enlarged increasingly, and diversification of the recording apparatus is also proceeding, for example, more precise print quality is required. With this diversification, the kind of ink used in the recording apparatus is also diversified, so that such a use that the cartridge is exchanged according to printed contents to execute printing comes to be made.

Accordingly, in order to control the kind of ink and ink residual amount in each ink cartridge, an ink cartridge provided with a semiconductor storage means that can read out and write data is proposed.

In case that the ink cartridge having the above-mentioned function of introducing the pressurized air therein to feed out the ink and a function of giving and receiving data between the ink cartridge provided with the semiconductor storage means and the recording apparatus body is mounted on a cartridge holder of the recording apparatus, there is required the constitution in which the pressurized air can be introduced in the ink cartridge and simultaneously the ink can be lead to the outside from the ink cartridge, and further in which connection of a circuit board is also performed simultaneously in order to give and receive data between the semiconductor storage means and the recording apparatus body.

In this case, positioning accuracy when the cartridge is mounted in the holder is an important factor in order to establish some mechanical and electrical connection.

Further, since the ink cartridge has the function of forcedly pushing out the ink by the pressurized air, in case that ink leakage is produced by some trouble, it is necessary to effectively prevent such a disadvantage that the connection terminal portion of the aforesaid circuit board is stained with the leaking ink.

The present invention has been made on the basis of such a technical problem, and a first object of the invention is to provide a positioning mechanism in which mechanical and electrical connection is performed reliably, and to provide an ink cartridge in which a stain of a connection terminal portion of a circuit board can be prevented effectively even if ink leakage is produced by some trouble of the cartridge and an ink jet recording apparatus using the same.

Further, in an ink cartridge provided with a semiconductor storage means that can read out and write data in order to control the kind of ink and ink residual amount in each ink cartridge, as the aforesaid storage means, EEPROM is preferably used. It is necessary for this storage means to take readiness for attachment to the cartridge case and readiness for detachment from the case for the purpose of recycle into consideration.

It is greatly requested that the cartridge is so constructed: when the cartridge has been mounted on the recording apparatus, electrical connection to the circuit board provided with the semiconductor storage means is ensured; and in a state where the cartridge is detached, a user cannot unintendedly touch an electrode contact formed in the circuit board with a tip of his finger.

The present invention has been made on the basis of the aforesaid technical request, and a second object of the invention is to provide an ink cartridge for use with a recording apparatus in which recycle of a semiconductor storage means is facilitated, electrical connection to a circuit board is ensured by attachment to the recording apparatus, and a user cannot unintendedly touch an electrode contact formed on the circuit board in a state where the cartridge has been detached.

In the ink cartridge so constructed that ink is fed out by introducing the pressurized air, in order to prevent the ink from leaking from an ink outlet port in a state where the cartridge is not mounted, an ink outlet plug preferably having a valve mechanism is provided for the ink outlet port. And, it is necessary to construct the cartridge so that the valve mechanism is opened to lead the ink to the outside in case that the cartridge has been mounted on the recording apparatus.

However, as described before, in the recording apparatus having the function of feeding out the ink by introducing the pressurized air in the cartridge case, in a transition period when the ink cartridge is attached to or detached from the recording apparatus, a seal function of the valve mechanism becomes insufficient. In case that the cartridge case receives the pressurized air under this state, ink leakage is produced from the ink outlet port, so that a problem that the inside of the apparatus is stained with the leaking ink is produced.

Accordingly, in the recording apparatus using this kind of cartridge which feeds out the ink from the ink pack by action of the pressurized air, it is important to perform adjustment between a timing when the ink outlet port formed on the ink cartridge side is connected to the recording apparatus side and a timing when the pressurized air can be introduced in the cartridge case. Further, also in the ink cartridge is detached from the recording apparatus, it is necessary to similarly adjust a timing of connection release between the cartridge and the recording apparatus.

The present invention has been made on the basis of such a technical problem, and a third object of the invention is to provide an ink cartridge for use with a recording apparatus, and an ink jet recording apparatus, which can adopt a connection mechanism for avoiding an ink pack from receiving the action of the pressurized air in case that the cartridge is attached to or detached from the recording apparatus, thereby reliably preventing production of ink leakage caused due to the action of the pressurized air.

Further, the recording apparatus having the aforesaid constitution has a technical problem that air bubbles enter into an ink supplying passage when the ink cartridge is attached to the cartridge holder, so that a printing trouble is caused.

This is because an ink inlet tube to be connected to the ink cartridge is provided for the cartridge holder, air which exists between the ink inlet tube and the ink outlet plug on the cartridge side is captured into the ink outlet plug portion by attachment of the ink cartridge and not discharged, and this air mixes in the ink.

The present invention has been made in order to solve such a technical problem, and a fourth object of the invention is to provide a connection structure for an ink cartridge, in which entry of air into the ink outlet plug portion when the ink cartridge is connected to the cartridge holder can be prevented thereby to prevent production of printing trouble, and to provide an ink jet recording apparatus using this connection structure.

Further, in the ink cartridge used in the recording apparatus having the aforesaid constitution, it is necessary to provide an ink outlet section so constructed that ink leakage can be prevented in a non-attaching state to the recording apparatus, and the ink can be smoothly fed out to the recording apparatus in an attaching state to the recording apparatus.

Therefore, such constitution of the ink cartridge can be preferably used that an annular packing member and a movable valve member are provided for the ink outlet section.

According to the ink cartridge having the thus constructed ink outlet section, since the valve member is joined to an end surface of the packing member in a non-attachment state to the recording apparatus, it is effectively prevented that ink leaks from a central opening in the annular packing member.

Further, at the attaching time to the recording apparatus, a leading end portion of the ink inlet tube that enters into the central opening in the packing member in relative slide-contact with the opening and that is arranged on the recording apparatus side comes into contact with the valve member and acts so as to push back the valve member. Accordingly, the ink can be smoothly supplied to the recording apparatus side through the ink inlet tube.

Further, according the ink cartridge having the ink outlet section, even if the attachment and detachment of the ink cartridge in relation to the recording apparatus are repeated according to necessity, it is possible to prevent a problem of deterioration of the packing member by repeated taking-out and putting-in of the ink inlet tube arranged on the recording apparatus, so that durability can be also obtained.

However, since the annular packing member provided for the ink outlet section having the aforesaid constitution is brought into slide-contact with the outer surface of the ink inlet tube on the recording apparatus in case that the cartridge is attached to the recording apparatus, it must have the inner diameter that is thinner a little than the outer diameter of the ink inlet tube.

In case that the inner diameter of the packing member is formed as a cylindrical inner surface of the same dimension, the entire surface of the inner surface of the packing member is uniformly brought into slide-contact with the outer surface of the ink inlet tube on the recording apparatus side when the cartridge is attached to the recording apparatus.

Therefore, large mechanical frictional resistance is produced when the cartridge is attached to the recording apparatus. On the other hand, in case that the cartridge is detached from the recording apparatus, since ink is stuck onto the outer surface of the ink inlet tube, the frictional resistance becomes very small at the detachment time.

Accordingly, particularly in case that the ink cartridge is attached to the recording apparatus, there is produced a problem that the annular packing member, upon reception of the frictional resistance, receives such abnormal deformation that the cylindrical inner surface of the inner part turns sideways, and is kept attached in the turning state.

Accordingly, in case that the packing member is receiving the abnormal deformation for a comparatively long time and the cartridge is detached under this state, the joint state of the valve member to the packing member becomes bad, so that a problem of production of ink leakage is produced.

The present invention has been made in order to solve the aforesaid problem, and a fifth object of the invention is to provide an ink cartridge which can prevent an annular packing member from deforming abnormally particularly in case that the ink cartridge is attached to a recording apparatus, and which can find out reliably an error of incorporating direction of the packing member in a state where the packing member has been incorporated into the ink outlet section.

On the other hand, in the above-mentioned ink jet recording apparatus, it is necessary to prevent ink which are different in the kind of color from being mixed with each other due to wrong connection between the ink cartridge and the cartridge holder at the exchanging time of the ink cartridge.

Further, it is necessary to prevent not only ink which are different in the kind of color but also ink which are different in each composition (for example, dye ink and pigment ink) from being mixed with each other.

Therefore, in order to prevent the wrong attachment (wrong insertion) of the ink cartridge, a protuberance and a recess are formed respectively at the ink cartridge and the cartridge holder, and they are fitted to each other in case that the ink cartridge is attached to the cartridge holder right.

However, in order to prevent the aforesaid wrong insertion of the ink cartridge, prevent mixing of ink which are different in each composition and use of an ink cartridge which is not adapted to a type of apparatus, and realize good printing, it is necessary to form many recesses and protuberances.

Therefore, the ink cartridge and the cartridge holder must be formed according to each kind of color, each composition, each type of apparatus, which causes a problem of high cost of a metal mold.

Further, in case that many recesses and protuberances are formed, a size of the ink cartridge and cartridge holder must be made large. On the other hand, in case that the recesses and protuberances are formed in the limited space, the number of them must be limited. Therefore, in case that ink information data increases, the necessary information data cannot be identified, so that there is fear that not only ink different in composition are mixed but also the ink cartridge which is not adapted to a type of apparatus is used.

The present invention has been made in order to solve such a problem. A sixth object of the invention is to provide an ink cartridge which can reduce cost and ensure good printing, its connection structure, and an ink jet recording apparatus using the same.

According the afore-mentioned constitution of the ink outlet plug in which the annular packing member and the movable valve member are provided for the ink outlet section of the ink cartridge, for example, in case that a user opens the valve member by inserting a stick matter such as a screw driver into the ink outlet plug, a problem that the open air flows into the ink pack is produced.

In case that the ink cartridge has been attached to the recording apparatus under this state, there is caused a problem that the air flowing in the ink pack is fed to the recording head side and ejection failure of ink droplets is produced.

Further, in case that a trouble has been produced in an ink supply valve arranged in an ink flow passage for connecting a main tank and a sub-tank at the printing time, there may be produced a problem that the ink fed out from the cartridge to the recording apparatus side flows again in the ink pack (flows reversely). Therefore, there is also a problem that it is impossible to ensure degassed rate of ink and cleanness in the ink pack of the cartridge.

The present invention has been made in order to solve these technical problems, and a seventh object of the invention is to provide an ink cartridge which can prevent the inflow of air and the reverse flow of ink with respect to the inside of the ink pack, and which can ensure degassed rate and cleanness of ink in the ink pack, and to provide an ink jet recording apparatus using this cartridge.

According to the first aspect of the invention made in order to achieve the aforesaid objects, an ink cartridge for use with a recording apparatus includes an ink pack which is formed from flexible material and sealingly stores ink therein, and a cartridge case which houses the ink pack therein and is formed hermetically, in which pressurized air is introduced in the case in a mounted state to a recording apparatus. In this ink cartridge, on a surface of the cartridge case, there are arranged positioning means used for mounting the ink cartridge to the recording apparatus, an ink outlet port from the ink pack, an inlet port for the pressurized air and a connection terminal of a circuit board having data storage means.

In this case, the positioning means is preferably constructed by an opening hole formed so as to surround a positioning pin arranged in the recording apparatus.

In a preferable example, the opening holes constructing the positioning means are arranged at two locations along the longitudinal direction on the aforesaid one surface of the case, and substantially in the center between the opening holes, the ink outlet port from the ink pack is arranged.

Further, preferably, outsides the opening holes arranged at the two locations, the connection terminal of the circuit board and the inlet port for the pressurized air are respectively arranged.

According to the thus constructed ink cartridge, on one surface of the cartridge case, the positioning means used in a case that the cartridge is mounted to the recording apparatus is arranged, and similarly on the one surface thereof, the ink outlet port from the ink pack, the inlet port for the pressurized air, and the connectional terminal of the circuit board having the data storage means are concentratedly arranged. Therefore, the one surface of the cartridge case is positioned by the positioning means, where by positional alignment of each mechanical and electrical connection mechanism can be accurately performed, so that positioning accuracy can be improved.

Since the positioning means provided to the cartridge case is constructed by the opening holes formed so as to surround the positioning pins arranged in the recording apparatus, and these opening holes are arranged at two locations along the longitudinal direction on the aforesaid one surface of the case, the cartridge can be positioned three-dimentionally by action between the two opening holes and the two positioning pins arranged in the recording apparatus.

On the other hand, by the invention, an ink jet recording apparatus that can mount the ink cartridge of the first aspect thereto is also provided. This ink jet recording apparatus is so constructed that the connection terminal of the circuit board is located at the upper portion in a gravity direction with respect to the ink outlet port in a state where the ink cartridge has been mounted using the positioning means arranged on the one surface of the cartridge case.

Since the cartridge is mounted to the recording apparatus with such the positional relation, even if ink leakage is produced from the ink outlet port of the cartridge by some trouble, it is possible to prevent the connection terminal portion of the circuit board from being stained with the leaking ink. Accordingly, it is possible to ensure the normal operation of the recording apparatus and to provide a recording apparatus having good reliability.

Then, an ink cartridge for use with a recording apparatus according to the second aspect of the invention is provided with a circuit board having a data-readable storage means that can store ink information therein, and is mounted detachably to the recording apparatus. The circuit board is attached to the cartridge case within an opened box-shaped space whose two surfaces intersect at right angles are open. Means for attaching the circuit board is exposed toward the opened one surface, and a terminal mechanism arranged on the recording apparatus is connected to the circuit board electrically through the opened other surface in a state where the cartridge is mounted on the recording apparatus.

In this case, preferably, the circuit board attaching means is constructed by a projection for heat-welding formed integrally with the cartridge case. The projection for heat-welding is passed through a part of the circuit board, and a top of the projection is heat-caulked, whereby the circuit board is attached to the cartridge case.

In a preferred example, in the ink cartridge, there is housed an ink pack which is formed from flexible material and sealingly stores ink therein, and pressurized air is introduced in the case in the mounted state to the recording apparatus.

According to the thus constructed ink cartridge, the box-shaped space is formed at a part of the cartridge case, and the circuit board having the data-readable storage means which can store the ink information therein is attached in this box-shaped space.

In this case, two surfaces of the box-shaped space that cross at right angles are opened, and the circuit board attaching means is exposed toward the opened one surface. Therefore, attachment and detachment of the circuit board can be readily performed.

In case that the cartridge is mounted to the recording apparatus, the terminal mechanism arranged on the recording apparatus is connected to the circuit board electrically through the opened other surface.

Since the circuit board is arranged in the box-shaped space, it is possible to effectively prevent a user from unintendedly touching the electrode contacts formed in the circuit board with the tip of his finger, whereby the electrical connection state between the circuit board mounted on the cartridge and the recording apparatus can be kept good.

Next, an ink jet recording apparatus according to the third aspect of the invention is provided with an ink cartridge constructed by an ink pack which is formed from flexible material and sealingly stores ink therein and a cartridge case which houses the ink pack therein and is formed hermetically, in which pressurized air can be introduced in the case. In this ink jet recording apparatus, a connection mechanism is provided, in which in case the ink cartridge is mounted to the recording apparatus side, after an ink outlet port formed on the ink cartridge side is connected to the recording apparatus, a pressurized air inlet port formed on the ink cartridge side is connected to the recording apparatus side.

In this case, preferably, the cartridge case has positioning means used in case that the cartridge is mounted to the recording apparatus. Under a state where the positional relation of the ink cartridge to the recording apparatus has been determined by the positioning means, the ink outlet port and the pressurized air inlet port are sequentially connected to the recording apparatus side.

In addition, a data-readable storage means that can store therein information data of ink sealed in the ink pack is provided to the ink cartridge. Preferably, the connection mechanism includes terminal mechanism in which in case the ink cartridge is mounted to the recording apparatus side, after the pressurized air inlet port is connected to the recording apparatus side, the electrical connection to the storage means is performed.

In case that the aforesaid connection timing between the storage means on the cartridge side and the terminal mechanism on the recording apparatus side is adopted, it is desirable that upon detection of the electrical connection of the terminal mechanism on the recording apparatus side to the storage means on the cartridge side, a pressure pump for generating pressurized air can be driven.

On the other hand, an ink cartridge for use with the recording apparatus according to the third aspect of the invention is constructed by an ink pack which is formed from flexible material and sealingly stores ink therein and a cartridge case which houses the ink pack therein and is formed hermetically at an outer shell thereof, in which pressurized air can be introduced in the case from the recording apparatus side in the mounted state to the recording apparatus. In case the ink cartridge is mounted to the recording apparatus side, after an ink outlet port formed on the ink cartridge side is connected to the recording apparatus, a pressurized air inlet port formed on the ink cartridge side is connected to the recording apparatus side.

In this case, preferably, the cartridge case has positioning means used in case that the cartridge is mounted to the recording apparatus. Under a state where the positional relation of the ink cartridge to the recording apparatus has been determined by the positioning means, the ink outlet port and the pressurized air inlet port are sequentially connected to the recording apparatus side.

In addition, a data-readable storage means that can store information data of ink sealed in the ink pack therein is provided to the ink cartridge. In case the ink cartridge is mounted to the recording apparatus side, desirably, after the pressurized air inlet port is connected to the recording apparatus side, the storage means is electrically connected to a terminal mechanism on the recording apparatus side.

More preferably, the pressurized air inlet port provided to the ink cartridge is formed in the shape of a hollow cylindrical member formed integrally with the cartridge case, and a length in the axial direction of a cylindrical surface of the cylindrical member constituting the inlet port is 2 to 20 mm.

By combination of the thus constructed ink jet recording apparatus and ink cartridge, the connection mechanism provided on the recording apparatus has a dimensional relation in which after the ink outlet port on the ink cartridge side is connected to the recording apparatus side, the pressurized air inlet port is connected to the recording apparatus. Therefore, in case that the ink cartridge is mounted to the recording apparatus, after the ink outlet port is connected to the recording apparatus side, the pressurized air is introduced in the cartridge case.

Accordingly, it is possible to prevent ink from leaking from the ink outlet port of the cartridge upon reception of action of the pressurized air in the middle of attachment of the ink cartridge.

Further, in connection with the aforesaid dimensional relation, in case that the ink cartridge is detached from the recording apparatus, the operation is performed in the following order: the pressurized air inlet port is firstly taken off from the recording apparatus side, and then the ink outlet port is taken off from the recording apparatus side.

Accordingly, in a state where the ink out port is taken off from the recording apparatus side, the pressurized air inlet port has already opened to air, so that it is possible to similarly prevent ink from leaking from the ink outlet port of the cartridge upon reception of action of the pressurized air.

Further, since the positioning means for mounting to the recording apparatus is provided to the cartridge case, the positional relation in the attachment and detachment of the ink cartridge with respect to the recording apparatus is determined. Therefore, the aforesaid order of the attachment and detachment of the ink outlet port and the pressurized air inlet port can be ensured more reliably.

In case that the ink cartridge having the data-readable storage means that can store therein information data on the ink sealed in the ink cartridge is used, after the pressurized air inlet port is connected to the recording apparatus side, the terminal mechanism arranged in the connection mechanism is electrically connected to the storage means.

In case that it has been detected that the terminal mechanism is electrically connected to the storage means, the pressure pump for generating pressurized air can be driven. Hereby, upon completion of the mechanical connection state, an operation of introducing the pressurized air in the cartridge is executed.

Accordingly, idle drive of the pressure pump can be prevented, and an introduction timing of the pressurized air can be controlled more suitably.

Further, in a connection structure for an ink cartridge according to the fourth aspect of the invention, there are provided a cartridge holder having an ink inlet tube that connects to a recording head through an ink flow passage, and an ink cartridge having an ink outlet tube that can communicate with the ink inlet tube of the cartridge holder and a valve body for opening and closing an ink outlet port of this ink outlet tube; by forcing the ink inlet tube into the ink outlet tube of the ink cartridge, the valve body is pressed to thereby open the ink outlet port; and the ink outlet tube and the ink inlet tube are communicated with each other, so that the ink cartridge is connected to the cartridge holder. Further, the connection structure is characterized in that a protuberance for pressing the valve body is provided on an end surface on the forced side of the ink inlet tube and an air discharging passage that communicates with the inside and outside of the ink outlet port in an air discharging state produced by forcing the ink inlet tube into the ink outlet tube is provided to the protuberance.

By this constitution, since the ink inlet tube starts to force into the ink outlet tube, till the protuberance presses the valve body and the ink outlet port is opened, the air in the ink outlet port is discharged through the air discharging passage to the outside of the ink outlet tube.

Accordingly, since the entry of air into the tube can be prevented at the ink cartridge connecting time, air bubbles do not exist in the ink in the ink flow passage, so that production of printing trouble can be prevented.

In this case, it is desirable that the air discharging passage is a recess groove formed on the outer surface of the protuberance. By this constitution, the air discharging passage can be formed as a single linear passage.

Therefore, forming of the air discharging passage constructed by the recess groove is performed more readily and reliably than boring machining of an air discharging passage constructed two or more linear passages (bending passage).

Further, it is desirable that a recess fittable to the protuberance is provided to the valve body. By this constitution, axis alignment between the ink inlet tube and the ink outlet tube can be performed readily and reliably at the connection time of the ink cartridge.

Further, it is desirable that a tapered portion for guiding the ink inlet tube into the ink outlet tube is formed on each fitting surface of the recess and the protuberance. By this constitution, the ink inlet tube can be smoothly forced into the ink outlet tube.

Further, according to the fourth aspect of the invention, an ink jet recording apparatus having the aforesaid connection structure is also provided. This ink jet recording apparatus includes an ink jet recording head that is mounted on a carriage and moves in the widthwise direction of a recording sheet, and a sheet feeding means for relatively feeding the recording sheet in the direction orthogonal to a moving direction of this recording head, and further is characterized by using the aforesaid connection structure of the ink cartridge.

By this constitution, it is possible to provide an ink jet recording apparatus that can prevent production of printing trouble.

Further, an ink cartridge for use with a recording apparatus according to the fifth aspect of the invention is an ink cartridge which stores ink therein and includes an ink outlet section for feeding out the ink to the recording apparatus side in a mounted state to the recording apparatus. The ink outlet section includes an annular packing member and a movable valve member. In a non-mounted state to the recording apparatus, the valve member contacts an one end surface of the packing member to thereby prevent the outflow of ink, and in a mounted state to the recording apparatus, the contact of the valve member to the one end surface of the packing member is released to thereby enable the outflow of the ink. Further, at the other end surface of the packing member, at least one groove is formed so as to communicate from the inner surface of the central opening to the outer surface.

In this case, it is desirable that on the other end surface of the packing member, plural grooves are radially formed so as to communicate from the inner surface of the central opening to the outer surface.

Further, it is desirable that a spring member for urging the valve member to the one end surface of the packing member is provided. In the mounted state to the recording apparatus, by a leading end portion of an ink inlet tube which comes into slide-contact with the inner surface of the opening of the packing member and relatively enters into the opening, the valve member is pressed back, and the contact of the valve member with the one end surface of the-packing member is released.

Preferably, on the inner surface of the central opening of the annular packing member, an annular slide-contact portion of which the inner diameter is made thin in order to come into contact with the outer surface of the ink inlet tube arranged on the recording apparatus side is further formed, and the slide-contact portion is formed being offset toward the aforesaid one end surface side of the packing member with which the valve member is contacted.

On the other hand, preferably, the movable valve member includes a disc-shaped member for preventing the ink outflow by contact with the one end surface of the packing member, and plural guide members which are arranged intermittently along the periphery of the disc-shaped member and respectively extend in the moving direction of the valve member. In a state where the contact of the disc-shaped member with the one end surface of the packing member has been released, ink is led to the outside through gaps between the guide members arranged intermittently along the periphery of the disc-shaped member.

In a preferred example, the ink outlet section is arranged at a part of an ink pack that is formed from flexible material and stores ink therein, and it is attached to a part of the cartridge case that houses the ink pack therein so as to be exposed from the cartridge case.

Further, in a preferred example, the cartridge case is formed hermetically, and has a pressurized air inlet port which can introduce pressurized air into a space between the cartridge case and the ink pack.

According to the thus constructed ink cartridge of the fifth aspect, the annular slide-contact portion of which the inner diameter is made thin is formed on the inner surface of the central opening of the annular packing member attached to the ink outlet section. Therefore, in case that the ink cartridge is mounted to the recording apparatus, this slide-contact portion acts so as to come into contact to the outer surface of the ink inlet tube provided on the recording apparatus side.

Accordingly, when the ink cartridge is mounted to the recording apparatus, mechanical frictional resistance that the packing member receives between it and the ink inlet tube can be reduced.

In addition, since the slide-contact portion is formed being offset toward the one end surface side of the packing member with which the valve member is contacted, the slide-contact portion is deformed somewhat to the inside in the relative entry direction of the ink inlet tube by the friction between the ink inlet tube and it.

However, since there is a little relief clearance for the end portion on the interior side of the packing member, the packing member can prevent the cylindrical inner surface from becoming the abnormal deformation state upon reception of the frictional resistance, for example, a state where it turns sideways on the interior side.

On the other hand, on the other end surface of the packing member, at least one groove is formed so as to communicate from the inner surface of the central opening to the outer surface. Therefore, when the packing member is incorporated into the ink outlet section, in case that there is an error in the incorporated direction, seal cannot be provided between the valve member and the packing member.

Accordingly, as soon as ink is attempted to be sealed in the ink cartridge, the ink leaks from the ink outlet section, so that the above assembly failure can be found out reliably.

Further, in a connection structure for an ink cartridge according to the sixth aspect of the invention, there are provided a cartridge holder having an ink inlet tube that connects through an ink flow passage to a recording head, and an ink cartridge that is held detachably by this cartridge holder and has an ink outlet tube that can communicate with the ink inlet tube, and the ink cartridge is connected to the cartridge holder by communicating the ink outlet tube and the ink inlet tube with each other. This connection structure is characterized in that a recess and a protuberance that can fit or cannot fit to each other according to right/wrong in connection between the cartridge and the holder regarding the kind of ink color are formed between the cartridge holder and the ink cartridge, and in that a storage element for giving and receiving other ink information data than the kind of ink color in the fitting state of these recesses and protuberances and a data identification means are provided respectively on the ink cartridge side and on the cartridge holder side.

Under this constitution, by fitting of the protuberance and the recess, compatibility of the kind of ink color is detected, and other ink information data than the kind of ink color is read by the data identification means.

Accordingly, in case other ink information data than the kind of ink color is changed or added, correspondingly, the read data of the storage element can be changed or added. Therefore, it is not necessary to form the ink cartridge and the cartridge holder according to each kind of color, each composition, and each type of apparatus like the conventional case, and it is possible to reduce the cost.

Further, since the necessary ink information data can be identified by the data identification means, mixing of ink that are different in composition and use of the ink cartridge that is not adapted to a type of apparatus are prevented, so that good printing can be ensured.

In this case, it is desirable that the recess is provided to the cartridge holder and the protuberance is provided to the ink cartridge. By this constitution, when the ink cartridge is connected to the cartridge holder, the protuberance of the ink cartridge is fitted into the recess of the cartridge holder.

Further, the recess may be provided to the ink cartridge and the protuberance may be provided to the cartridge holder. By this constitution, when the ink cartridge is connected to the cartridge holder, the protuberance of the cartridge holder is fitted into the recess of the ink cartridge.

And, the storage means is mounted on an IC board. By this constitution, when the ink cartridge is connected to the cartridge holder, other ink information data than the kind of ink color is read from the storage element on the IC board.

In this case, it is desirable that at least one information data of classification of pigment/dye ink, residual ink amount, serial number, expiration date, and the intended type of apparatus is stored in the storage means. By this constitution, other ink information data than the kind of ink color can be read from the storage means by the data identification means.

And the plural recesses and protuberances are provided. Hereby, with increase of the number of the recesses and protuberances, correspondingly the kind of ink color can be changed to many kinds or added.

On the other hand, an ink cartridge according to the sixth aspect of the invention is an ink cartridge that is detachably connected to a cartridge holder having an ink inlet tube leading to a recording head and provided with an ink pack having an ink outlet tube that can communicate with the ink inlet tube. This ink cartridge is characterized in that there are provided a recess or a protuberance that can fit or cannot fit to the cartridge holder by right/wrong in connection between the ink pack and the cartridge holder regarding the color kind of ink supplied to the recording head, and a storage element for giving and receiving other ink information data than the color kind of ink.

Under this constitution, by fitting of the recess and the protuberance, fitness of the kind of ink color is detected, and other ink information data than the kind of ink color is read by the data identification means.

Accordingly, in case other ink information data than the kind of ink color is changed or added, the read data of the storage element can be correspondingly changed or added. Therefore, it is not necessary to form the ink pack and the cartridge holder according to each kind of color, each composition, and each type of apparatus like the conventional case, and it is possible to reduce the cost.

Further, since the necessary ink information data can be identified by the data identification means, mixing of ink that are different in composition and use of the ink cartridge that is not adapted to a type of apparatus are prevented, so that good printing can be ensured.

Further, an ink jet recording apparatus according to the sixth aspect of the invention is characterized, in an ink jet recording apparatus having a carriage for mounting a head that can reciprocate between a printing region and a non-printing region, by using the aforesaid connection structure of ink cartridge or the ink cartridge.

By this constitution, an ink jet recording apparatus can be obtained, which can reduce cost and execute good printing.

Further, an ink cartridge according to the seventh aspect of the invention includes an ink outlet tube that is removable inserted into an ink inlet tube that connects through an ink flow passage to a recording head, and an ink pack that is connected to this ink outlet tube and seals ink therein. This ink cartridge is characterized in that: a first valve body that is opened and closed by attachment and detachment of the ink inlet tube is provided in the ink outlet tube; a second valve body located on the ink supplying side of this first valve body is provided; the second valve body is constructed by a check valve that usually closes a tube passage of the ink outlet tube and opens it by flow of ink at the ink supplying time to the recording head.

Under this constitution, when ink flows out of the ink pack in an attachment state of the ink inlet tube and the ink outlet tube, the closed second valve body is opened upon reception of this flowing force, so that the ink outlet tube and the ink inlet tube are communicated with each other.

On the other hand, the open air and reverse-flowing ink flow into the ink outlet tube, and the closed second valve body is kept closed upon reception of this flowing force, so that the ink outlet tube and the ink inlet but are not communicated with each other.

Accordingly, inflow of the open air and reverse flow of ink to the ink pack can be prevented, so that degassed rate of ink in the ink pack and cleanness can be ensured.

In this case, it is desirable that the second valve body is constructed by a thin piece. By this constitution, at the valve closing time, one end surface of the second valve body closes the tube passage of the ink inlet tube.

Further, the second valve body is a valve body that can move in the direction of an axial line of the tube passage. By this constitution, the second valve body moves in the direction of the axial line of the tube passage and enters from the closed state to the opened state, or enters from the opened state to the closed state.

Further, the second valve body may be formed from elastic-deformable material. Hereby, the second valve body is fixed to the ink outlet tube, and can be functioned as a check valve.

Further, the second valve body may be composed of a spherical member. Hereby, at the closing time, the spherical surface of the second valve body closes the tube passage of the ink inlet tube.

In this case, it is desirable that specific gravity of the second valve body is the same as that of ink. Hereby, the movement of the second valve body is smoothly performed by flow of ink, and the second valve body exhibits a function of the check valve sufficiently.

Further, it is desirable that a stopper is provided between the first valve body and the second valve body. Hereby, the second valve body moves between the stopper and the valve-closed position along the axial line of the tube passage.

Further, it is desirable that a movement-regulating piece is provided sideward of the second valve body. Hereby, the movement of the second valve body in a direction orthogonal to the axial direction of the tube passage is regulated by the movement-regulating piece.

Further, it is desirable that a valve seat corresponding to the second valve body is formed projectingly on the ink supplied side. Hereby, if burr is produced at an edge portion of the second valve body so as to protrude, this produced burr can be positioned at a space around the valve body in the valve-closed state.

And, a recess that opens on the ink-supplied side is formed at the ink outlet tube, and a leading end portion of the movement-regulating piece is arranged in this recess. Hereby, it is possible to prevent the second valve body from entering between the recess forming surface and the leading end portion of the movement-regulating piece.

Further, an ink jet recording apparatus according to the seventh aspect of the invention has a carriage for mounting a head, which can reciprocate between a printing region and a non-printing region, and it is characterized by using the aforesaid ink cartridge. Hereby, an ink jet recording apparatus can be obtained, in which inflow of the open air and reverse flow of ink to the ink pack can be prevented and degassed rate of ink and cleanness in the ink pack can be ensured.

BEST MODE FOR CARRYING OUT THE INVENTION

An ink cartridge for use with a recording apparatus and an ink jet recording apparatus according to each aspect of the present invention will be described by reference to illustrated examples.

In the following description, a construction of an ink jet recording apparatus and a control method of ink replenishment to a sub-tank according to the present invention will be first discussed, and a construction of an ink cartridge according to each aspect of the present invention will be subsequently discussed.

Figure 1:
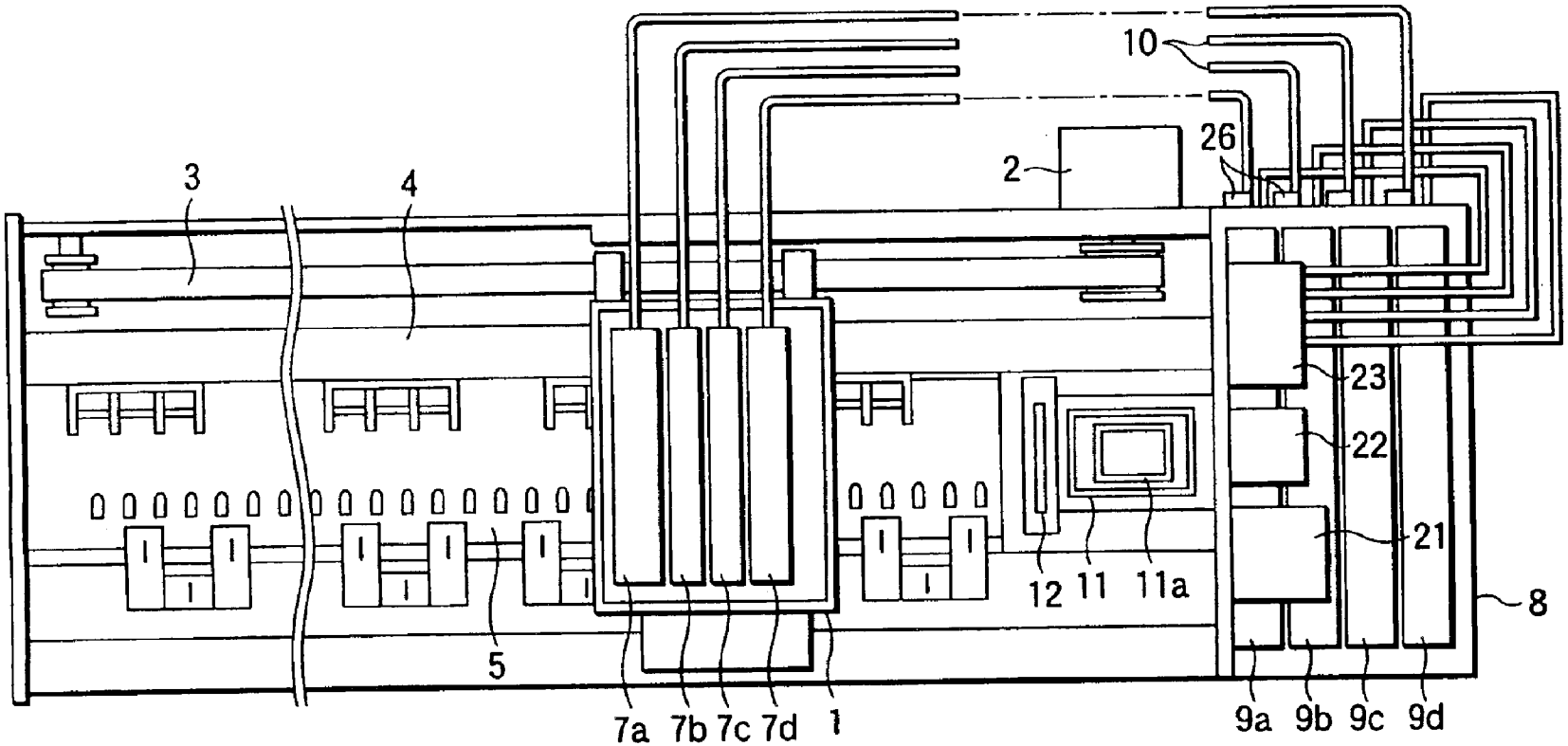
FIG. 1 is a plan view showing an example of an ink jet recording apparatus according to the invention.

FIG. 1 is a top view showing a construction of an ink jet recording apparatus according to the present invention. As shown in FIG. 1, reference numeral 1 designates a carriage. The carriage 1 is constructed so as to cause reciprocatory movement in the longitudinal direction of a paper feed member 5; that is, in the primary scanning direction identical with the widthwise direction of recording paper, while being guided by a scan guide member 4 by way of a timing belt 3 driven by a carriage motor 2.

Although not shown in FIG. 1, an ink-jet recording head 6 to be described later is mounted on the surface of the carriage 1, which surface opposes the paper feed member 5.

Sub-tanks 7*a* through 7*d* for supplying ink to the recording head are mounted on the carriage 1. In this example, four sub-tanks 7*a* through 7*d* are provided so as to correspond to the types of ink and for temporarily storing the ink therein.

The sub-tanks 7*a* through 7*d* are constructed such that black ink, yellow ink, magenta ink, and cyan ink are supplied to the sub-tanks 7*a* through 7*d* from corresponding main tanks 9*a* through 9*d* through tubes 10, 10 . . . serving as ink supply passages, respectively. The main tanks 9*a* through 9*d*, i.e. ink cartridges, are attached to a cartridge holder 8 provided on an end portion of the recording apparatus.

Capping means 11 capable of sealing a nozzle plate of the recording head is disposed in a non-print region (i.e., at the home position) on the travel path of the carriage 1. A cap member 11*a*—which is formed from flexible material, such as rubber, that is capable of sealing the nozzle plate of the recording head—is attached to the upper surface of the capping means 11. The capping means 11 is designed such that, when the carriage 1 is moved to the home position, the nozzle plate of the recording head is sealed with the cap member 11*a* in conjunction with this movement.

During the non-operating period of the recording apparatus, the cap member 11*a* seals the nozzle plate of the recording head, there by acting as a cover for preventing drying of nozzle apertures. Although not depicted, one end of a tube of a suction pump (i.e., a tube pump) is connected to the cap means 11, so that negative pressure generated by the suction pump is applied to the recording head, to thereby perform a cleaning operation for causing the recording head to discharge ink under suction.

A wiping member 12 formed from resilient material, such as rubber, is disposed adjacent to a print region side of the capping means 11 so as to wipe and clean the nozzle plate of the recording head as required.

Figure 2:
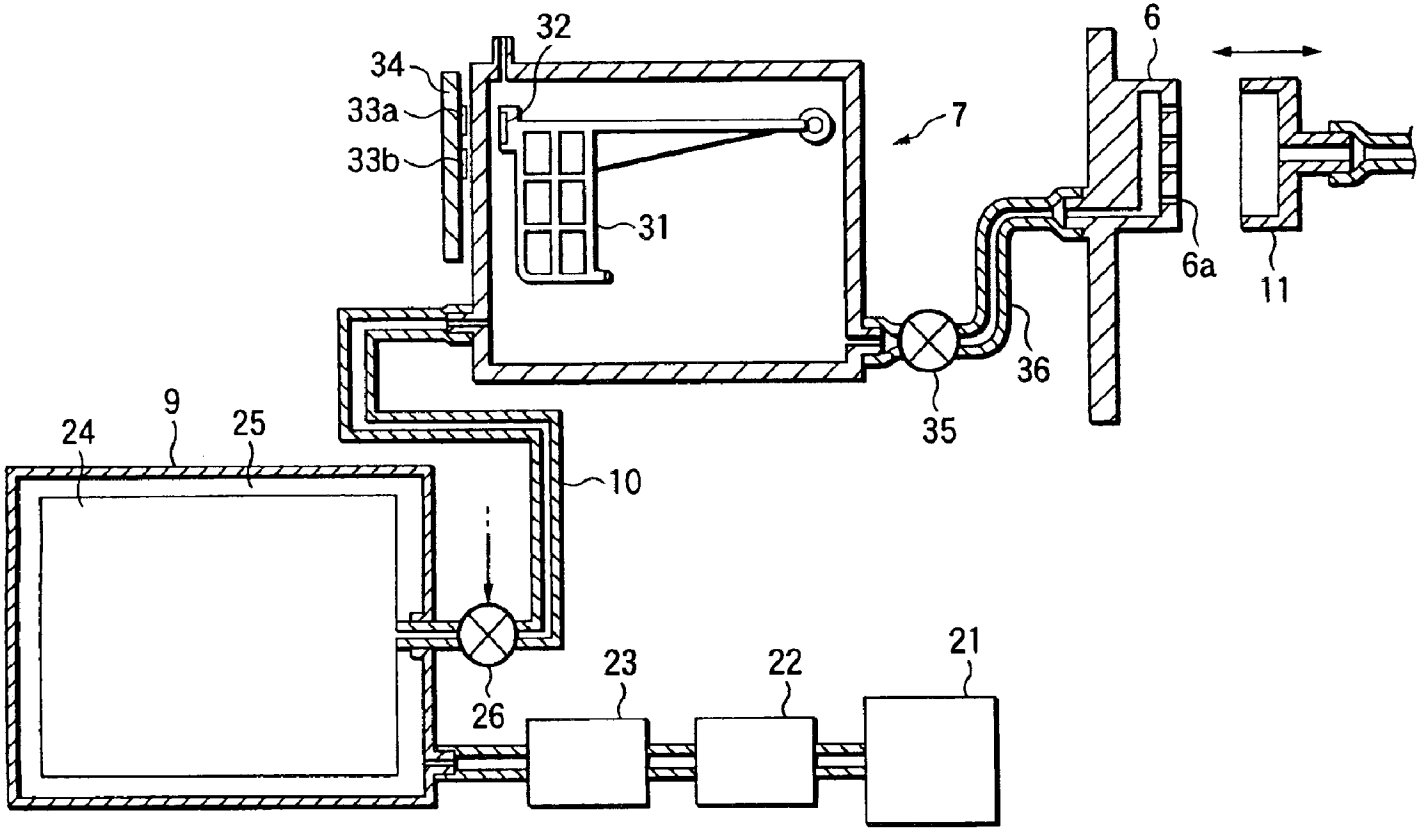
FIG. 2 is a schematic diagram showing an ink supply system extending from an ink cartridge to a recording head in the recording apparatus shown in FIG. 1.

FIG. 2 is a schematic drawing showing an ink supply system installed in the recording apparatus shown in FIG. 1. The ink supply system will now be described by reference to FIG. 2 in conjunction with FIG. 1, in which like elements are assigned like reference numerals. Referring to FIGS. 1 and 2, reference numeral 21 designates a pressurization pump. The air pressurized by the pressurization pump 21 is supplied to a pressure regulation valve 22. The pressurized air, pressure-adjusted by the pressure regulation value 22, is supplied to the respective main tanks 9*a* through 9*d* (the main tanks are designated in FIG. 2 by simply reference numeral 9, and the main tanks will often be described in singular form by use of only reference numeral 9) by way of a pressure detector 23.

As the construction of the main tank 9 is schematically shown in FIG. 2, the outer shell of the main tank 9 is formed hermetically. An ink pack 24 which is filled with ink and is formed from resilient material is housed in the main tank 9. The space defined by combination of the main tank 9 and the ink pack 24 constitutes a pressure chamber 25, and the pressurized air is supplied to the pressure chamber 25 by way of the pressure detector 23.

With such a construction, the ink packs 24 housed in the main tanks 9*a* through 9*d* are subjected to pressure stemming from the pressurized air, whereby ink flows from the main tanks 9*a* through 9*d* to the corresponding sub-tanks 7*a* through 7*d*.

The ink pressurized in each of the main tanks 9*a* through 9*d* is supplied to the corresponding one of the sub-tanks 7*a* through 7*d* mounted on the carriage 1, by way of the corresponding one of ink replenishment valves 26 and the corresponding one of the ink replenishment tubes 10 (the sub-tanks are designated in FIG. 2 by use of simply reference numeral 7, and hereinafter the sub-tanks will often be described in singular form by use of simply reference numeral 7).

The construction of the sub-tank 7 shown in FIG. 2 will be discussed in detail later, but the sub-tank 7 is basically constructed as follows: A float member 31 is provided within the sub-tank 7, and a permanent magnet 32 is attached to a part of the float member 31. Magnetoelectric converter elements 33*a* and 33*b* typified by Hall elements are mounted on a board 34, and the board 34 is disposed in close proximity to the side wall of the sub-tank 7.

With such an arrangement, an output generating means is constructed, which generates an electrical output in accordance with a float position of the float member 31 depending on an ink amount in the sub-tank. That is, in accordance with the amount of lines of magnetic force developing in the permanent magnet 32 according to the float position of the float member 31, the electrical output is generated by the Hall elements 33*a* and 33*b*.

When the level of the ink stored in the sub-tank 7 has lowered, the float member 31 housed in the sub-tank is moved under the force of gravity. In association with this movement, the permanent magnet 32 is also moved in the same direction. The electrical output produced by the Hall elements 33*a* and 33*b* in association with movement of the permanent magnet can be sensed as the level of the ink stored in the sub-tank 7. On the basis of the electrical output produced by the Hall elements 33*a* and 33*b*, the ink replenishment valve 26 is opened.

As a result, the pressurized ink in the main tank 9 is supplied to each corresponding sub-tank 7 whose ink level has lowered. When the ink stored in the sub-tank 7 has risen to a predetermined level, the valve 26 is closed on the basis of the electrical output produced by the Hall elements 33*a* and 33*b*.

By repetition of these operations, ink is intermittently replenished from the main tank to the sub-tank, thereby constantly storing substantially a given amount of ink within each sub-tank.

With such an arrangement, ink pressurized by the air pressure within each main tank is replenished to a respective sub-tank based on an electrical output indicative of a position of a float member disposed within the sub-tank. Accordingly, an ink replenishing response can be improved, and an amount of ink stored in each sub-tank can be managed appropriately.

Ink is supplied from the sub-tank 7 to the recording head 6 by way of a valve 35 and a tube 36 connected thereto. On the basis of print data supplied to the recording head 6, ink droplets are ejected from nozzle apertures 6*a* formed in the nozzle plate of the recording head 6. In addition, referring to FIG. 2, reference numeral 11 designates the previously-described capping means, and a tube connected to the capping means 11 is connected to an unillustrated suction pump.

Figure 3:
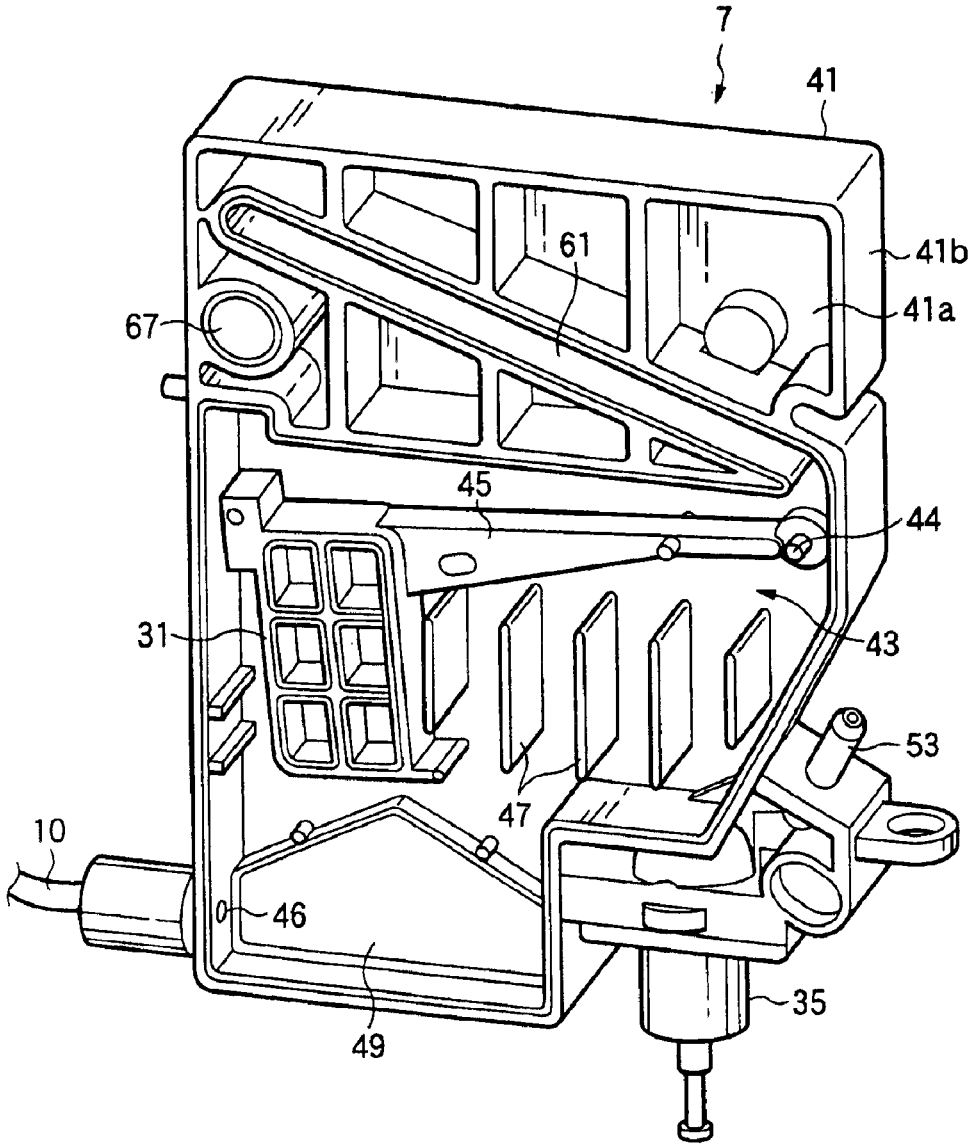
FIG. 3 is a perspective view of a sub-tank, partly broken away and viewed from one side.
Figure 4:
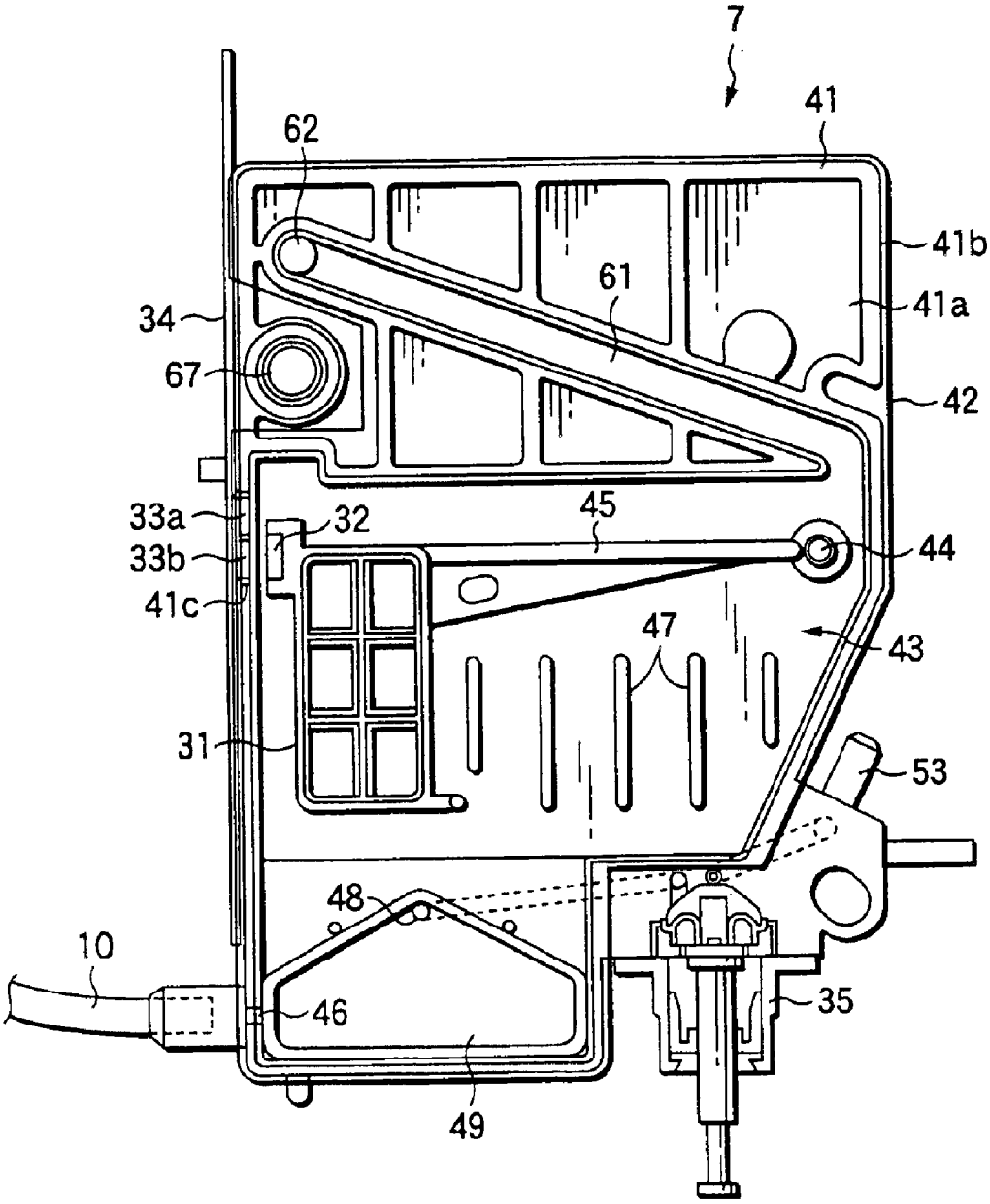
FIG. 4 is a perspective view in which the sub-tank is similarly viewed from one side.
Figure 5:
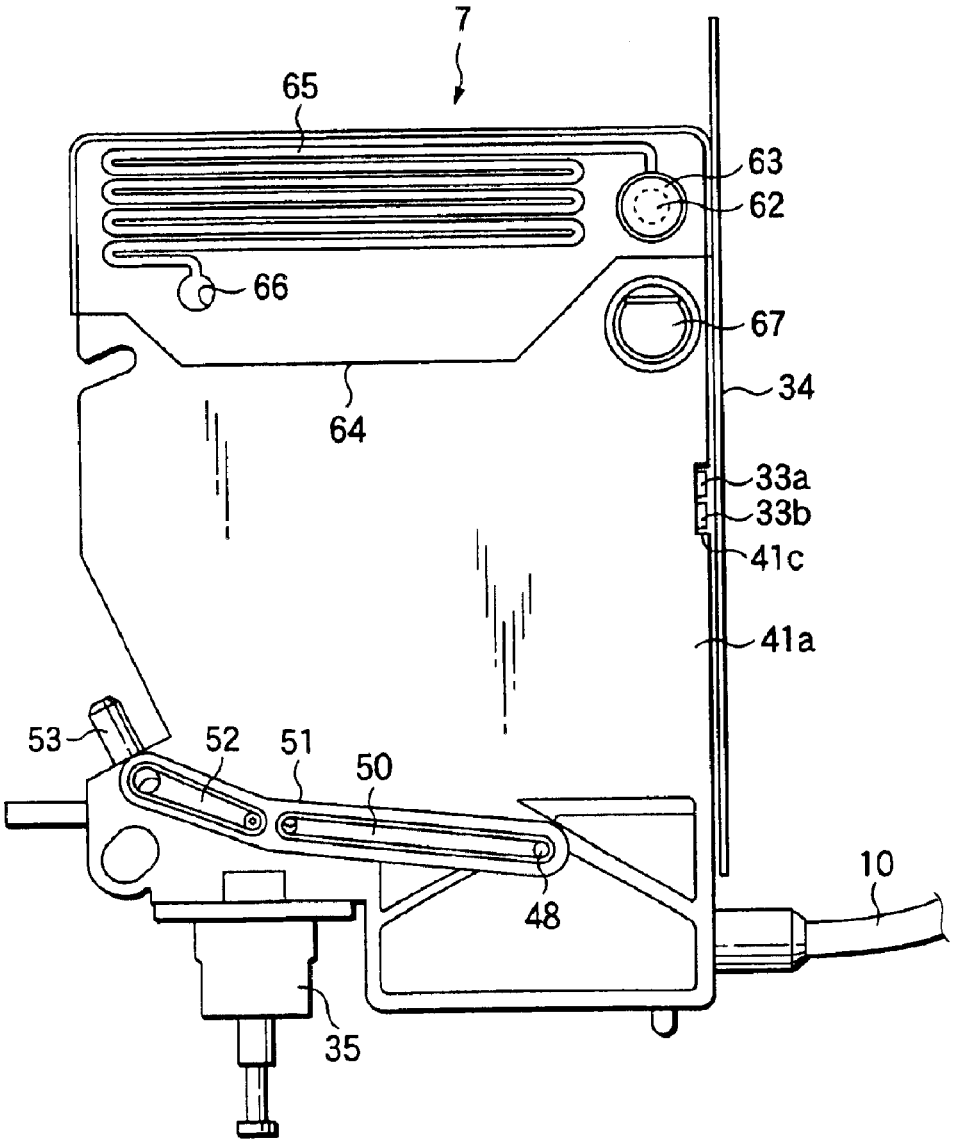
FIG. 5 is a rear diagram in which the sub-tank is viewed from a rear surface.

FIGS. 3 to 5 show an example of the sub-tank. FIG. 3 is a perspective view of the sub-tank from a one-face direction with a part of the sub-tank omitted, and FIG. 4 is a perspective view (a projection) of the sub-tank from the same direction. FIG. 5 is a rear view of the sub-tank from the rear direction. Parts identical with or similar to those previously described are denoted by the same reference numerals in FIGS. 3 to 5.

The sub-tank 7 is formed almost like a rectangular parallelepiped and the whole of the sub-tank is made flat. An outer shell of the sub-tank 7 includes a box-like member 41 formed with a one side wall 41*a* and a peripheral side wall 41*b* continuous and integral with the side wall 41*a*. A film-like member 42 made of a transparent resin (see FIG. 4) is attached to the opening periphery of the box-like member 41 in a close contact state by, for example, thermal welding means, so that an ink storage space 43 is formed in the inside surrounded by the box-like member 41 and the film-like member 42.

A support shaft 44 projected from the one side wall 41*a* forming a part of the box-like member 41 to the ink storage space 43 is formed integrally with the box-like member 41. The float member 31 is arranged within the ink storage space 43 and is rotatably movable in the gravity direction about the support shaft 44.

In this example, the support shaft 44 is disposed in the proximity of an end part of the ink storage space 43 in the horizontal direction, and the float member 31 is formed integrally on the movable free end side of a support arm member 45 movable about the support shaft 44.

As shown in FIG. 4, the permanent magnet 32 is attached to the free end side of the support arm member 45. When the support arm member 45 is placed almost in a horizontal state, the permanent magnet 32 is positioned in the proximity of an opposite end part of the ink storage space 43 in the horizontal direction, namely, is brought closest to the hall devices 33*a* and 33*b* mounted on the board 34 attached to the side wall of the sub-tank 7.

The hole devices 33*a* and 33*b* are inserted in a positioning recess 41*c* formed in the sidewall of the sub-tank 7. The formation of the positioning recess 41*c* reduces the thickness of the side wall portion of the sub-tank 7, thereby reducing a distance between the moving locus of the permanent magnet 32 attached to the float member 31 and each of the hole devices 33*a* and 33*b*.

On the other hand, the sub-tank 7 is formed with an ink replenishment port 46 in a lower part in the gravity direction, namely, in the bottom of the peripheral side wall 41*b* in this example, and the ink storage space 43 is replenished with ink from the main tank 9 via the tube 10 connected to the ink replenishment port 46.

The ink replenishment port 46 of the sub-tank 7 is formed in the lower part in the gravity direction as mentioned above. Accordingly, ink from the main tank is supplied through the bottom of the ink storage space 43. This arrangement prevents bubbles of ink in the ink storage space 43 as ink is supplied.

Further, the sub-tank 7 is provided with a plurality of rib members 47 for reducing waving of ink in the sub-tank, which would otherwise be caused in association with a movement of the carriage. These rib members 47 are located in a region so as not to interfere with a movable region where the float member 31 and the support arm member 45 are movable.

In this example, each of the rib members 47 is formed integrally with the one side wall 41*a* of the box-like member 41 forming the sub-tank 7, and projected from the one side wall 41*a* as a base toward the ink storage space 43, but each of these ribs 47 may be formed as a discrete member.

The provision of the rib members 47 can reduce the waving of ink in the sub-tank as mentioned above, thereby making it possible to improve the detection accuracy of ink storage amount in the sub-tank 7 by the hall devices.

In the sub-tank 7, an ink outlet 48 is formed in the proximity of the ink replenishment port 46. A filter member 49 of a pentagon (like a home plate) for trapping foreign substances is disposed to cover the ink outlet 48, and therefore ink stored in the sub-tank 7 is guided through the filter member 49 into the ink outlet 48.

Moreover, since the ink outlet 48 is formed in the proximity of the ink replenishment port 46, comparatively new ink introduced into the sub-tank 7 is immediately supplied out of the ink outlet 48.

As shown in FIG. 5, ink derived from the ink outlet 48 is introduced into a groove part 50 formed in the rear of the side wall 41*a*, and is led to the valve 35 placed at the bottom of the sub-tank 7 via an ink outlet passage that is formed by the groove part 50 and a film-like member 51 thermally welded to cover the groove part 50.

The ink is introduced through the valve 35 into a groove part 52 similarly formed in the rear of the side wall 41*a*, and is led to a connection port 53 of the tube 36 connected to the record head 6, via an ink outlet passage that is formed by the groove part 52 and the film-like member 51 thermally welded to cover the groove part 52.

On the other hand, as shown in FIGS. 3 and 4, a conduction groove 61 leading to the ink storage space 43 is formed in the upper half portion of the sub-tank 7 in a slant state, and an atmosphere communication port 62 piercing through the side wall 41*a* of the sub-tank 7 to the rear of the side wall 41*a* is formed in the upper end part of the conduction groove 61, namely, in a high part in the gravity direction of the sub-tank 7.

As shown in FIG. 5, the atmosphere communication port 62 is disposed in the rear of the sub-tank 7 and is blocked by a water repellent film 63 formed almost like a rectangle for allowing the atmosphere to pass through and blocking passage of ink.

The water repellent film 63 is placed in such a manner that the film 63 is stored in a recess formed in the rear on the side wall 41*a* of the sub-tank 7 and is held by a film-like member 64 thermally welded so as to cover the upper rear of the side wall 41*a*. A meandering groove 65 is formed in the rear of the side wall 41*a* via the water repellent film 63 and communicates at one end thereof with a blind hole 66 formed in the side wall 41*a* of the sub-tank 7.

The meandering groove 65 and the blind hole 66 are covered with the film-like member 64 in a hermetic state, and therefore the meandering groove 65 and the film-like member 64 form an air circulation resistance passage (denoted by the same reference numeral as the meandering groove 65).

The film-like member 64 covering the blind hole 66 is broken with a sharp tool, etc., whereby the atmosphere release port 62 is allowed to communicate with the atmosphere via the air circulation resistance passage formed like meandering.

Since the atmosphere release port 62 formed in the sub-tank 7 is thus covered with the water repellent film 63, a problem of leaking ink from the sub-tank 7 if the recording apparatus is upside down, for example, by mistake can be circumvented in the presence of the water repellent film 63.

The blind hole 66 in the end part of the air circulation resistance passage 65 is previously covered with the film-like member 64 in a hermetic state. Accordingly, liquid leakage (ink leakage) of the sub-tank can be checked when the sub-tank is completed, and upon completion of the checking, the film-like member 64 covering the blind hole 66 is broken to provide the essential function.

A through hole 67 is formed in the sub-tank 7. One support shaft (not shown) piercing through the through holes 67 of the sub-tanks 7 can be used to arrange and support the sub-tanks in a parallel or juxtaposed state, thereby forming a sub-tank unit.

Figure 6:
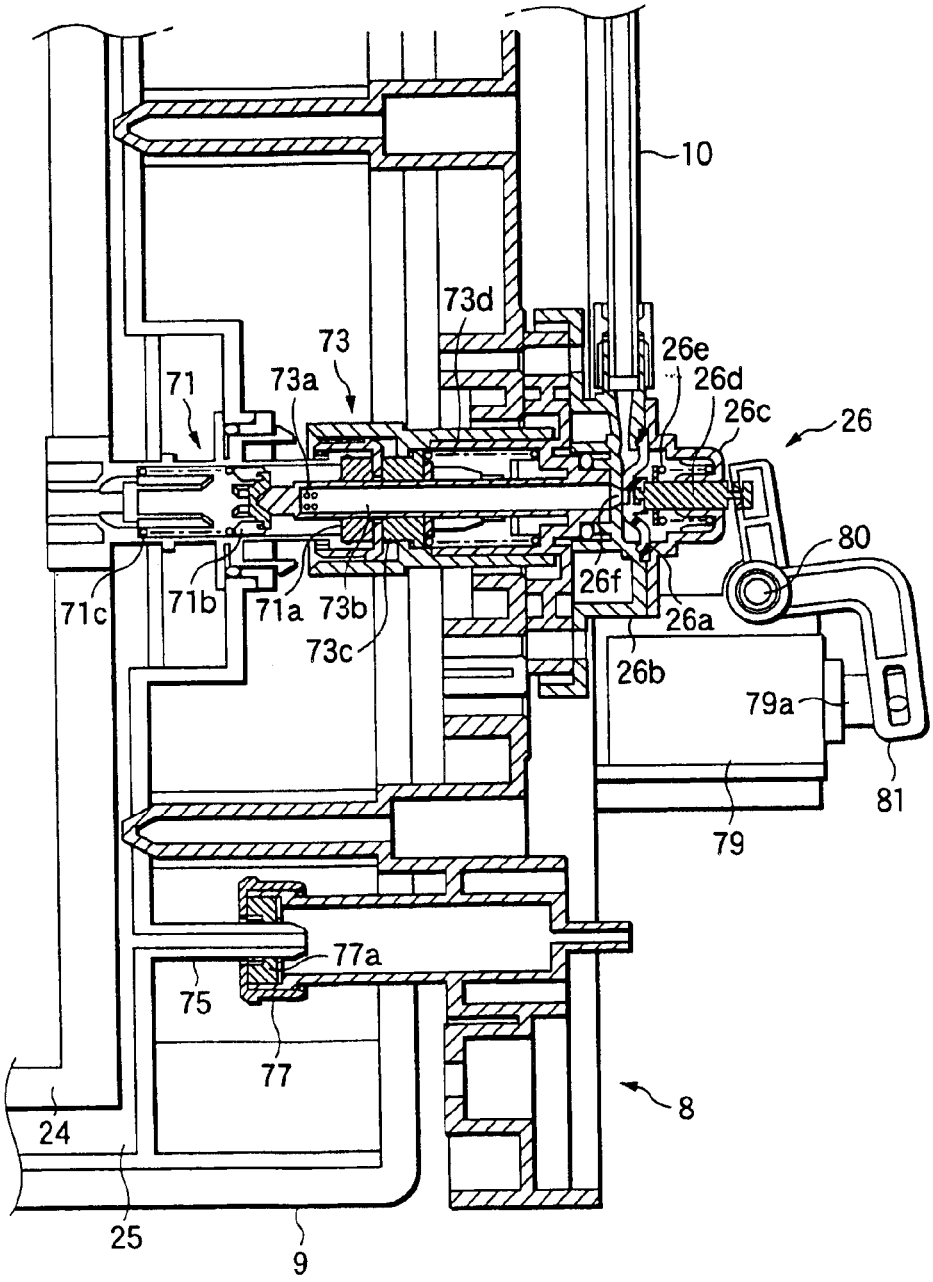
FIG. 6 is a sectional view partially showing a main tank and a cartridge holder in a state where an ink supply valve is closed.
Figure 7:
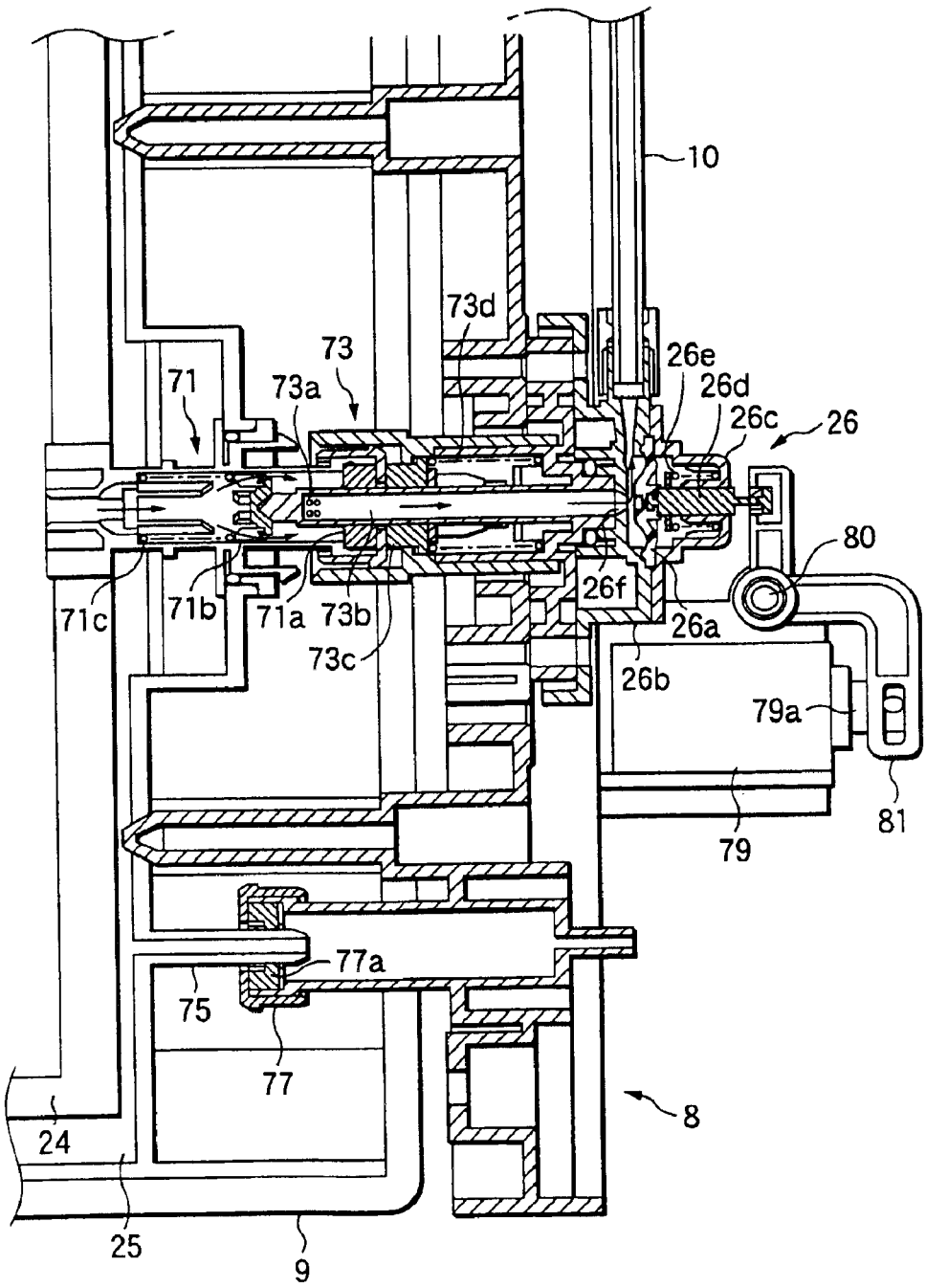
FIG. 7 is a sectional view partially showing the main tank and the cartridge holder in a state where the ink supply valve is opened.

Next, FIGS. 6 and 7 are partially enlarged cross-sectional views of the main tank 9 functioning as the aforesaid ink cartridge and the cartridge holder 8 in a state where the main tank 9 is mounted on the cartridge holder 8. FIG. 6 shows a state where the ink replenishment valve 26 attached to the cartridge holder 8 is closed, and FIG. 7 shows a state where the ink replenishment valve 26 is opened. Portions corresponding to those that have already been explained are denoted by the same reference numerals.

With the ink pack 24 housed in the main tank 9, an ink outlet plug 71 is formed integrally, and this ink outlet plug 71 is attached so as to protrude from one end portion of the main tank 9 to the outside. In this outlet plug 71, a packing member 71*a* formed annularly is disposed at the leading end thereof, and a valve member 71*b* arranged slidably in the outlet plug 71 axially is urged toward the packing member 71*a* by a spring member 71*c*.

Under this constitution, in case that the main tank 9 is not mounted on the cartridge holder 8, the valve member 71*b* comes into contact with the packing member 71*a* to prevent ink from leaking from the ink pack 24. FIG. 6 shows a state where the valve member 71*b* is pushed in by an ink inlet tube, which will be described later, so that ink can be led to the outside from the ink pack 24.

On the other hand, on the cartridge holder 8 side, an ink inlet body 73 for ink reception is projectingly formed in the center of the cartridge holder. In this ink inlet body 73, an ink inlet tube 73*b* in the shape of a hollow needle is arranged, and ink inlet holes 73*a* are formed in the vicinity of the leading end of the inlet tube. Further, a sliding member 73*c* that can slide axially is provided so as to surround the periphery of this ink inlet tube 73*b*. The sliding member 73*c* is urged by a spring member 73*d* so as to protrude in the front direction.

By this constitution, in case that the main tank 9 is not mounted on the cartridge holder 8, the sliding member 73*c* closes the ink inlet holes 73*a* formed in the ink inlet tube 73*b* thereby to close the valve. FIG. 6 shows a state where the sliding member 73*c* is pushed by a connection body 73 on the cartridge holder 8 side, the ink inlet holes 73*a* in the ink inlet tube 73*b* are exposed, and ink can be introduced into the ink inlet tube 73 from the main tank 9 side.

Further, a pressurized air inlet port 75 constructed by a cylindrical member which communicates with the pressure chamber 25 is formed at an outer shell member of the main tank 9. On the other hand, a pressurized air supply plug 77 is provided on the cartridge holder 8 side, and an annular packing member 77*a* is provided in this pressurized air supply plug 77.

Accordingly, in a state shown in the figure where the main tank 9 has been mounted on the cartridge holder 8 side, the annular packing member 77*a* provided on the cartridge holder 8 side comes into close contact with and is coupled to the outer surface of the pressurized air inlet port 75 constructed by the cylindrical member. Hereby, the pressurized air can be introduced in the pressure chamber 25 of the ink tank 9.

At the base portion of the ink inlet tube 73*b* provided on the cartridge holder 8 side, the ink replenishment valve 26 is arranged, and the ink replenishment tube 10 is connected through this valve 26 so that the ink can be replenished to the sub-tank 7 mounted on the carriage 1 as described above.

A diaphragm valve 26*a* is provided for the ink replenishment valve 26, and its peripheral portion is held between and by a first case 26*b* and a second case 26*c*, so that the diaphragm valve 26*a* is housed in the both cases. And, a slide shaft 26*d* attached to the substantially central portion of the diaphragm valve 26 is attached to the second case 26*c* so that it can slide axially, and upon reception of the driving force by an electromagnetic plunger 79 functioning as an actuator, this slide shaft 26*d* is driven horizontally as shown in the figures.

Accordingly, upon reception of the axial driving force of the slide shaft 26*d*, the substantially central portion of the diaphragm valve 26*a* can move in the horizontal direction.

In this example, the driving force by the electromagnetic plunger 79 is transmitted to one end portion of a drive lever 81 rotated through a support shaft 80, and transmitted, at the other end portion of the drive lever, to the slide shaft 26*d* that can drive the diaphragm valve 26*a*.

Further, a spring member 26*e* is provided between the slide shaft 26*d* and the second case 26*c*. In a state where the electric power is not applied to the electromagnetic plunger 79, as shown in FIG. 6, the center of the diaphragm valve 26*a* closes, by the action of the urging force of the spring member 26*e*, an opening portion 26*f* provided for the first case 26*b* connected to the base end portion of the ink inlet tube 73*b* thereby to establish a closed state.

Further, in case that where the electric power is applied to the electromagnetic plunger 79, as shown in FIG. 7, a drive rod 79*a* of the electromagnetic plunger 79 is pulled in, whereby the slide shaft 26*d* is pulled out through the drive lever 81.

Accordingly, the center of the diaphragm valve 26*a* separates from the opening portion 26*f* provided for the first case 26*b* thereby to establish an opened state.

Therefore, in the opened state of the diaphragm valve 26*a* by the current application to the electromagnetic plunger 79, as shown by arrows in FIG. 7, ink is introduced from the ink pack 24 through the ink flow passage of the ink inlet tube 73*b* into the first case 26*b* in which the diaphragm valve is arranged, and can be supplied through the ink replenishment tube 10 connected to the first case 26*b* into the sub-tank 7.

When the amount of the ink in the sub-tank 7 reaches the predetermined amount, by the output of the hole elements 33*a*, 33*b* for detecting the amount of the lines of magnetic force of the permanent magnet 32 corresponding to the floating position of the float member 31 provided in the sub-tank 7, the current application to the magnetic plunger 79 is cut off, so that replenishment of the ink is stopped.

Further, in case that the operation power of the recording apparatus has been turned off, the electromagnetic plunger 79 does not receive the power supply, whereby the center of the diaphragm valve 26*a* closes the opening portion 26*f* provided in the first case 26*b* connected to the base end portion of the ink inlet tube 73*b* by the urging force of the spring member 26*e* thereby to establish the closed state.

Accordingly, even if there is water head difference between the main tank 9 and the sub-tank 7, it is possible to prevent ink from flowing in either direction through the ink replenishment tube 10.

As can be seen from the constitution shown in FIGS. 6 and 7, the ink flow passage leading to the opening portion 26*f* of the first case 26*b* in which the diaphragm valve 26*a* is provided, that is, the ink flow passage formed in the ink inlet tube 73*b*, and the ink flow passage leading from the inside of the case 26*b* to the ink replenishment tube 10 are so constructed as to cross substantially at the right angles. Further, the outlet section of the ink replenishment tube 10 connected to the case 26*b* is arranged so as to extend substantially in the vertical direction.

By this constitution, the air bubbles that enter when the main tank 9 functioning as an ink cartridge is mounted on the cartridge holder 8 can be floated toward the ink replenishment tube 10 without staying near the diaphragm valve 26*a*. Since the floating air bubbles toward the ink replenishment tube 10 are introduced in the sub-tank 7 and float, it is possible to prevent a problem that the air bubbles enter into the recording head 6 and cause printing failure.

In the example shown in FIGS. 6 and 7, the ink replenishment valve constructed by the diaphragm valve 26*a* is arranged in the cartridge holder 8 on which the main tank is mounted. Namely, the ink replenishment valve is arranged in the proximity of the main tank in the ink supply passage leading from the main tank to the sub-tank.

Even in case that the main tank 9 is pulled out from the cartridge holder 8, since the ink replenishment valve is arranged in the proximity of the cartridge holder 8, it is possible to effectively prevent the ink existing in the ink replenishment tube 10 from leaking to the cartridge holder 8 side.

In this case, in the example, though the sliding member 73*c* for covering up and closing the ink inlet holes 73*a* of the ink inlet tube 73*b* is provided in the cartridge holder 8 as described above, by arranging the ink replenishment valve in the proximity of the main tank as described before, the closed action for the ink inlet holes 73*a* by the sliding member 73*c* and the closed action by the ink replenishment valve 26 are multiplied by each other, so that it is possible to effectively prevent the ink from leaking from the connection body 73 on the cartridge holder side upon reception of the reverse flow by the water head difference.

According to the above ink jet recording apparatus, in the ink replenishment passage leading from the main tank functioning as an ink cartridge to the sub-tank mounted on the carriage, the ink replenishment valve is arranged, which is closed in the off-state of the operation power of the recording apparatus. Therefore, during a non-operation period of the recording apparatus, or at a unexpected power failure time, it is possible to prevent the ink from flowing in either direction due to the water head difference between the main tank and the sub-tank, so that it is possible to provide a recording apparatus in which the inside of the apparatus is not stained by leakage of the ink.

According to the thus constructed ink jet recording apparatus, the ink is always pushed out from the main tank to the sub-tank by the pressurized air during the operation of the recording apparatus. The amount of the ink in the sub-tank is detected by the ink amount detecting means, and opening and closing of the ink replenishment valve arranged in the ink replenishment passage leading from the main tank to the sub-tank is controlled by control signals given from the ink amount detecting means, whereby the required sufficient amount of ink can be always stored in the sub-tank.

In the thus constructed ink jet recording apparatus, for example, in case that the ink amount detecting means including the float member operates erroneously, or in case that some trouble is produced in a control signal transmission system leading from the ink amount detecting means to the ink replenishment valve, even if the predetermined amount of the ink has been replenished in the sub-tank, the ink supply valve is not closed.

This case may cause a problem in that the ink remains replenished from the main tank into the sub-tank by the pressurized air, and the ink leaks through the air communication port formed in the sub-tank to stain the surroundings.

Figure 8:
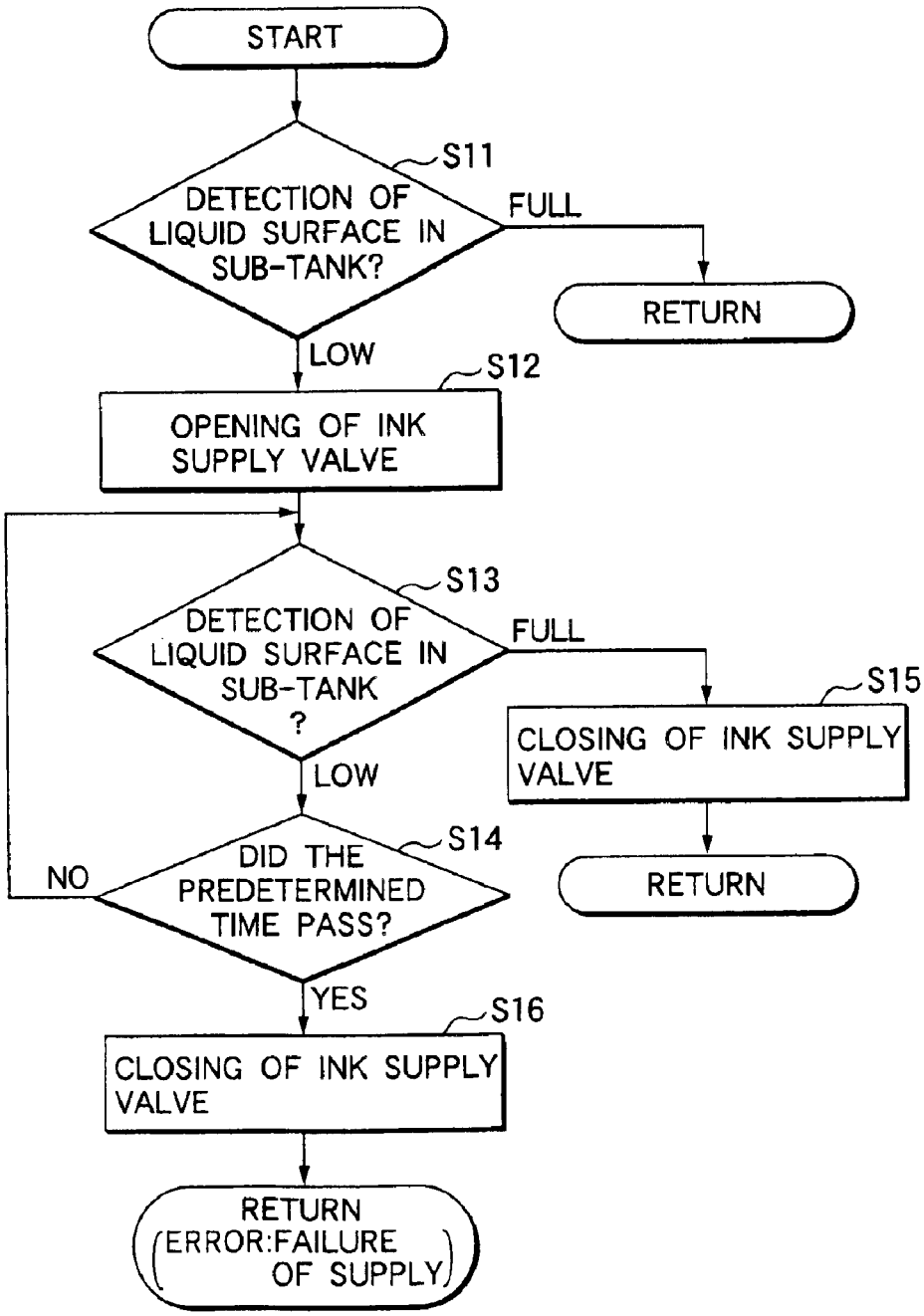
FIG. 8 is a flowchart showing a control routine of ink supply from the main tank into the sub-tank, executed in the recording apparatus according to the invention.

FIG. 8 shows a control routine of ink replenishment to the sub-tank, considered on the assumption of the aforesaid situation, for preliminarily preventing such a problem that the ink leaks, for example, from the sub-tank.

With reference to the control routine shown in FIG. 8, the ink replenishment operation to the sub-tank will be described below. First, in a step S11, the liquid surface in the sub-tank is detected. This is judged by the output of the hole elements 33*a*, 33*b* for detecting the amount of lines of magnetic force of the permanent magnet attached to the float member, as described above.

Herein, a case that it is judged by the ink amount detecting means that the ink amount in the sub-tank does not satisfy the predetermined value is referred to as "LOW", and a case that it is judged that the ink amount in the sub-tank reaches the sufficient amount is referred to as "FULL". In case of "FULL" in the step S11, the ink replenishment operation enters a return state, and the ink amount is continuously monitored in the step S11.

With consumption of the ink by the recording head, in case that "LOW" is detected, the ink replenishment operation proceeds to a step S12 and the ink replenishment valve 26 is opened.

Accordingly, the ink replenishment into the sub-tank from the main tank is started. Then, as shown in a step S13, the amount of the ink in the sub-tank is monitored by the ink amount detecting means. Immediately after the replenishment valve 26 was opened in the step S12, the "LOW" state is usually detected in this step S13, and a judgment shown in a step S14 is performed.

Namely, in the step S14, the time elapsed since the opened operation of the ink replenishment valve executed in the step S12 is judged. In case that the time elapsed does not satisfy the predetermined time, the ink replenishment operation returns to the step S13, and the liquid surface in the sub-tank is detected, that is, the state of the control output by the ink amount detecting means is monitored. And, a cycle in which the ink replenishment operation returns from the step S14 to the step S13 is repeated.

In case that the ink is replenished into the sub-tank in the state where the time elapsed does not satisfy the predetermined time and the "FULL" state is detected in the step S13, the ink replenishment operation proceeds to a step SIS, whereby the ink replenishment valve 26 is closed and the ink replenishment operation enters a return state.

Accordingly, the operations shown in the steps 11 to 15 are repeated, and the ink is intermittently replenished into the sub-tank from the main tank. The above operations shown in the steps 11 to 15 are repeated when the ink replenishment operation is normally performed.

Here, for example, though the sufficient amount of ink has been replenished into the sub-tank, in case that, for example, the float member 31 constituting the ink amount detecting means does not float upon reception of some trouble, the excessive amount of ink is continuously replenished into the sub-tank.

Further, the same is also applied to case that the unexpected trouble was produced in the control signal transmission system leading from the ink amount detecting means to the ink replenishment valve. As a result, a problem that the ink leaks from the sub-tank is produced.

A routine shown in a step S14 and a step 16 sequential to the step S14 is a control, considered on the assumption of production of this trouble, for preventing the excessive amount of ink from being replenished into the sub-tank.

Namely, in the step S14, the time elapsed since the opened operation of the ink replenishment valve executed in the step S12 is monitored, and in case that "FULL" is not detected in the cycle operation of the step S13 and the step S14 even if the predetermined time passes, that is, the "LOW" state is judged, the ink replenishment operation proceeds to the step S16, and the ink replenishment valve 26 is forcedly closed.

In this state, it can be judged that some trouble is produced in the ink replenishment system as described before. Accordingly, by lapse of the predetermined time managed in the step S14, the valve is automatically closed forcedly, whereby the replenishment of the excessive ink into the sub-tank can be stopped.

In case of proceeding to this step S14, it is desirable to perform an error display representing ink supply failure state, and inform a user of trouble in the ink replenishment system.

According to the above constitution, when other trouble occurs, such as in case that the predetermined air pressure is not applied to the pressure chamber 25 of the main tank, or that the ink is difficult to flow in the tube 10 constituting the ink replenishment passage leading from the main tank to the sub-tank, the error display can be performed. In this case, the printing failure may be produced. In any event, it is possible to inform the user of a fact that maintenance is required.

Figure 9:
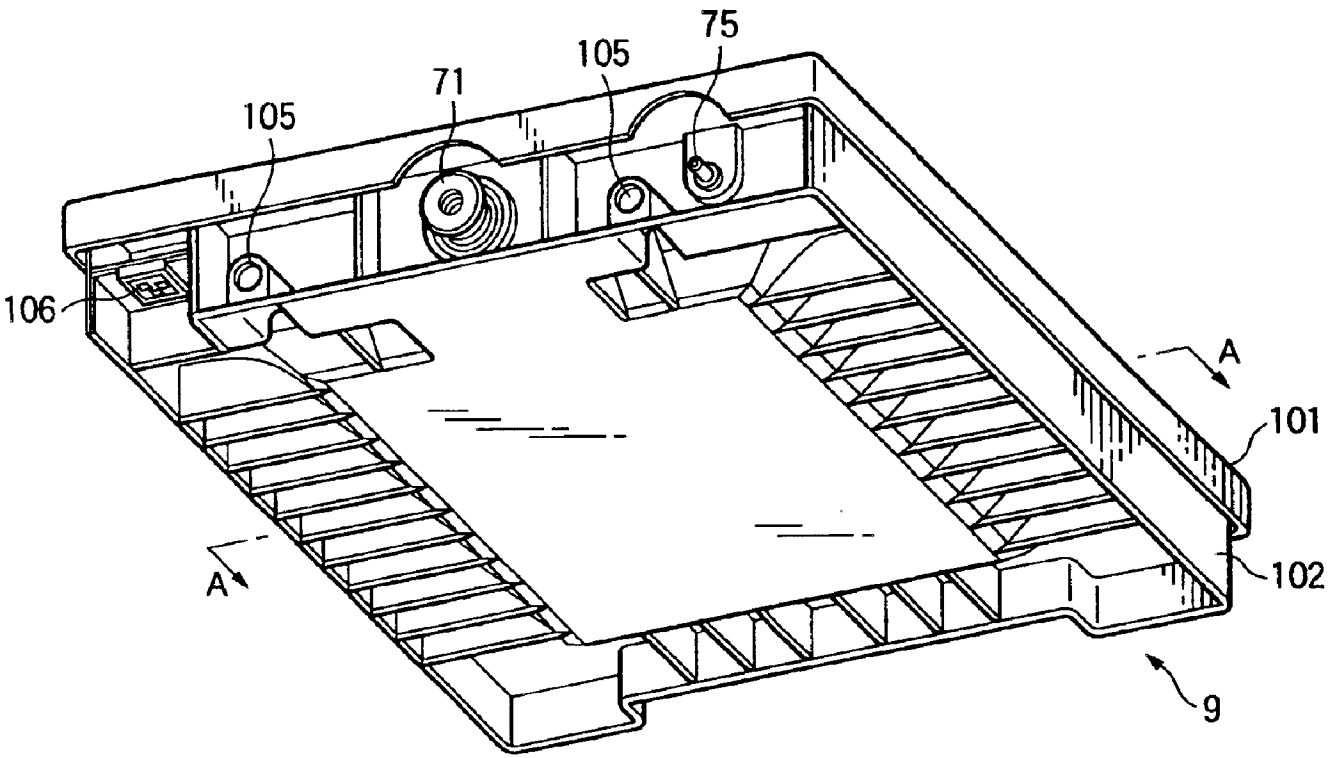
FIG. 9 is a perspective view showing the appearance and construction of the ink cartridge according to the invention.
Figure 10:
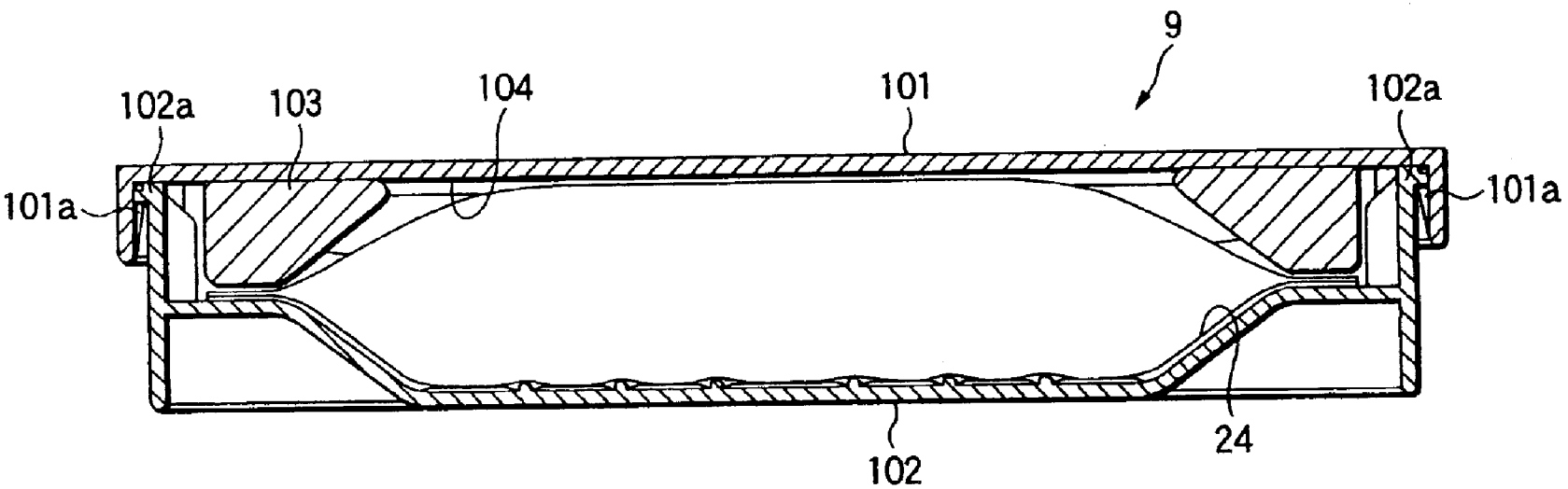
FIG. 10 is an enlarged cross-sectional view of the ink cartridge when viewed from a line A—A shown in FIG. 9 in the direction designated by arrows.
Figure 11:
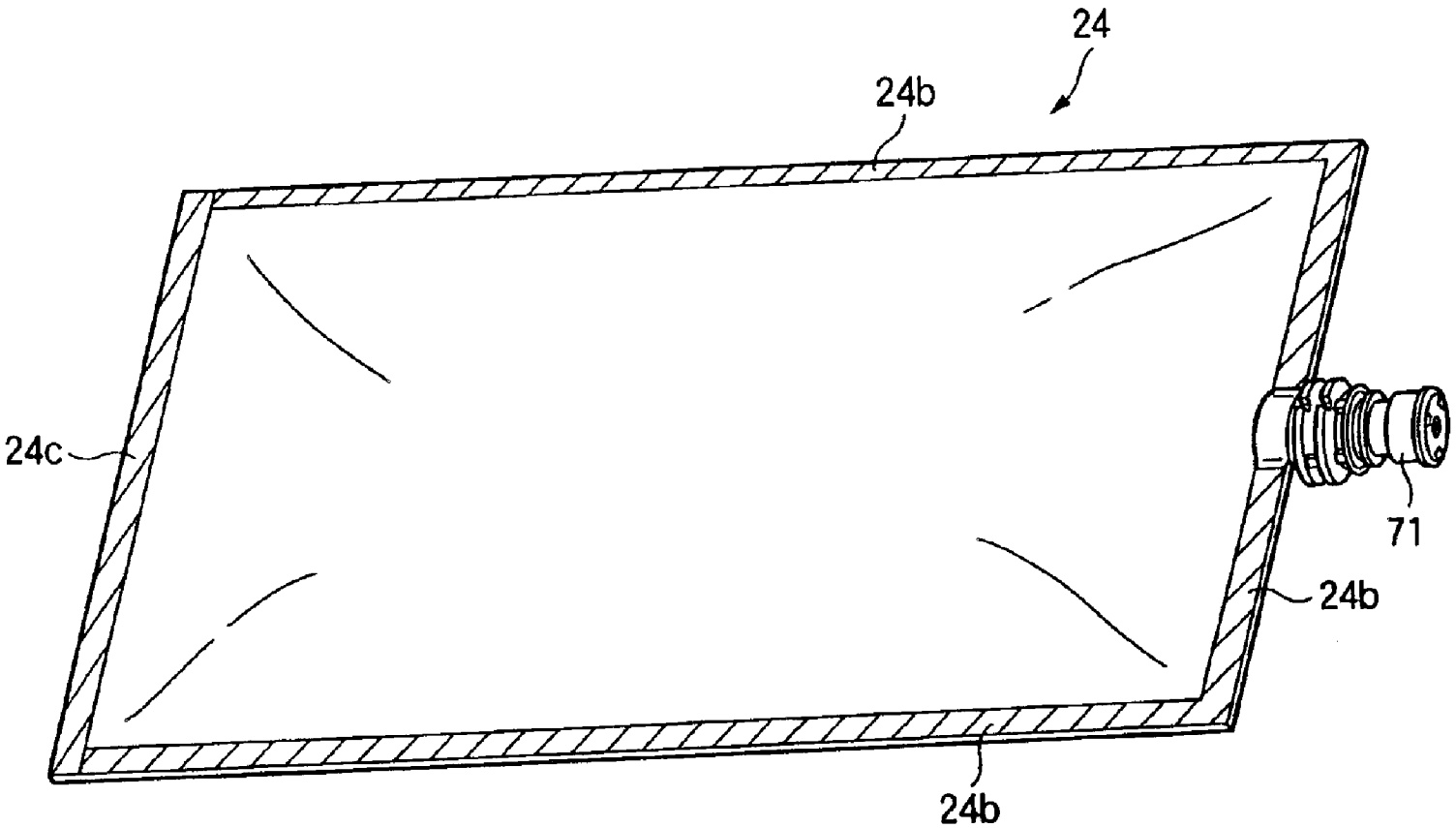
FIG. 11 is a perspective view showing the construction of an ink pack housed in the ink cartridge shown in FIG. 8.

Next, with reference to FIG. 9 and subsequent Figures, an ink cartridge according to each aspect of the present invention, which can be preferably used with the recording apparatus described above will be discussed. FIGS. 9 through 11 show an ink cartridge (main tank) 9 according to a first aspect of the present invention.

In this example, as shown in FIGS. 9 and 11, the outer shell, i.e. the ink cartridge, is constructed by an upper case 101 and a lower case 102. The lower case 102 is formed into a flattened box shape, and the upper side of the lower case 102 is open. An ink-filled ink pack 24 (see FIG. 11) can be housed in the lower case 102.

In this example, as shown in FIG. 10, in order to fix the four sides of the ink pack 24 housed in the lower case 102, a quadrilateral intermediate lid 103 whose center is opened as a window is inserted. A film member 104 designated by a thick line is heat-welded to a flange section 102*a* formed along the marginal edge of the opening of the lower case 102, thereby hermetically closing the lower case 102. The upper case 101 formed into a flattened box shape is fitted on the lower case 102.

In this example, wedge-shaped lug members 101*a* are intermittently formed in the upper case 101 along the interior surface thereof. As the upper case 101 is pushed on the lower case 102, the lug members 101*a* engage the flange section 102*a* formed along the marginal edge of the opening of the lower case 102, whereby they are coupled together.

With this construction, when pressurized air is introduced into the lower case 102 sealed by the film member 104, the film member 104 is positioned so as to come into contact with the interior surface of the upper case 101, thus preventing outward expansion of the film member 104, which would otherwise be caused upon reception of the pressurized air.

FIG. 11 shows the structure of the ink pack 24 housed in the outer shell case that is constructed in the manner as mentioned above. Two sheets of rectangular flexible material; for example, a polyethylene film, are used for the ink pack 24. In order to improve the gas-barrier characteristic, aluminum foil or the like, for example, is laminated on the surface of each film.

An ink outlet plug 71 constituting an ink outlet port is attached to substantially the center of one lateral side end section in the longitudinal direction. Three sides, i.e. the lateral side end section having the ink outlet plug 71 and the longitudinal side end sections orthogonal to the lateral side end section, are first joined by heat welding to form a bag. Reference numeral 24*b* designates a heat-welded section in each of the three sides.

Ink is filled into the ink pack 24 from the remaining one open side of the ink pack 24 formed into the bag. The remaining side is then joined by heat welding to provide the ink pack sealing storing ink therein. Reference numeral 24*c* designates a heat-welded section in the remaining side.

In the ink cartridge 9, as constructed above according to the first aspect of the present invention, as shown in FIG. 9, a pair of open holes 105 to be utilized as positioning means at the time of mounting the ink cartridge to the recording apparatus are formed in one surface of the cartridge case.

The pair of opening holes 105 are disposed at two locations spaced apart from each other along a longitudinal direction of the one surface of the case. When the lower case 102 is formed by, for example, injection molding, the opening holes 105 are molded integrally and simultaneously.

The ink outlet plug 71 constituting the ink outlet port for the ink pack is attached to a substantially middle position between the positioning opening holes 105 thus disposed at the two locations, in a state of biting an un-illustrated O-ring for hermetic purpose.

A pressurized air inlet port 75 and a circuit board 106 to be described in detail later are provided outside the opening holes 151 thus disposed at the two locations.

Simultaneous with molding of the lower case 102, the pressurized air inlet port 75 is molded hollowly and integrally. Pressurized air can be introduced into the lower case 102 sealed by the film member 104, by way of the pressurized air inlet port 75.

Figure 12:
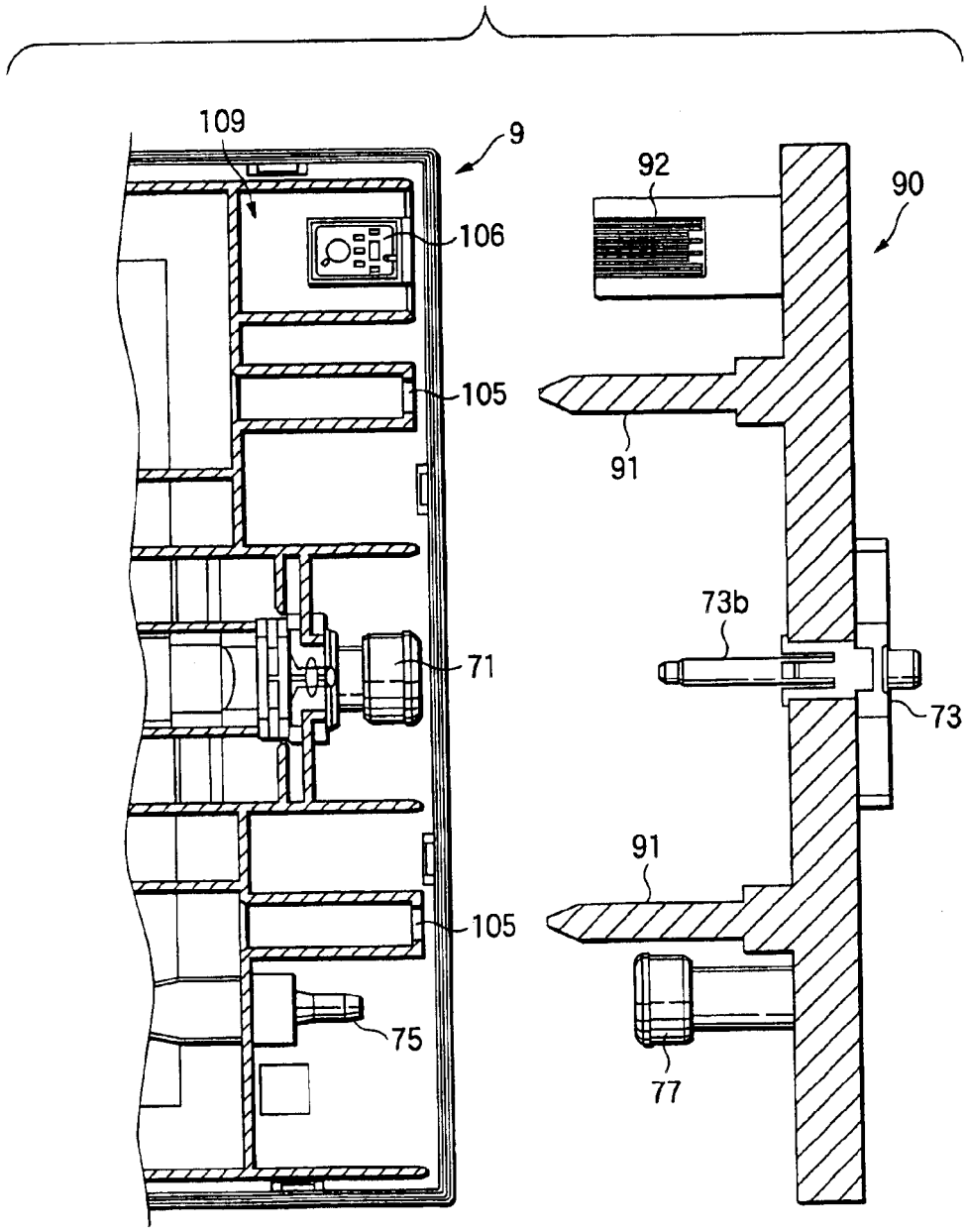
FIG. 12 is a cross-sectional view showing an end portion on one surface side of the ink cartridge and the construction of connection mechanism provided for the cartridge holder.
Figure 13:
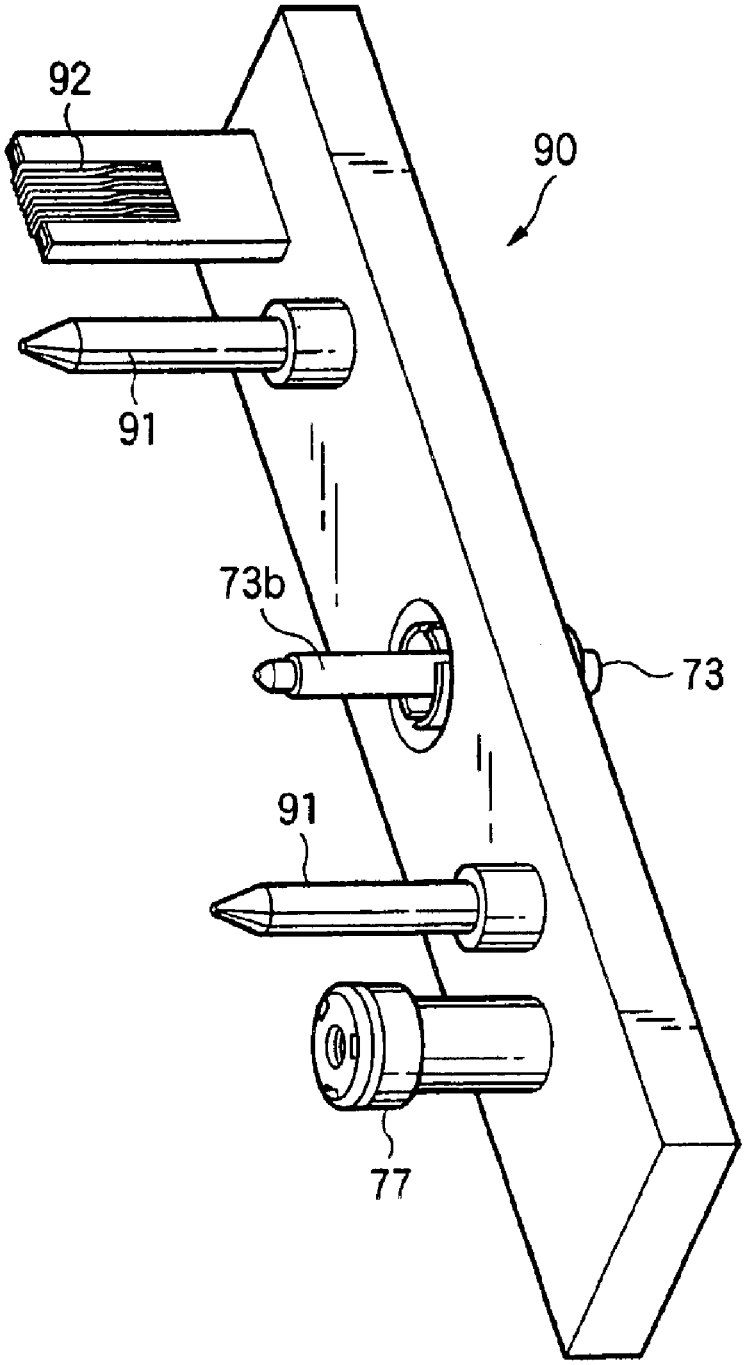
FIG. 13 is a perspective view showing the connection mechanism provided for the cartridge holder.

FIG. 12 shows the cross section of an end section on one surface of the ink cartridge 9 constructed in the manner mentioned above according to the first aspect of the present invention, showing a state that the ink cartridge 9 is attached to a connection mechanism 90 provided on the cartridge holder 8 of the recording apparatus. FIG. 13 is a perspective view showing an example of the connection mechanism 90 provided on the cartridge holder 8 of the ink jet recording apparatus according to the present invention.

As shown in FIGS. 12 and 13, a pair of columnar positioning pins 91 are disposed on the cartridge holder 8 of the recording apparatus. The pair of positioning opening holes 105 formed in the ink cartridge 9 are mounted to surround the positioning pins 91, respectively.

As described above, the positioning opening holes 105 on the cartridge side are located at two locations in the longitudinal direction of the one surface of the case, and mounted to the base ends of the two positioning pins 91 provided on the recording apparatus. Accordingly, the ink cartridge 9 can be positioned three-dimensionally.

As the cartridge 9 is mounted with respect to the positioning pins 91, the ink inlet tube 73*b* in the form of a hollow needle provided in substantially the middle position between the pair of positioning pins 91 fits into the ink outlet plug 71 constructing the ink outlet port extending from the ink pack, thereby enabling outflow of ink from the cartridge.

As a result of mounting the ink cartridge 9, the pressurized air inlet port 75 is connected to a pressurized air outlet port 77 arranged in the holder 8, thus enabling introduction of pressurized air into the cartridge 9.

A terminal mechanism 92 having a plurality of contacts is connected to the circuit board 106 arranged in the cartridge 9, thereby enabling exchange of data with semiconductor storage means which is provided on the circuit board 106 and is to be described later.

In a case where the ink cartridge 9 is loaded onto the cartridge holder 8, the circuit board 106 in the ink cartridge 9 is arranged vertically and disposed at an upper position in the direction of gravity, as shown in FIG. 12.

FIG. 14 is a cross-sectional view showing that the ink inlet tube 73*b* in the ink inlet body 73 provided to the holder is connected to the ink outlet plug 71 constructing the ink outlet port extending from the ink pack as a result of mounting the ink cartridge 9, thereby enabling outflow of ink from the cartridge. A part A of FIG. 14 shows a state before they are connected, and a part B of FIG. 14 shows a state after they are connected.

An annular rubber-made packing member 71*a* is fitted into an exit section of the ink outlet plug 71 provided in the ink pack. On the other hand, a valve member 71*b* is housed in the ink outlet plug 71 so as to enable axial movement.

The valve member 71*b* is constructed so as to close a central portion of the annular packing member 71*a* under the urging force of the coil-shaped spring member 71*c*. An ink inlet hole 73*a* is formed in a position on the side surface in the vicinity of the tip end of the ink inlet tube 73*b* formed in the ink inlet body 73.

Figure 14A:
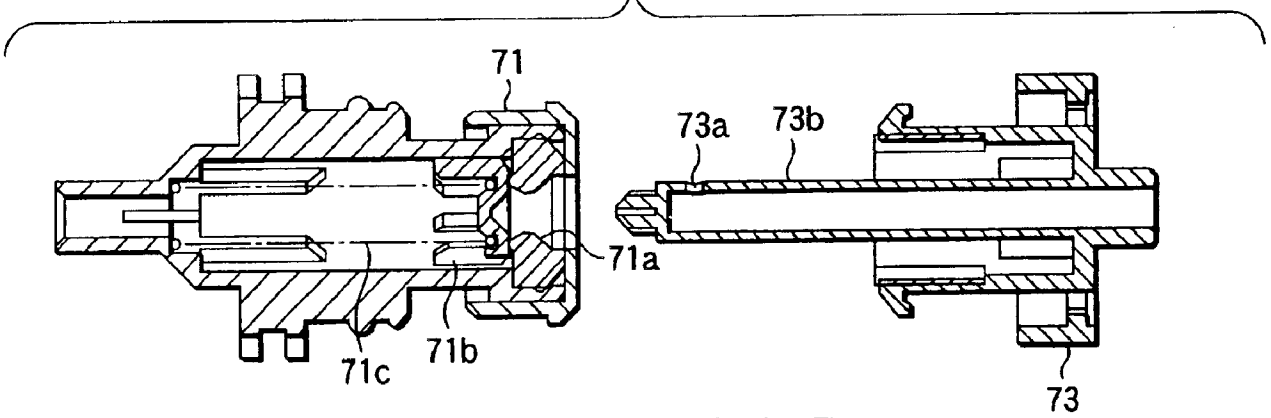
FIG. 14 is a cross-sectional view showing the construction of an ink outlet plug on the cartridge side and an ink inlet tube of the cartridge holder side.

Accordingly, in a state shown in FIG. 14(A) in which the ink cartridge 9 is not loaded in the recording apparatus, the valve member 71*b* closes the annular center portion of the packing member 71*a* under the urging force of the coil-shaped spring member 71*c* so that the ink outlet plug 71 is put into the valve closed state, thereby preventing leakage of ink from the ink pack.

Figure 14B:
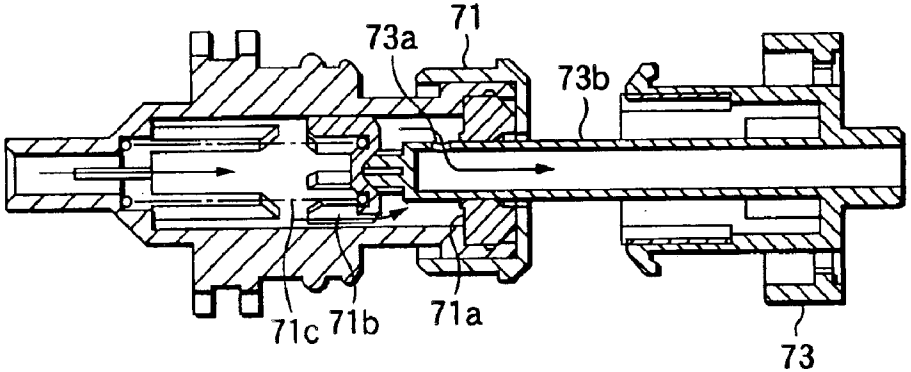

When the ink cartridge 9 is loaded in the recording apparatus, as shown in FIG. 14(B), the tip end of the ink inlet tube 73*b* pushes the valve member 71*b* inwardly against the urging force of the spring member 71*c*. Accordingly, an ink flow passage designated by arrows is formed, thereby enabling outflow of ink.

In this case, an annular internal-diameter portion of the packing member 71*a* comes into close contact with the outer diameter portion of the ink inlet tube 73*b*, thus preventing leakage of ink from the contact portion.

Figure 15:
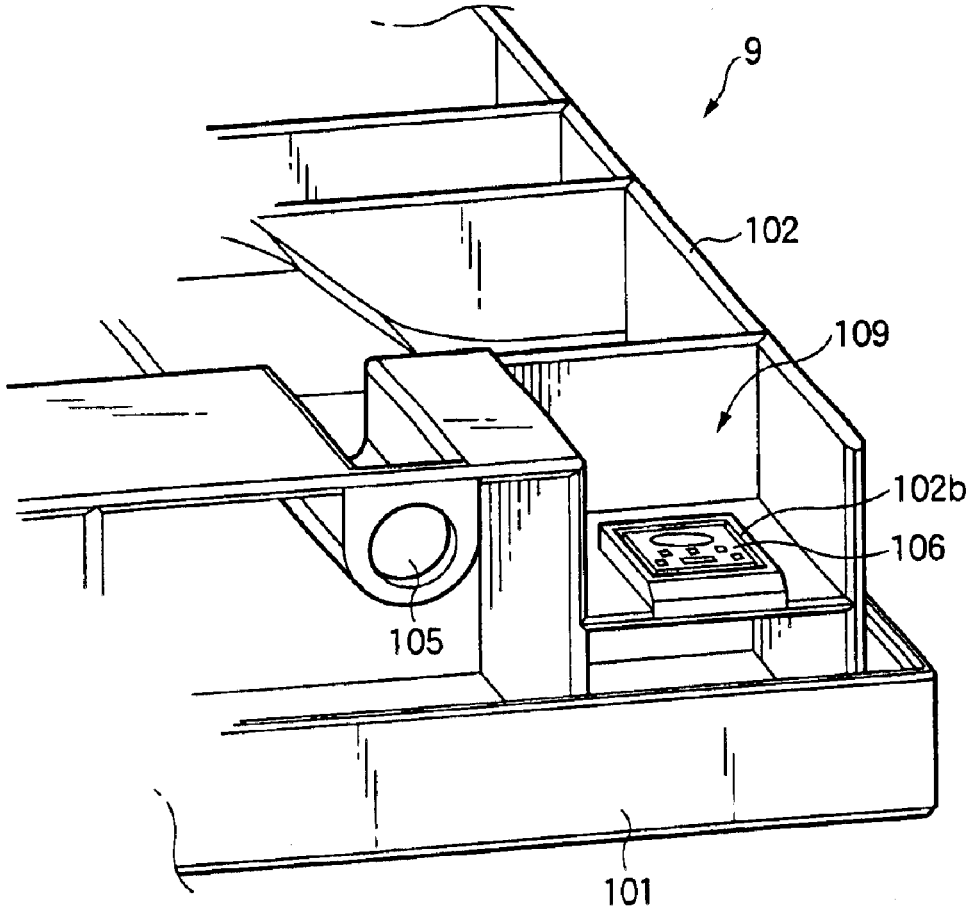
FIG. 15 is an enlarged perspective view showing an attachment state of a circuit board attached to the cartridge.
Figure 16A:
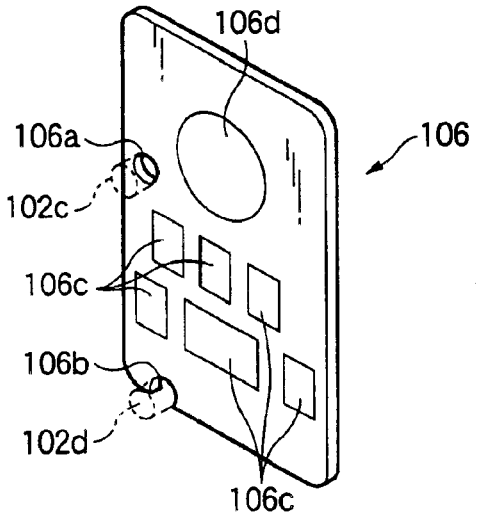
FIG. 16 is a more enlarged perspective view showing the appearance and the construction of the circuit board shown in FIG. 15.
Figure 16B:
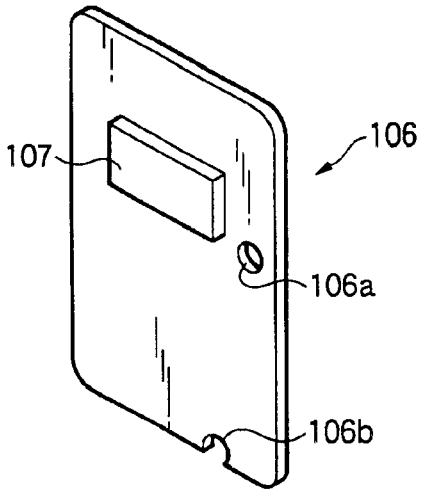

FIG. 15 shows an example of a mounting state of the circuit board 106 mounted on the ink cartridge. FIG. 16 show the appearance and construction of the circuit board 106. FIG. 16(A) is a perspective view of the circuit board 106 when viewed from the front, and FIG. 16(B) is a perspective view of the circuit board 106 when viewed from below the underside thereof.

As shown in FIG. 15, the circuit board 106 is located in the corner of the lower case 102 of the cartridge and is mounted on the inner bottom portion two orthogonal surfaces of which are open. One of the two open surfaces enables connection between the circuit board 106 and the terminal mechanism 92 provided on the cartridge holder 8. The other of the two open surfaces is primarily used when the circuit board 106 is mounted to the cartridge case.

As shown in FIG. 16, a through hole 106*a* and a notched hole 106*b* are formed in the circuit board for mounting the circuit board 106 onto the lower case 102.

As designated by phantom lines shown in FIG. 16A, protrusions 102*c* and 102*d* for heat-welding purposes to be inserted into the respective through hole 106*a* and the notched hole 106*b* are preliminarily formed on the lower case 102.

When the substantially-rectangular circuit board 106 is mounted on the lower case 102, the circuit board 106 is fitted into a recessed section 102*b* formed as shown in FIG. 15 for positioning the circuit board.

An unillustrated heater chip is brought into contact with the heads of the protrusions 102*c* and 102*d* designated by phantom lines shown in FIG. 16A, thus fusing the protrusions. As a result, the circuit board 106 is mounted on the lower case 102, as shown in FIG. 15.

The heater chip is used as a jig for mounting the circuit board 106 to the lower case 102, and the tip end of the heater chip is inserted through the one surface opened in the upper side of the circuit board 106.

As shown in FIG. 16A, electrode contacts 106*c* are formed on the front side of the circuit board 106 as connection terminals to be brought into electrical contact with the terminal mechanism 92 of the cartridge holder 8 when the cartridge is loaded in the cartridge holder. An electrode contact 106*d* for checking purpose is formed in a circular shape on the same surface.

The electrode contacts 106*c* and 106*d* are connected to data-readable/writable semiconductor storage means 107 mounted on the underside of the circuit board 106. When the ink cartridge 9 is loaded on the cartridge holder of the recording apparatus, data pertaining to, for example, the type of ink stored in the ink cartridge, an ink remaining amount, a serial number, and an expiration date, are sent and received.

In the ink cartridge according to the first aspect of the invention, on one surface of the cartridge case, the positioning means used in a case that the cartridge is attached to the recording apparatus is arranged, and similarly on the one surface thereof, the ink outlet port from the ink pack, the pressurized air inlet port, and the connectional terminal of the circuit board having the data storage means are concentratedly arranged. Therefore, the one surface of the cartridge case is positioned by the positioning means, whereby positional alignment of mechanical and electrical connection mechanism can be accurately performed.

Hereby, positioning accuracy can be improved, and reliability in operation of this kind of recording apparatus can be improved.

Further, the ink jet recording apparatus according to the preset invention on which the ink cartridge of the first aspect is mounted is so constructed that the connection terminal of the circuit board is located at the upper portion in a gravity direction in relation to the ink outlet port in a state where the ink cartridge has been mounted using the positioning means arranged on the one surface of the cartridge case. Therefore, even if the ink leakage is produced from the ink outlet port by some trouble, it is possible to prevent the connection terminal portion of the circuit board from being stained with the leaking ink. Accordingly, it is possible to ensure the normal operation of the recording apparatus.

Next, an ink cartridge according to the second aspect of the invention will be described. This ink cartridge according to the second aspect is provided with a circuit board having a data-readable storage means that can stores ink information therein, and characterized in the space configuration of the provided position of the circuit board, an attaching means and electrical connecting constitution of a terminal mechanism.

The appearance and the construction of the ink cartridge, and the ink pack housed in the outer shell case of the cartridge are not limited particularly, and they may be constructed similarly to those in the ink cartridge of the first aspect shown in FIGS. 9 to 11.

Further, the constitution of the recording apparatus on which this ink cartridge is mounted, and the connection mechanism between the ink cartridge and the cartridge holder can use intactly the constitution shown in FIGS. 12 to 14. Further, the constitution shown in FIGS. 15 and 16 in which the circuit board having the data-readable storage means is mounted on the ink cartridge can be adopted as a preferable example of the second aspect of the invention.

In the ink cartridge according to the second aspect of the invention, a circuit board 106 is attached in a box-shaped space section 109 in which two surface that cross at right angles are opened as shown in FIG. 15. Therefore, it is possible to effectively prevent a user from unintendedly touching the electrode contacts 106*c* or the like formed on the surface of the circuit board 106 with the tip of his finger or the like. Hereby, the electrical contact state between the circuit board mounted on the cartridge and the recording apparatus can be kept good.

Further, in case that the ink in the cartridge is used up and this cartridge is collected, since the surfaces crossing at right angles are opened on the surface of the circuit board 106 attached to the case, the leading end of a tool can be inserted from this opened portion and the heat-caulked portion can be cut, whereby the circuit board 106 can be readily collected.

Therefore, according to the ink cartridge for use with a recording apparatus in the second aspect of the invention, the circuit board having the storage means that can store the ink information therein can be readily attached and detached.

Next, an ink cartridge and an ink jet recording apparatus according to the third aspect of the invention can also adopt the constitution shown in FIGS. 9 to 16 as a preferred example. The ink cartridge and the ink jet recording apparatus according to the third aspect of the invention are characterized in that in case that the ink cartridge is attached to or detached from the recording apparatus, connection mechanism by which the ink pack does not receive action of the pressurized air is adopted, so that production of the ink leakage due to the action of the pressurized air can be reliably prevented.

Therefore, a pressurized air inlet port 75 provided to the ink cartridge is formed in the shape of a hollow cylindrical member formed integrally with the cartridge case as shown in FIG. 12, and it is desirable that a length L in the axial direction of a cylindrical surface of the cylindrical member constituting the inlet port 75 is 2 to 20 mm. Namely, it is desirable that the diameter of the cylindrical surface of this cylindrical member is formed uniformly along the axial direction, since the cylindrical surface is connected to the pressurized air outlet port 77 arranged in the cartridge holder 8.

Therefore, it is not preferable that a tapered surface for mold separation when the cartridge case is injection-molded is provided for the cylindrical surface. Accordingly, it is necessary to set the length L in the axial direction of the cylindrical surface to 20 mm or less.

Further, the length L in the axial direction is made 2 mm or more, whereby the connection to the pressurized air outlet port 77 arranged in the holder 8 can be kept good even if the ink cartridge is shifted a little in the inserted direction.

In this constitution, in case that the ink cartridge 9 is attached to the connection mechanism 90 of the cartridge holder 8, as described before, a pair of positioning opening holes 105 arranged in the ink cartridge 9 advance to positioning pins 91 arranged in the connection mechanism 90 and then surround these pins.

Accordingly, at this time, temporal positioning is achieved between the hollow ink inlet tube 73*b* arranged in the connection mechanism 90 of the cartridge holder of the recording apparatus and the ink outlet plug 71 of the ink cartridge.

Under this state, as the ink cartridge 9 advances further to the connection mechanism 90 side, the ink outlet plug 71 in the ink cartridge 9 is connected to the hollow ink inlet tube 73*b* arranged in the connection mechanism 90.

As described before, a dimensional relation is provided, in which after the ink outlet plug 71 in the ink cartridge side was connected to the hollow ink inlet tube 73*b* arranged in the connection mechanism 90, the ink cartridge 9 advances further to the connection mechanism 90 side, whereby the pressurized air inlet port 75 in the ink cartridge 9 is connected to the pressurized air outlet port 77 arranged in the connection mechanism 90. Hereby, the pressurized air inlet port 75 is connected to the pressurized air outlet port 77.

Further, a dimensional relation is provided, in which after the pressurized air inlet port 75 was connected to the pressurized air outlet port 77, the ink cartridge 9 advances further to the connection mechanism 90 side, whereby electrode contacts 106*c* in the circuit board 106 arranged in the ink cartridge 9 are lastly connected to a terminal mechanism 92 arranged in the connection mechanism 90 electrically.

In case that it is detected on the recording apparatus side that the electrode contacts 106*c* in the circuit board 106 have been lastly connected to the terminal mechanism 92 arranged in the connection mechanism 90 electrically, a pressure pump 21 for generating the pressurized air can be driven.

By constructing the dimensional relation between the corresponding parts on the ink cartridges 9 side and the corresponding parts of the connection mechanism 90 on the recording apparatus as mentioned above, in case that the ink cartridge 9 is detached from the recording apparatus, the connection between both is sequentially released in the reverse order to the foregoing.

According to the recording apparatus and the ink cartridge in the third aspect of the invention, in case that the ink cartridge is mounted on the recording apparatus, after the ink outlet port of the cartridge was connected to the ink inlet tube of the recording apparatus, the pressurized air inlet port is connected to the recording apparatus side. Therefore, when the cartridge is attached to or detached from the recording apparatus, it is possible to prevent the ink from leaking from the ink outlet port of the cartridge due to the action of the pressurized air.

In addition, the terminal mechanism is lastly connected to the circuit board mounted on the cartridge, and in case of detecting the completion of the electrical connection between both, the pressure pump for generating the pressurized air can be driven whereby upon completion of the mechanical connection state, the operation for introducing the pressurized air in the cartridge can be executed, so that it is possible to suitably control the introduction timing of the pressurized air.

Figure 17:
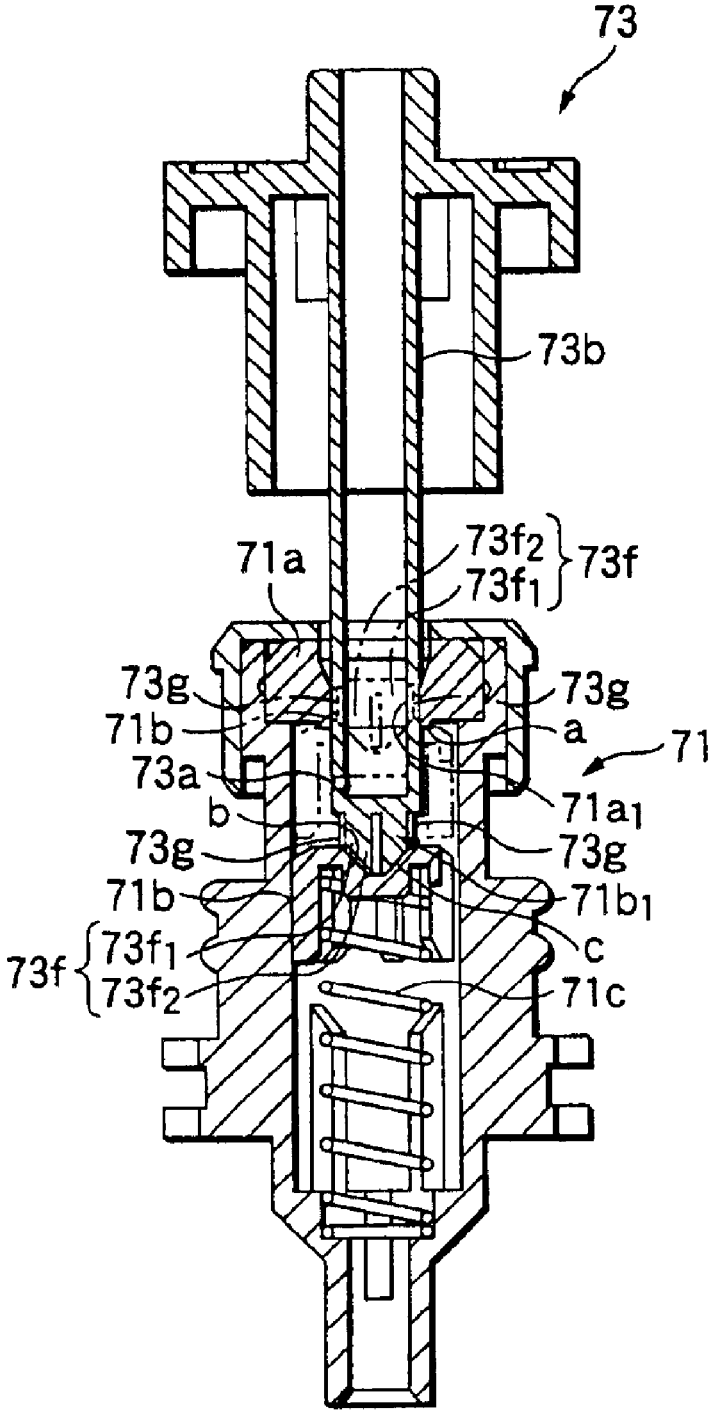
FIG. 17 is a cross-sectional view showing the connection structure of the ink cartridge according to the invention.
Figure 18:
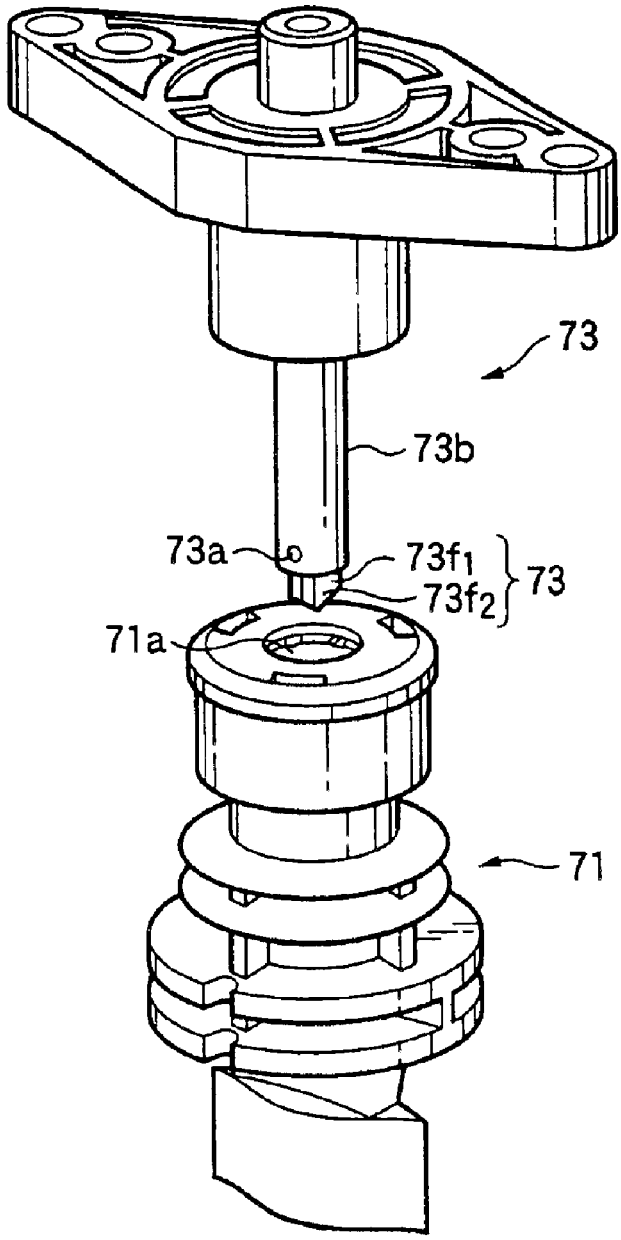
FIG. 18 is a perspective view similarly showing the connection structure of the ink cartridge according to the invention.

Next, connection structure of ink cartridge according to the fourth aspect of the invention and an ink jet recording apparatus using its connection structure will be described. FIGS. 17 and 18 are a cross-sectional view and a perspective view, which show the connection structure of the ink cartridge according to the fourth aspect of the invention.

FIG. 17 shows a state where, upon mounting of the ink cartridge 9 according to the present invention, an ink inlet tube 73*b* arranged in a cartridge holder 8 on the recording apparatus side is inserted into an ink outlet plug 71 constituting an ink outlet tube and the ink can be fed out from an ink pack 24 of the ink cartridge 9. Further, FIG. 18 shows a state before the ink inlet tube 73*b* is inserted into the ink outlet plug 71.

In FIGS. 17 and 18, an annular rubber-made packing member 71*a* is fitted into an ink outlet port 71$a_1$ located at an exit in the ink outlet plug 71 attached to the ink pack 24 side.

Further, in the ink outlet plug 71, a valve member 71*b* is housed, which moves axially and can open and close the ink outlet port 71$a_1$.

At an end surface central portion on the cartridge holder side of this valve member 71*b*, a substantially conical recess 71$b_1$ is provided, which has a tapered surface b for guiding a protuberance, which will be described later, formed at the ink inlet tube 73*b*, and opens so as to expand toward the leading end surface.

The valve member 71*b*, as shown by two-dot chain lines in FIG. 17, sits on a valve seat portion a formed projectingly at the opening periphery of the ink outlet port 71$a_1$ in the packing member 71*a* by the urging force of a coil spring 71*c*, and closes the ink outlet port 71$a_1$ (becomes a closed state).

Further, the valve member 71*b*, as shown by solid lines in FIG. 17, receives the pressing force by contact (press) produced by forcing the ink inlet tube 73*b* into the ink outlet plug 71, and separates from the valve seat portion a with this pressing operation thereby to open the ink outlet port 71$a_1$ (become an opened state).

On the other hand, the ink inlet tube 73*b* is constructed by a bottomed tube member that is forced into the ink outlet port 71$a_1$ of the packing member 71*a*, and arranged on the cartridge holder 8 side. Further, the ink inlet tube 73*b*, in a state where the ink cartridge 9 has been attached (connected) to the cartridge holder 8, is coupled to the ink outlet plug 71 concentrically.

At the leading end portion of the ink inlet tube 73*b*, an ink inlet hole 73*a* that opens to the tube wall side is provided. Further, at the end surface on the forced side (tube bottom surface) of the ink inlet tube 73*b*, a protuberance 73*f* for pressing the valve member 71*b* is integrally formed. This protuberance 73*f* has a function of discharging air in the ink outlet port $71a_1$ to the outside of the tube.

Figure 19A:
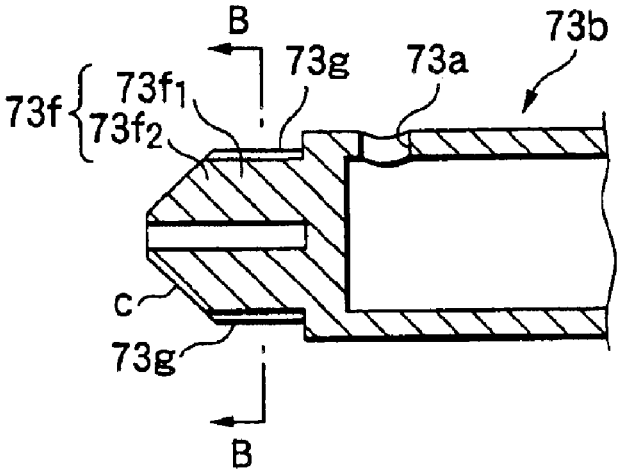
FIG. 19 is a cross-sectional view of an ink inlet tube in the connection structure of ink cartridge, and a cross-sectional view when viewed from a line B-B shown in the direction designated by arrows.
Figure 19B:
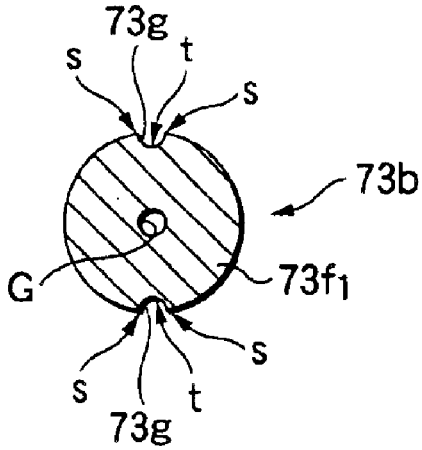

The protuberance 73*f*, as shown in FIGS. 19A and 19B, is formed by a trunk portion $73f_1$ that connects to the bottom portion of the ink inlet tube 73*b* and a pressing portion $73f_2$ that can be fitted to the recess $71b_1$.

The trunk portion $73f_1$ is formed by a columnar member that can be forced into the packing member 71*a*, and the pressing portion $73f_2$ is formed by a truncated conical member having such a tapered surface c as to fit to (come into close contact with) the tapered surface b of the recess $71b_1$.

In the protuberance 73*f*, two air discharging passages 73*g* are provided, which communicate with the inside and outside of the ink outlet port $71a_1$ in a state where the air in the ink outlet port $71a_1$ is discharged by the forced-insertion of the ink outlet tube 73*b* into the ink outlet plug 71.

These air discharging passages 73*g* are formed at portions symmetrical about a sectional center point of the trunk portion $73f_1$. Each of the air discharging passages 73*g* is constructed by a recess groove having a substantially semi-circular section and extending axially on the outer surface portion. Hereby, the air discharging passage 73*g* can be formed as a single linear passage.

Therefore, forming of the air discharging passage 73*g* in the form of the recess groove is performed more readily and reliably than boring machining of an air discharging passage constructed by two or more linear passages (bending passage).

In order to discharge the air in the ink outlet port $71a_1$ smoothly through the air discharging passages 73*g* to the outside of the tube, as shown in FIG. 19B, it is desirable that curved portions s, t are formed at two points in the air discharging passage 73*g* and the radiuses of these curved portions s, t are set as follows.

Namely, as shown in FIG. 19B, in case that the radius of the trunk portion $73f_1$ is set to 1.7 mm, the radius of the curved portion s is set to 0.1 mm and that of the curved portion t is set to 0.2 mm.

Further, in FIG. 19B, reference character G is a recess hole (opening radius of 0.25 mm) provided to the protuberance 73*f* in order to prevent shrinkage from being produced after molding (at the cooling time) of the protuberance 73*f* (ink inlet tube 73*b*).

Next, in the connection structure of the ink cartridge according to this example, the operation when the ink cartridge is connected to the cartridge holder of the recording apparatus will be described with reference to FIGS. 20A to 20D.

FIGS. 20A to 20D are cross-sectional views for explaining the operation when the ink cartridge is connected to the cartridge holder.

Figure 20A:
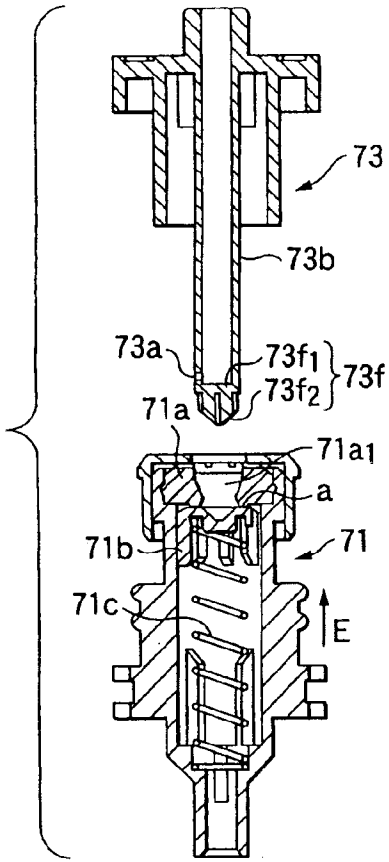
FIG. 20 is a cross-sectional view for explaining the operation in case that the ink cartridge is connected to the cartridge holder.
Figure 20B:
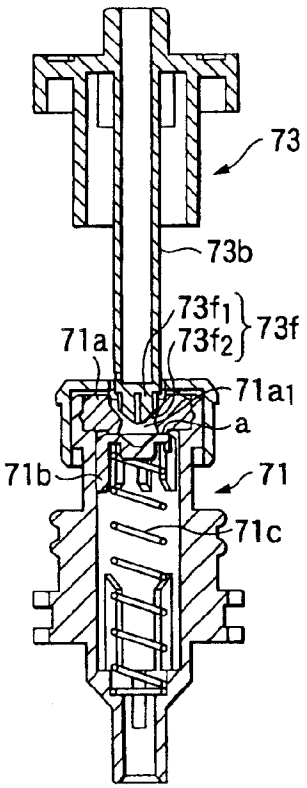

FIG. 20A shows a state before the inlet tube 73*b* of the ink inlet member 73 is inserted into the ink outlet plug 71, and FIG. 20B shows a state immediately before the protuberance 73*f* of the ink inlet tube 73*b* starts to discharge the air in the ink outlet port $71a_1$.

Figure 20C:
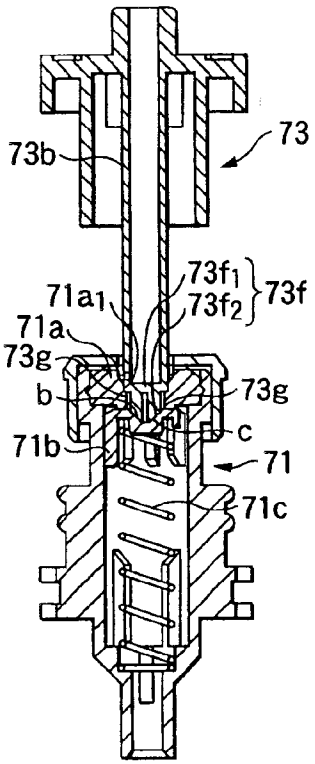
Figure 20D:
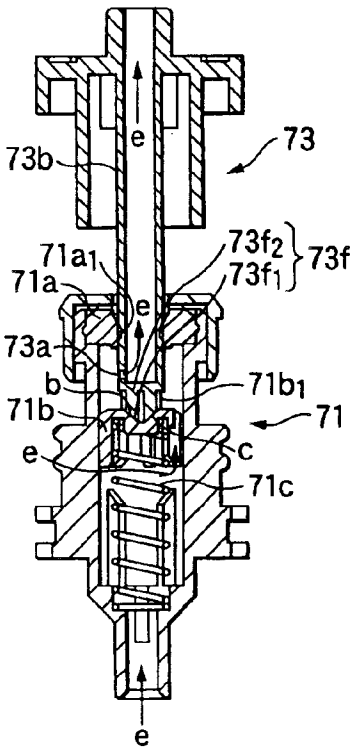

Further, FIG. 20C shows a state where the protuberance 73*f* of the ink inlet tube 73*b* has completed the discharge of the air in the ink outlet port $71a_1$, and FIG. 20D shows a state after the ink inlet tube 73*b* was connected to the ink outlet plug 71.

Firstly, as shown in FIG. 20A, the axial line of the ink outlet plug 71 is caused to coincide with the axial line of the ink inlet tube 73*b*, and the ink cartridge 9 is arranged in a position opposed to the cartridge holder 8 on the recording apparatus side.

In this case, the valve member 71*b* sits on the valve seat a of the packing member 71*a* by the urging force in the direction of an arrow E by the spring member 71*c*, and closes the ink outlet port $71a_1$ to become a closed state. Therefore, leakage of ink from the ink pack 24 of the ink cartridge 9 into the ink inlet tube 73*b* is prevented.

Then, as shown in FIG. 20B, the ink cartridge 9 is moved to the cartridge holder 8 side along the axial line of the ink inlet tube 73*b*. In this case, with the movement of the ink cartridge 9, the protuberance 73*f* of the ink inlet tube 73*b* moves to the air-discharge start position in the ink outlet port $71a_1$ of the packing member 71*a*.

Thereafter, as shown in FIG. 20C, the tapered surface c of the protuberance 73*f* in the ink inlet tube 73*b* comes into close contact with the tapered surface b of the recess $71b_1$ in the valve member 71*b*, and the ink cartridge 9 is moved to the cartridge holder 8 side till the protuberance 73*f* is fitted into the recess $71b_1$.

In this case, with the movement of the ink cartridge 9, the pressing portion $73f_2$ of the protuberance 73*f* is guided to the tapered surface b of the recess $71b_1$ in the valve member 71*b*, and the protuberance 73*f* moves from the air-discharge start position in the ink outlet port $71a_1$ of the packing member 71*a* to the air-discharge end position.

Therefore, the trunk portion $73f_1$ of the protuberance 73*f* is forced into the ink outlet port $71a_1$, the pressing portion $73f_2$ presses the air in the ink outlet port $71a_1$ into the recess $71b_1$, and the pressed air in the ink outlet port $71a_1$ is discharged through the air discharging passages 73*g* to the outside of the ink outlet plug 71.

Then, as shown in FIG. 20D, till the ink cartridge 9 is attached (connected) to the cartridge holder 8, the ink cartridge 9 is moved along the axial line of the ink inlet tube 73*b* to the cartridge holder 8 side. In this case, with the movement of the ink cartridge 9, the ink inlet tube 73*b* is forced into the packing member 71*a*.

Further, the valve member 71*b* moves in the tube outlet plug 71 in a direction opposed to the movement direction of the ink cartridge 9 against the spring force of the spring 71*c*. In this case, a state where the tapered surface b of the recess $71b_1$ is brought into close contact with the tapered surface c of the protuberance 73*f* is maintained.

Therefore, the ink inlet hole 73*a* formed in the ink inlet tube 73*b* opens in the ink outlet plug 71, the ink inlet tube 73*b* and the ink outlet plug 71 are communicated with each other, and an ink flow passage is formed, through which the ink from the ink pack 24 flows in the ink inlet tube 73 in the direction shown by an arrow e.

The ink cartridge 9 functioning as an ink cartridge is thus connected to the cartridge holder 8.

In this example, when the protuberance 73*f* and the recess $71b_1$ are fitted to each other, since the recess hole G is closed by the valve member 71*b*, the air in the recess hole G is sealingly captured into the recess hole G. Therefore, the air in the recess hole G is never mixed in the ink fed out from the ink pack 24 into the ink inlet tube 73*b*.

As described above, at the connection time of the ink cartridge 9, it is possible to prevent the air in the ink outlet port 71$a_1$ from entering into the ink outlet plug 71 and the ink inlet tube 73*b*. Therefore, air bubbles do not exist in the ink in the ink flow passage, and production of the printing trouble can be prevented.

Further, at the connection time of the ink cartridge 9, since the protuberance 73*f* of the ink inlet tube 73*b* is fitted into the recess 71$b_1$ of the valve member 71*b*, the axis alignment between the ink outlet plug 71 and the ink inlet tube 73*b* can be performed readily and reliably.

In this case, on the fitting surfaces of the recess 71$b_1$ and the protuberance 73*f*, the tapered surfaces b, c for guiding the ink inlet tube 73*b* into the ink outlet plug 71 are formed. Therefore, the ink inlet tube 73*b* is smoothly forced into the ink outlet plug 71.

Figure 21A:
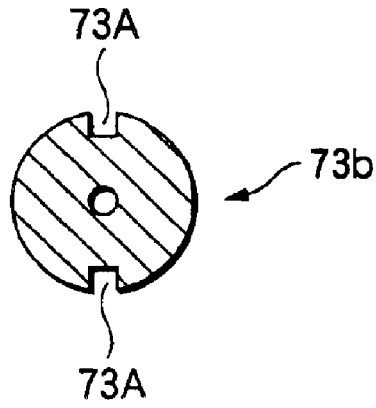
FIG. 21 is a cross-sectional view showing a modification of the ink inlet tube in the connection structure of the ink cartridge.
Figure 21B:
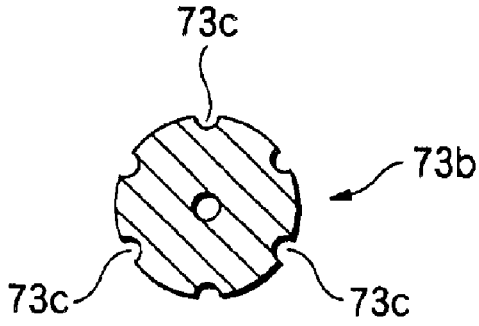

In this example, the sectional configuration of the air discharging passage 73*g* is substantially semi-circular. However, the connection structure of the invention is not limited to this but an air discharging passage 73A having the substantially rectangular section as shown in FIG. 21A may be used. Further, in this example, the number of the air discharging passages 73*g* is two. However, the invention is not limited to this, but it may be one or three or more as shown in FIG. 21B.

As described above, according to the connection structure of the ink cartridge in the fourth aspect of the invention, it is possible to prevent the air in the ink outlet port from entering into the tubes at the connection time of the ink cartridge, whereby production of the printing trouble can be prevented. Further, by providing the aforesaid connection structure, an ink jet recording apparatus that can prevent the printing trouble from being produced can be provided.

Next, with reference to FIGS. 22 to 26, the constitution of an ink cartridge according to the fifth aspect of the invention will be described. The ink cartridge according to the fifth aspect is characterized by an annular packing member that is arranged in an ink outlet plug 71.

Figure 22:
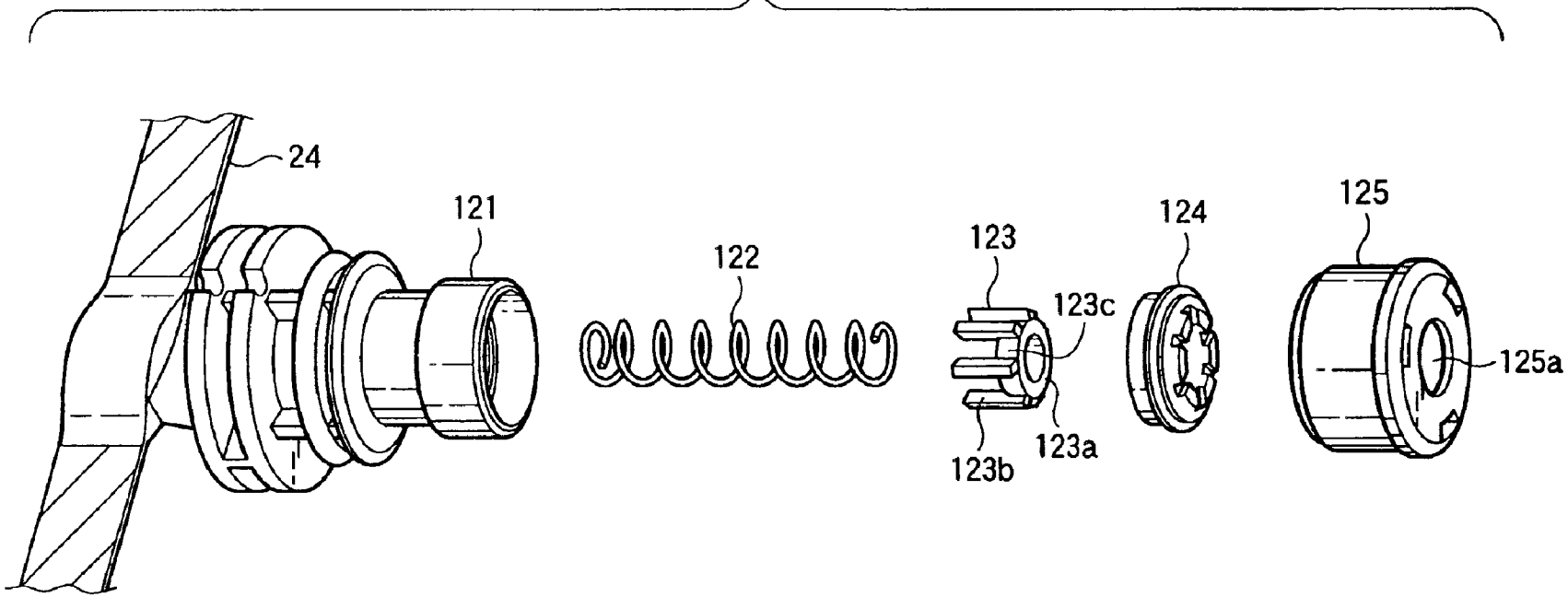
FIG. 22 is an exploded perspective view showing the construction of an ink outlet section arranged at an end portion of the ink pack.
Figure 23:
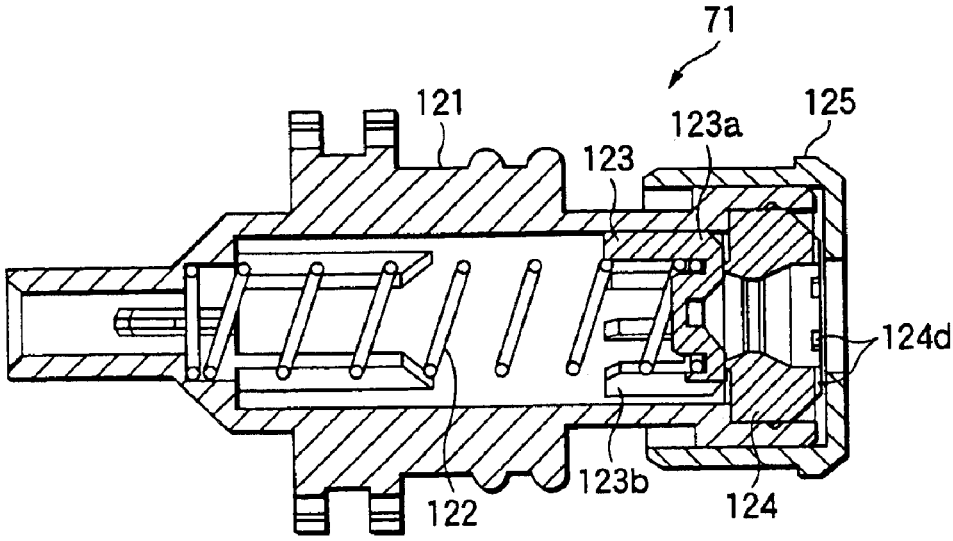
FIG. 23 is a central cross-sectional view showing the construction of the ink outlet section.

FIGS. 22 and 23 show the constitution of an ink outlet plug 71 arranged in the center of the end portion of the ink pack 24. FIG. 22 is an exploded perspective view of this constitution, and FIG. 23 is an enlarged center sectional view.

This ink outlet plug 71 includes a cylindrical member 121 attached in the center of the end portion of the ink pack 24 in a sealed state. In this cylindrical member 121, a coil spring 122 is housed. Further, a valve member 123 that can move through the spring 122 is housed in the cylindrical member 121.

At the exit end portion of the cylindrical member 121, an annular packing member 124 is fitted into the cylindrical member 121 to seal the cylindrical member 121, and in order to prevent removal of the packing member 124, a cap member 125 having an opening 125*a* is attached so as to cover the exit end portion of the cylindrical member 121 thereby to constitute the ink outlet plug 71.

In FIGS. 22 to 26 described below, the spring member 122 corresponds to the spring member 71*c* shown, for example, in FIG. 14 that has been already described, and the valve member 123 corresponds to the valve member 71*b* shown in FIG. 14, and the packing member 124 corresponding to the packing member 71*a* shown in FIG. 14.

This valve member 123 is urged by the coil spring member 122 toward one end surface of the packing member 124 as shown in FIG. 23, whereby the valve member 122 comes into contact with the one end surface of the packing member 124 and prevents the outflow of ink.

A disc-shaped member 123*a* having a function of preventing the ink outflow by contact with the one end surface of the packing member is provided to the valve member 123. Further, plural guide members 123*b* are formed integrally with the disc-shaped member 123*a* and formed intermittently along the periphery of the disc-shaped member 123*a*.

Accordingly, by the plural guide members 123*b* extending axially, the valve member 123 functions so that it can slide and move in the cylindrical member 121. Further, by providing the plural guide members 123*b* intermittently along the periphery of the disc-shaped member 123*a*, gaps 123*c* are formed between the respective guide members as shown in FIG. 22.

These gaps 123*c* function as an ink flow passage used when the ink is led to the outside in a state where the joint of the disc-shaped member to the one end surface of the packing member has been released.

Figure 25A:
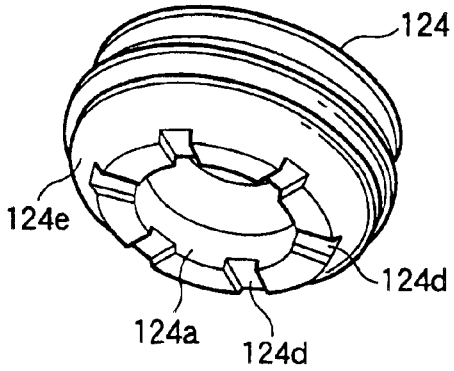
FIG. 25 is a perspective view viewed from a front side and a backside of the packing member.
Figure 25B:
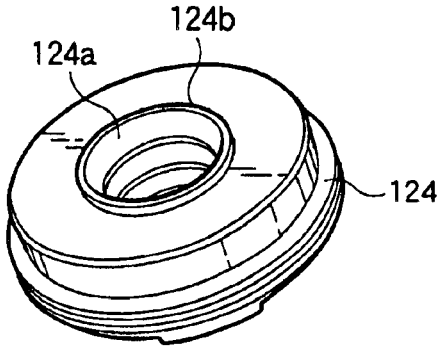

On the other hand, FIGS. 25 and 26 show the constitution of the packing member 124. FIGS. 25A and 25B show perspective views respectively viewed from the front side and the backside of the packing member. Further, FIG. 26A is a front view in which the packing member is viewed from one end surface, FIG. 26C is a side view, FIG. 26D is a rear diagram in which the packing member is viewed from the other end surface, and FIG. 26B is a cross-sectional view when viewed from a line C—C in FIG. 26D in the direction of arrows.

The packing member 124 is formed by molding rubber material into an annular shape, whereby an opening portion 124*a* in a penetrating state is formed in the center of the packing member. On one end surface of the packing member 124, opposed to the valve member 123, as shown in FIG. 26B, an annular projection part 124*b* is formed so as to surround the opening portion 124*a*.

Accordingly, the disc-shaped member 123*a* of the valve member 123 is joined to this projection part 124*b*, whereby the projection part 124*b*, deforms and fulfills the seal function between the projection part and the disc-shaped member 123*a*.

Figure 26A:
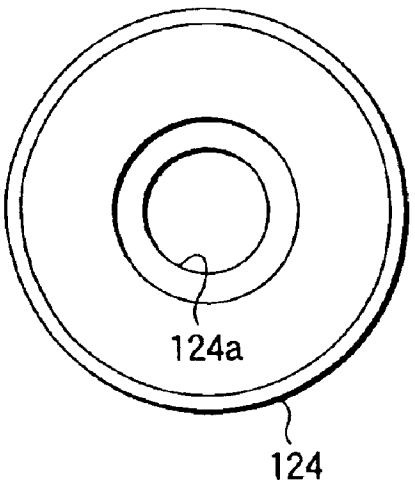
FIG. 26 is a diagram showing the states of the packing member viewed from each side and the sectional states.
Figure 26B:
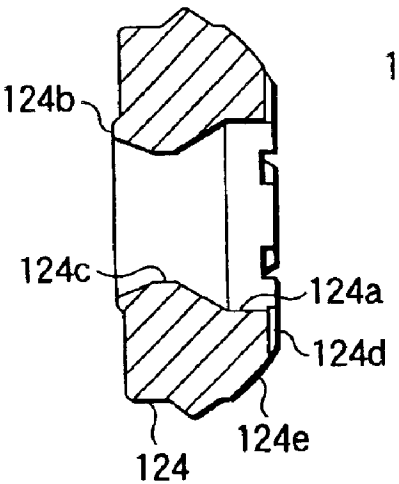
Figure 26C:
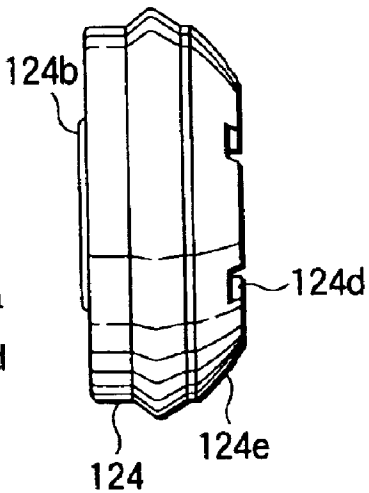

Further, on the inner circumferential surface of the opening portion 124*a* of the packing member 124, in order to come into contact with the outer circumferential surface of the ink inlet tube 73*b* arranged on the recording apparatus side, an annular slide-contact portion 124 of which the inner diameter is made thin is formed as shown in FIG. 26B. This slide-contact portion 124*c* is formed, being offset toward the aforesaid one end surface side to which the valve member 123 joins.

On the other hand, on the other end surface of the packing member 124, that is, on the side where the ink inlet tube 73*b* is attached or detached, plural grooves 124*d* are radially formed respectively so as to communicate from the inner circumferential surface of the central opening part 124*a* to the outer circumferential surface.

Figure 26D:
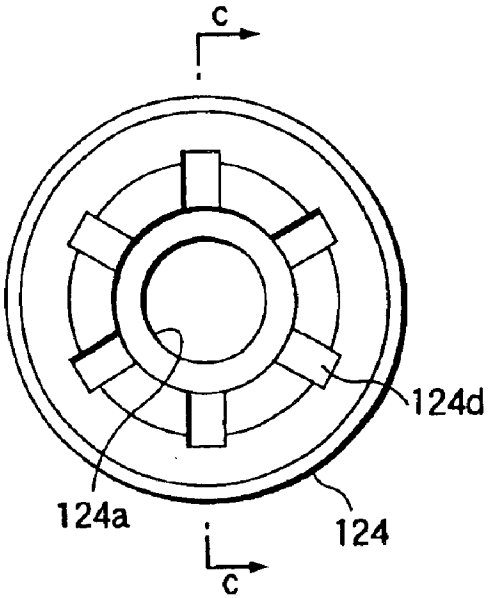

In this example, six grooves 124*d* are radially formed respectively at substantially equal intervals as shown in FIGS. 25A and 26D. The thus constructed packing member 124 is incorporated, as shown in FIG. 23, so that the other end surface to which the grooves 124*d* are provided is located on the exit side of the ink outlet plug 71.

Further, on the other end surface of the packing member 124, a chamfer 124*e* is provided substantially at an angle of 45 degrees, as shown in FIGS. 25A and 26B. This chamfer

124*e* is formed in order to intentionally offset a position of the center of gravity.

Namely, the provision of this chamfer 124*e* for offsetting the position of the center of gravity of the packing member is advantageous, in case of utilizing an automatic assembly machine, such that the packing members 124 can be directed in the same front and rear surface orientation by, for example, application of small vibration.

By attachment of the ink cartridge, the hollow ink inlet tube 73*b* arranged on the cartridge holder is inserted into the thus formed ink outlet plug 71, and the ink can be fed out from the cartridge. This state is shown, for example, in FIG. 14 that has been already described. Accordingly, the action of the ink outlet plug 71 in the ink cartridge according to this fifth aspect will be described with reference also to the constitution shown in FIG. 14.

Here, as described before with reference to FIG. 26B, the annular slide-contact portion 124*c* is formed on the inner circumferential surface of the opening portion 124*a* in the packing member 124, and further this slide-contact portion 124*c* is formed, being offset toward the one end surface side to which the valve member 123 joins.

By this constitution, as shown in FIG. 14B, in case that the ink cartridge has been mounted on the recording apparatus, the slide-contact portion 124*c* is deformed somewhat toward the deep side in the relative entry direction of the ink inlet tube by friction between the ink inlet tube 73*b* and it.

However, since there is a clearance for relief toward the end portion on the deep side of the packing member 124, it is possible to prevent the inner circumferential surface of the opening portion 124*a* from becoming the abnormal deformation state upon reception of the aforesaid frictional resistance, for example, a state where it turns sideways toward the deep side.

In case that ink cartridge is detached from the recording apparatus, since the ink is stuck to the outer circumferential surface of the ink inlet tube 73*b*, the frictional resistance becomes very small at the detachment time, so that an adverse influence caused by offsetting the slide-contact portion 124*c* to one end side is not produced.

As described before, on the other end surface of the packing member 124, the plural grooves 124*d* are radially formed respectively. As shown in FIG. 23, in case that the packing member 124 has been incorporated into the ink outlet plug 71 in a normal state, an effect produced by offsetting the slide-contact portion 124*c* to one end side can be exhibit.

However, in case that the packing member 124 has been erroneously incorporated in the reverse direction, an effect produced by offsetting the slide-contact portion 124*c* to one end side cannot be obtained, and an adverse influence is rather produced.

By forming the plural grooves 124*d* on the other end surface of the packing member 124, an error of incorporating direction of the packing member 124 can be found out reliably.

Figure 24:
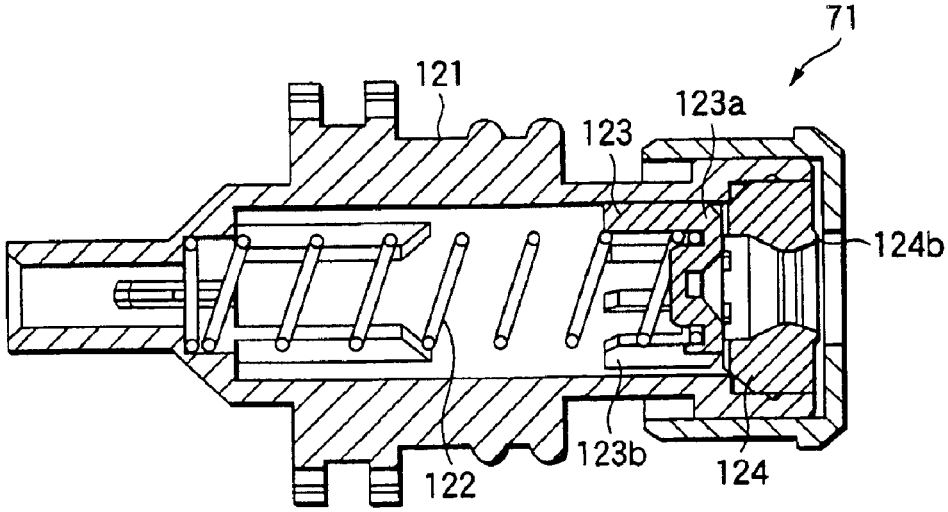
FIG. 24 is a central cross-sectional view showing an example in which a packing member is incorporated into the ink outlet section in the reverse direction.

FIG. 24 shows a state where the packing member 124 has been incorporated erroneously in the reverse direction. In this case, the end surface of the packing member where the grooves 124*d* are formed faces to the valve member 123, so that the ink in the ink pack leaks through the grooves 124*d* from the central opening portion 124*a*.

This is, as described with reference to FIG. 11, because in case of filling the ink into the ink pack 24, the ink outlet plug 71 is faced downward and the opening of the ink pack 24 on the opposed side to the arrangement position of the ink outlet plug 71 is utilized. Accordingly, in a process of filling the ink into the ink pack, the ink leaks from the ink outlet plug 71.

Hereby, it can be found soon that the packing member 124 is incorporated in the erroneous direction, and it is possible to previously prevent the ink cartridge from being shipped in the erroneous state.

Though the six grooves 124*d* are formed at the other end surface of the packing member in the above-mentioned example, as long as at least one groove is formed, the similar effects can be obtained.

Further, in the above-mentioned example, the pressurized air is introduced in the case of the ink cartridge. However, even if the invention is applied to other ink cartridges than the ink cartridge having such the constitution, the similar effects can be obtained.

As clear from the above description, according to the ink cartridge in the fifth aspect of the invention, on one end surface of the packing member, at least one groove is formed so as to communicate from the inner circumferential surface of the central opening portion to the outer circumferential surface. Therefore, it is possible to readily find that the packing member 124 is incorporated in the erroneous direction. Since the slide-contact portion is formed in the packing member while being offset to one end surface side, it is possible to prevent the production of unreasonable friction when the cartridge is attached to or detached from the recording apparatus.

Figure 27:
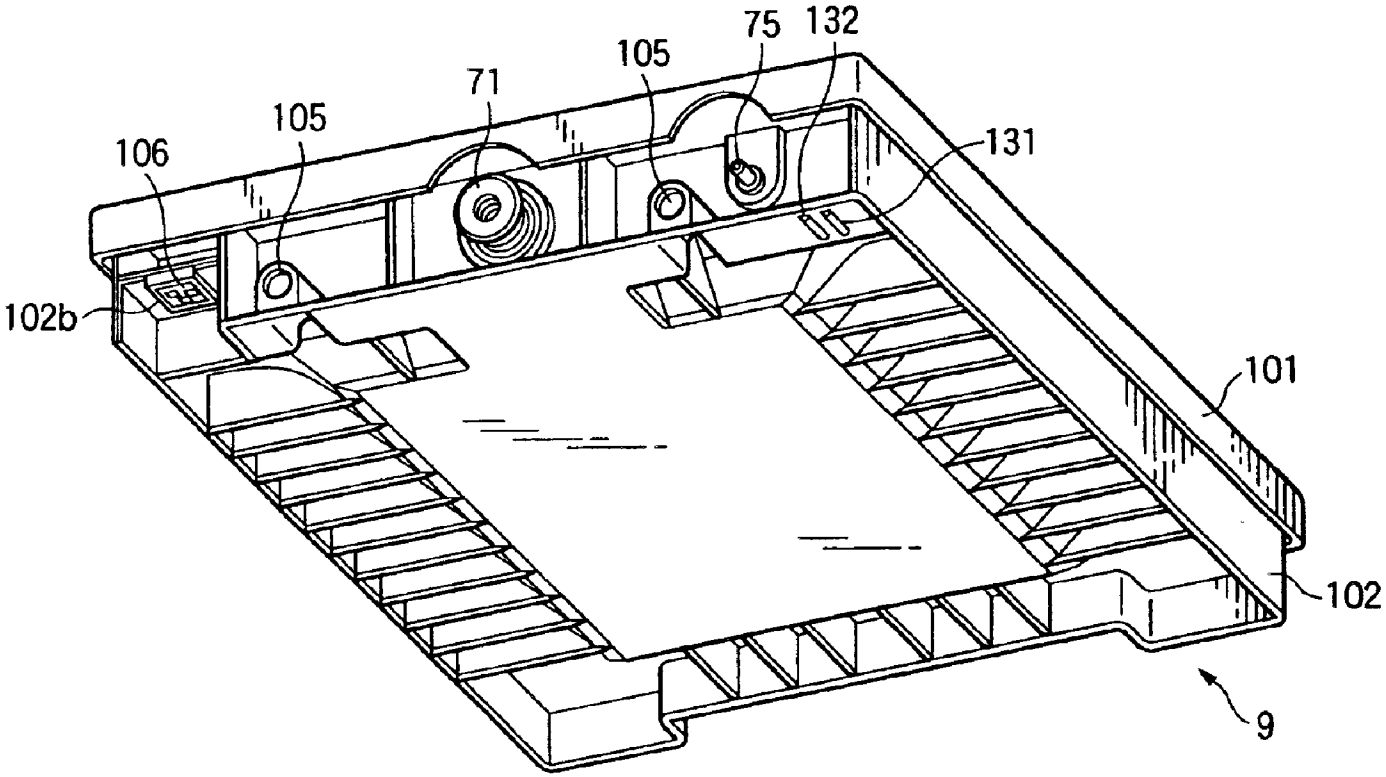
FIG. 27 is a perspective view showing the appearance and the construction of an ink cartridge according to another mode of the invention.

Next, an ink cartridge and a recording apparatus according to the sixth aspect of the invention will be described with reference to FIGS. 27 to 30. FIGS. 27 and 28 show an example of an ink cartridge used in the ink jet recording apparatus according to the sixth aspect.

The ink cartridge shown in FIGS. 27 and 28 is the same in the basic constitution as the ink cartridge that has been described with reference to FIG. 9. Accordingly, portions corresponding to those in FIG. 9 are denoted by the same reference numerals and their detailed description is omitted.

The ink cartridge shown in FIGS. 27 and 28 is different from the cartridge shown in FIG. 9 in that two protuberances (lug members) 131, 132 are formed at the bottom surface of a second case 102 functioning as a lower case and integrally with the case with the predetermined space in parallel.

The formed positions of these protuberances 131, 132 in the second case 102 are determined according to the kind of ink sealed in the ink pack 24.

Figure 28A:
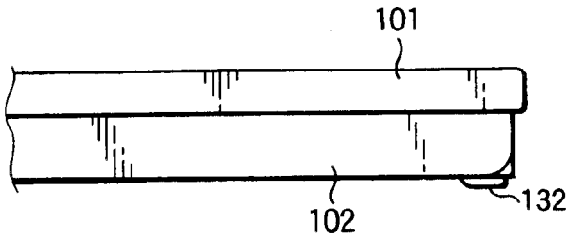
FIG. 28 is a plan view, a front view and a side view of the ink cartridge shown in FIG. 27.
Figure 28B:
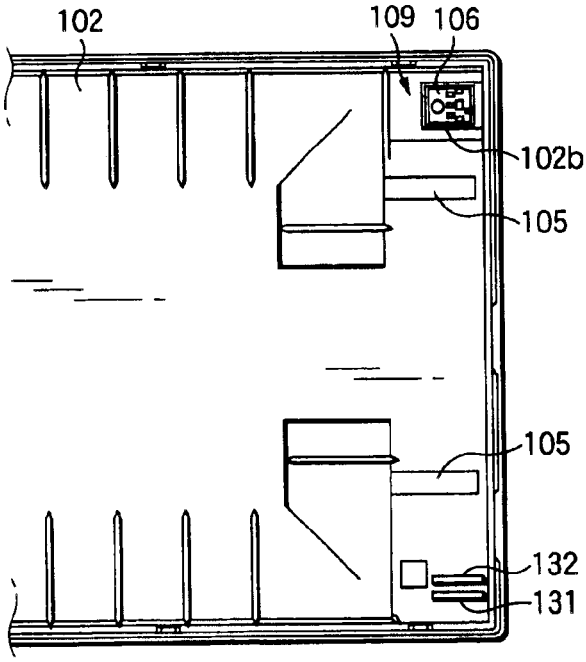
Figure 28C:
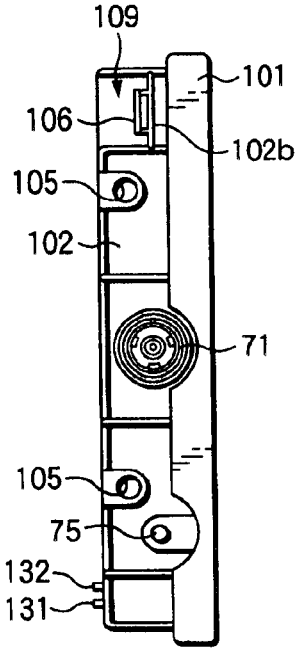

For example, in case that black ink is sealed in the ink pack 24 (the present example), as shown in FIGS. 28A and 28C, taking a dimension from the side surface of the lower case 102 to the formed position of each of the protuberances 131, 132 as A, B, A is set to 7.5 (mm) and B is set to 12.5 (mm).

In case that ink of cyan (C), magenta (M) or yellow (Y) is sealed in the ink pack 24, A and B are set respectively as follows: A=7.5 (mm) and B=17.5 (mm); A=7.5 (mm) and B=22.5 (mm); and A=12.5 (mm) and B=22.5 (mm).

Further, in case that ink of light cyan (LC) or light magenta (LM) is sealed, A and B are set respectively as follows: A=7.5 (mm) and B=27.5 (mm); and A=12.5 (mm) and B=17.5 (mm).

On the other, other ink information data than the kind of ink color, for example, a classification of pigment/dye ink, residual ink amount, serial number, expiration date, and the intended type of apparatus are stored in a storage element of a circuit board 106 arranged in the ink cartridge in this example.

The information data on the ink residual amount is written into the storage element when the ink cartridge 9 is pulled out from the cartridge holder 8 (connection between the cartridge and the holder is released).

As a result, in case that the ink cartridge that was used once is mounted again on the cartridge holder 8, its ink residual data is read by a data identification means, so that the residual ink amount at the present time is recognized.

Figure 29:
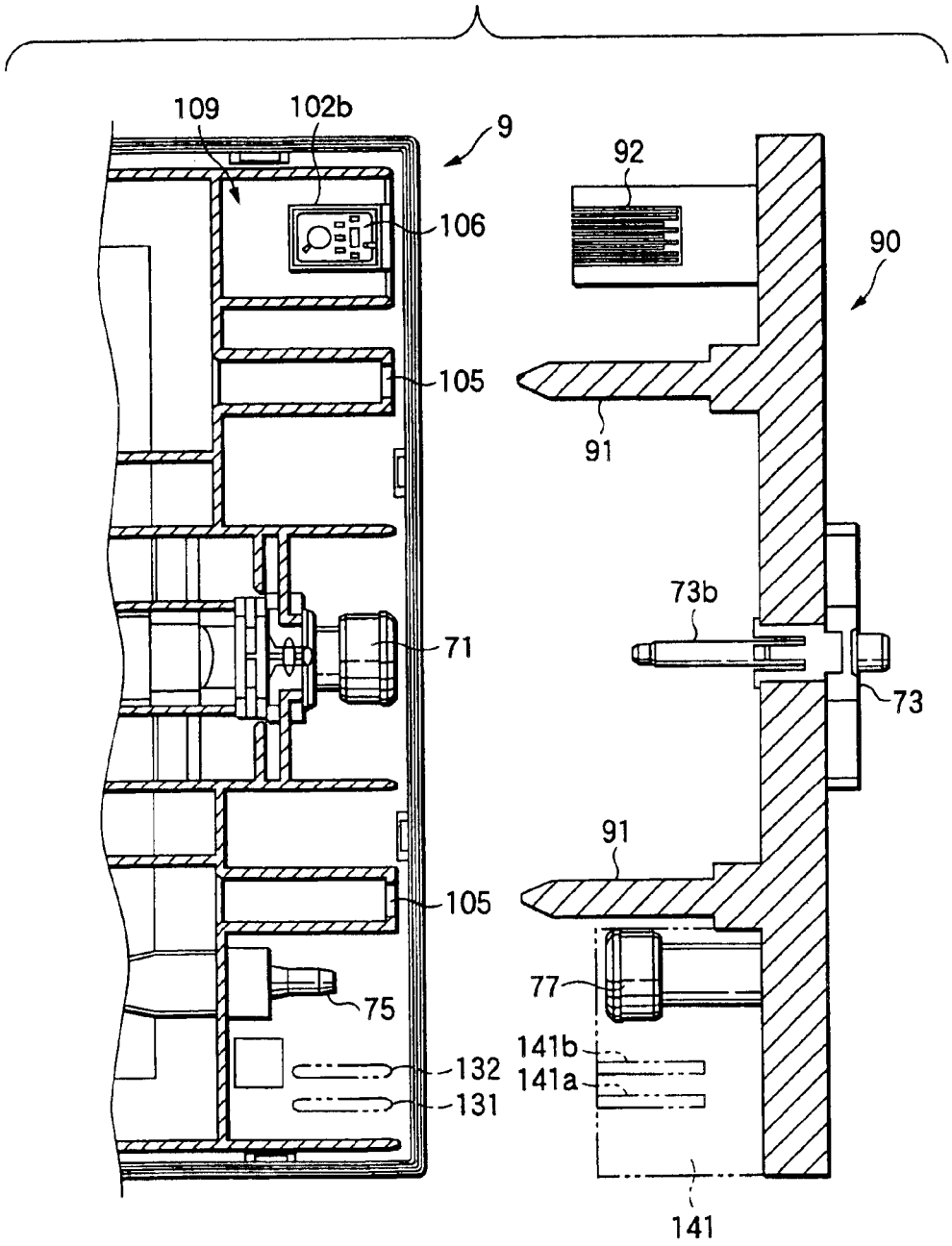
FIG. 29 is a sectional view showing one surface side end portion of the ink cartridge shown in FIGS. 27 and 28 and connection mechanism provided in a cartridge holder.

FIG. 29 shows a section of the end portion on one side of the ink cartridge 9, in which a state where the cartridge holder 9 is to be attached to a connection mechanism 90 arranged in the cartridge holder 8 on the recording apparatus. Further, FIG. 30 shows a perspective view of the connection mechanism 90 arranged in the cartridge holder 8.

Figure 30:
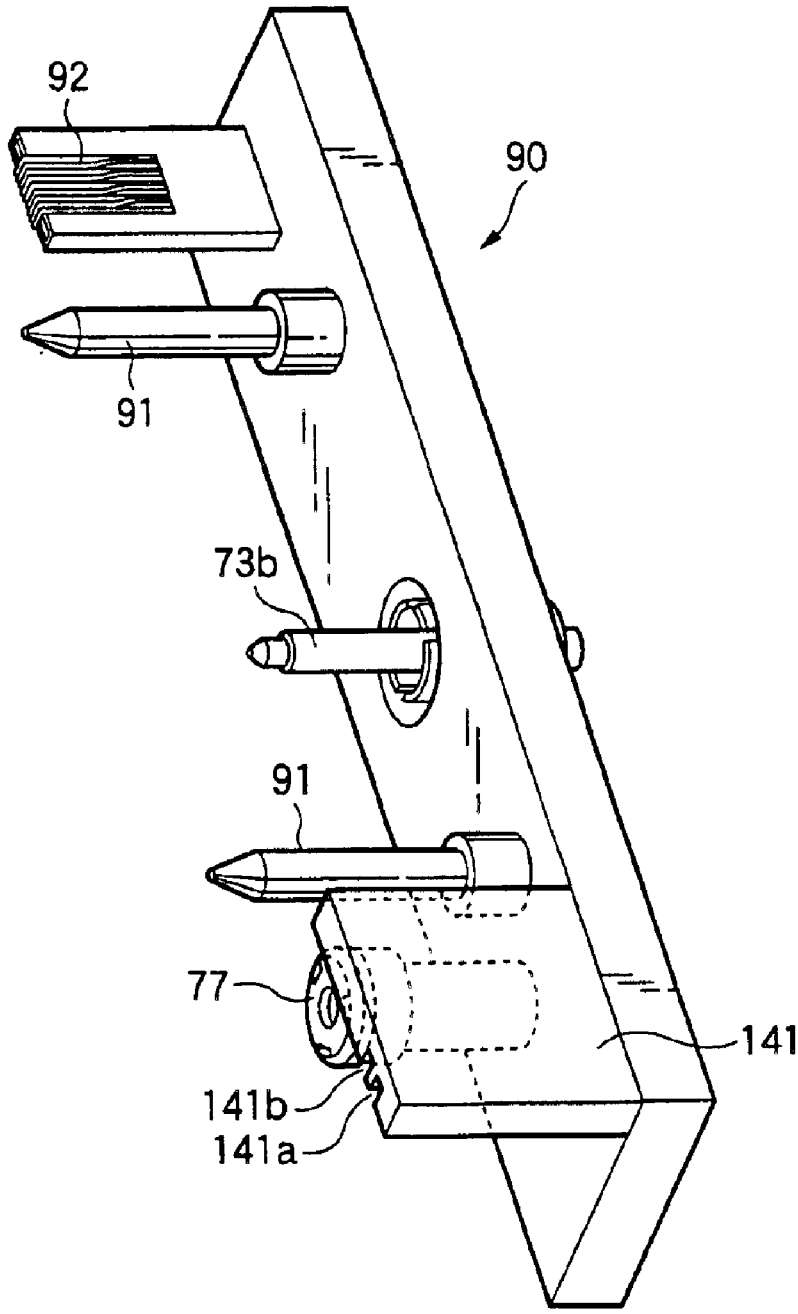
FIG. 30 is a perspective view showing the connection mechanism shown in FIG. 29.

The constitution shown in FIGS. 29 and 30 is basically the same as the constitution shown in FIGS. 12 and 13. Accordingly, portions corresponding to those in FIGS. 12 and 13 are denoted by the same reference numerals and their detailed description is omitted. The constitution shown in FIGS. 29 and 30 is different from the constitution shown in FIGS. 12 and 13 in that a connection plate 141 is provided to the connection mechanism 90.

In this connection plate 141, recesses 141*a*, 141*b* are arranged, which can fit or unfit to the respective protuberances 131, 132 according to right/wrong in connection between the cartridge and the holder regarding the color kind of printing ink. These recesses 141*a*, 141*b* are formed by concave grooves extending in the inserting and pulling-out direction of the ink inlet tube 73*b* with respect to the ink outlet plug 71.

Under the above constitution, when the ink cartridge 9 is connected to the cartridge holder 8 (connection mechanism 90), two positioning pins 91 arranged on the recording apparatus side are firstly inserted into respective opening holes 105 on the cartridge 9 side. At this time, in case the ink cartridge 9 is of appropriate ink color kind, the protuberances 131, 132 fit to the recesses 141*a*, 141*b*, respectively.

In case that the ink color kind is different and the protuberances 31, 132 do not fit to the respective recesses 141*a*, 141*b*, the positioning pins 91 cannot be inserted into the respective opening holes 105.

Hereby, by fitting of the protuberances 131, 132 to the respective recesses 141*a*, 141*b*, compatibility (right/wrong) regarding the kind of ink color is detected. In case that the kind of ink color is compatible, the ink outlet plug 71 communicates with the ink inlet tube 73*b*.

As described above, before communication of the ink outlet plug 71 with the ink inlet tube 73*b*, it is possible to detect that the kind of color is the same or different. Therefore, mixing of ink color can be prevented.

By insertion of the positioning pins 91 into the respective opening holes 105, the terminal mechanism 92 is connected to a circuit board 106, and the recording apparatus can obtain information data such as a classification of pigment/dye ink, residual ink amount, serial number, expiration date, and the intended type of apparatus according to the data read out from the circuit board 106.

Hereby, other ink information data than the kind of ink color is read by a data identification means on the recording apparatus.

At this time, in case that the ink cartridge 9 that is different in classification of pigment/dye ink has been mounted, the ink outlet plug 71 and the ink inlet tube 73*b* communicate with each other. However, since the kind of color is the same, an influence on printing quality caused by mixing is small.

A result of detection by the data identification means is confirmed by display in a display unit such as a lamp arranged in an operation panel of the recording apparatus, or by sound action by a sound generator such as a buzzer.

In case that other ink information data than the kind of ink color is changed or added, correspondingly, the written data of the storage element can be changed or added. Therefore, it is not necessary to form many recesses and protuberances like the conventional case, and it is possible to reduce the cost.

Further, since the necessary ink information data can be identified by the data identification means, mixing of ink that are different in composition and use of the ink cartridge that is not adapted to a type of apparatus are prevented, so that good printing can be realized.

In the aforesaid example, the two protuberances 131, 132 and the two recesses 141*a*, 141*b* are provided, however the invention is not limited to this. The number of them may be respectively single or three or more.

Further, in the example, though the protuberances 131, 132 are provided to the ink cartridge 9, and the recesses 141*a*, 141*b* are provided to the cartridge holder 8, the invention is not limited to this. Even in case that these relations in the cartridge holder 8 and the ink cartridge 9 are exchanged, the similar effects can be obtained.

An ink cartridge according to the seventh aspect of the invention and a recording apparatus capable of utilizing this ink cartridge will be described with reference to FIGS. 31 to 38.

The ink cartridge according to this seventh aspect of the invention includes a first valve body and a second valve body. This first valve body corresponds to the valve member 71*b* provided to the ink outlet plug 71 shown, for example, in FIG. 14 that has been already described. On the other hand, the second valve body is constructed by a check valve that closes a tube passage where the valve member 71*b* functioning as the first valve body is arranged and that can feed out ink to the recording apparatus side in case that the ink pack is pressured by air pressure.

Accordingly, the constitution and arrangement of the second valve body will be mainly described below. FIGS. 31 to 33 are diagrams for showing an ink outlet plug portion in the ink cartridge according to a first example of the seventh aspect.

In FIGS. 31 to 33, the ink outlet plug 71 has a first tube 161 and a second tube 162, and is so constructed that it can be removably attached to an ink inlet tube 73*b* of the cartridge holder 8 as described before.

On an ink supplied side of this ink outlet plug 71, the valve member 71*b* (refer to FIG. 14) functioning as a first valve body is arranged, and on an ink supplying side (ink pack side), a valve body 163 functioning as a second valve body, which will be described later, is arranged.

The valve member 71*b* as the first valve body is constructed by an opening and closing valve that is opened by insertion of the ink outlet plug 71 into the ink inlet tube 73*b*, and closed by pulling of the ink outlet plug 71 from the ink inlet tube 73*b*, as described before.

Figure 32B:
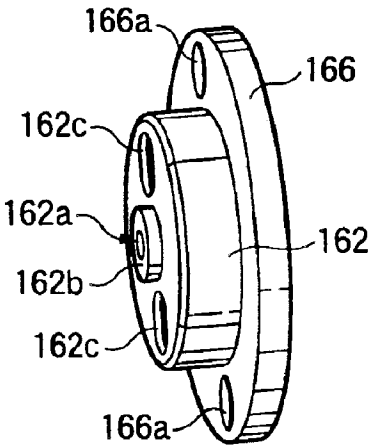
FIG. 32 is a perspective view showing the construction of a first tube and a second tube in the first embodiment.
Figure 32A:
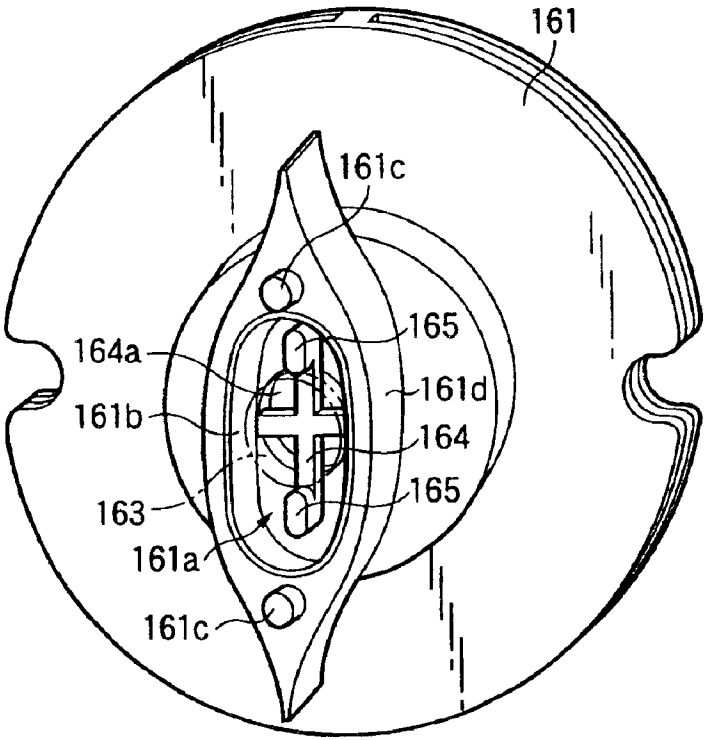
Figure 33B:
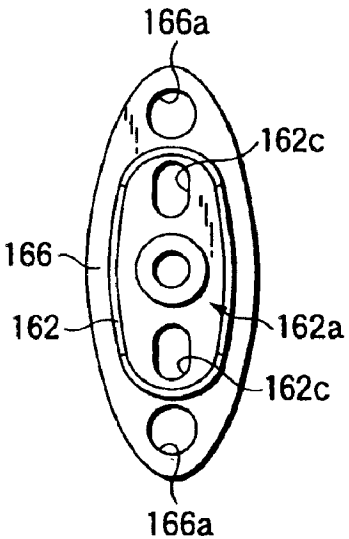
FIG. 33 is a plan view showing the construction of the first tube and the second tube in the first embodiment.
Figure 33A:
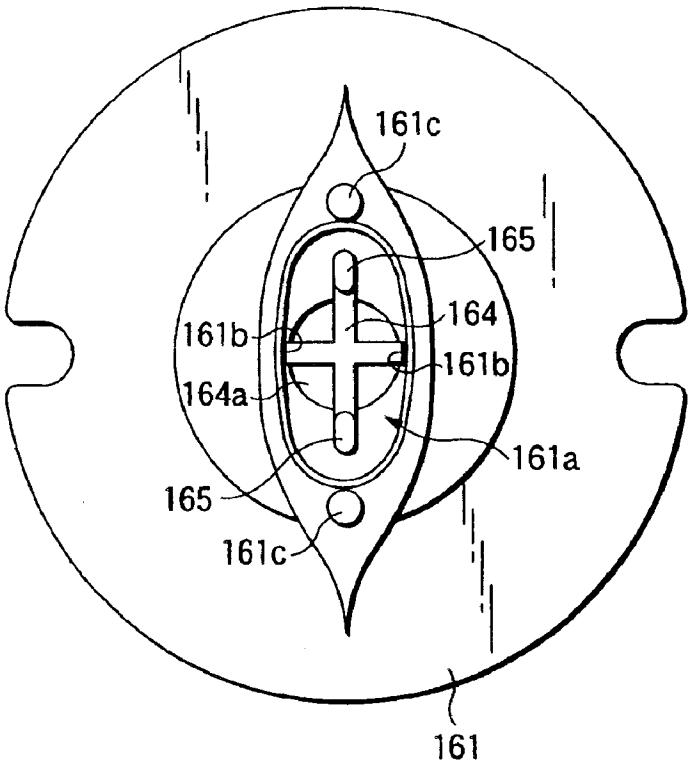

In the first tube 161 shown in FIGS. 32A and 33A, an inflow passage 161*a* that can be connected to the ink inlet tube 73*b* and such a stopper 164 as to cross this inflow passage 161*a* are provided. At passage walls of the inflow passage 161*a*, two stopper surfaces 161*b* are formed, which are juxtaposed at regular intervals in the circumferential direction and regulate the sideward movement (the movement in the direction orthogonal to the axial line direction of the inflow passage 161*a*) of the valve body 163.

Further, on the end surface on the ink supplying side of the first tube 161, a pair of positioning protuberances 161*c* are integrally formed, which are located out of the inflow passage 161*a* and juxtaposed at regular intervals in the circumferential direction.

The stopper 164 is constructed by a cross-shaped thin piece having an ink supply port 164*a*, and arranged on the ink-supplied side of the valve body 163 (on the ink supply side of the valve member 71*b*). For this stopper 164, a pair of movement regulating piece 165 are integrally provided, which are juxtaposed with the stopper surfaces 161*b*, at predetermined intervals in the circumferential direction, and protrude on the ink supplying side.

Figure 31A:
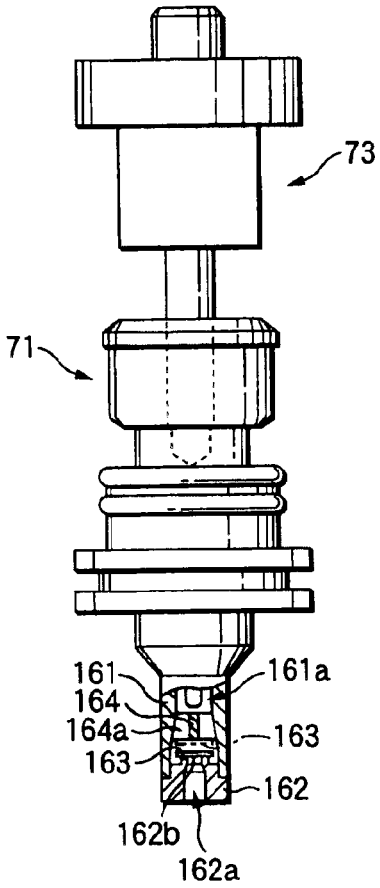
FIG. 31 is a main portion sectional view showing a first embodiment of an ink cartridge according to another aspect of the invention.
Figure 31B:
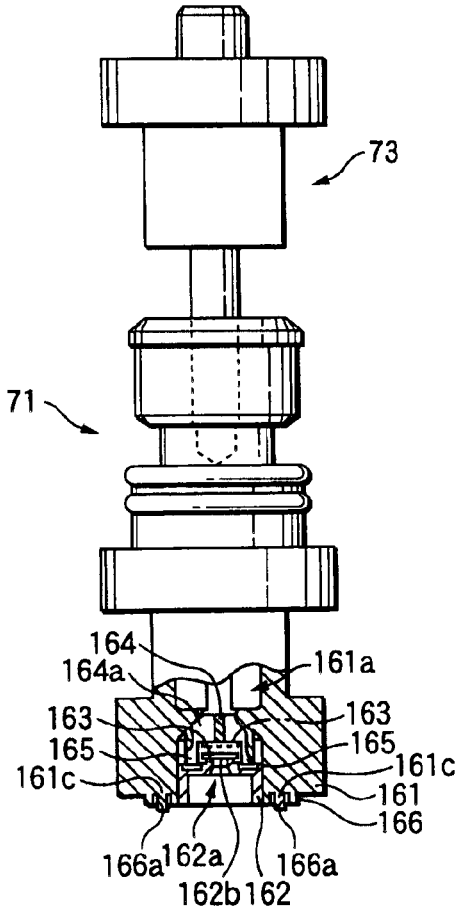

The second tube 162 shown in FIGS. 32B and 33B, as shown in FIGS. 31A and 31B, is fixed to the first tube 161 by forcing its end portion on the ink supplied side into the inflow passage 161*a*. In this second tube 162, there are provided an outflow passage 162*a* that can communicate with the inflow passage 161*a*, and a valve seat (valve seat ring) 162*b* extending along the opening periphery on the ink-supplied side of the outflow passage 162*a*. The outflow passage 162*a* is connected to the ink pact 24. The valve seat 162*b* is formed to protrude from the end surface on the ink supplied side of the second tube 162 toward the ink supplied side.

Figure 34A:
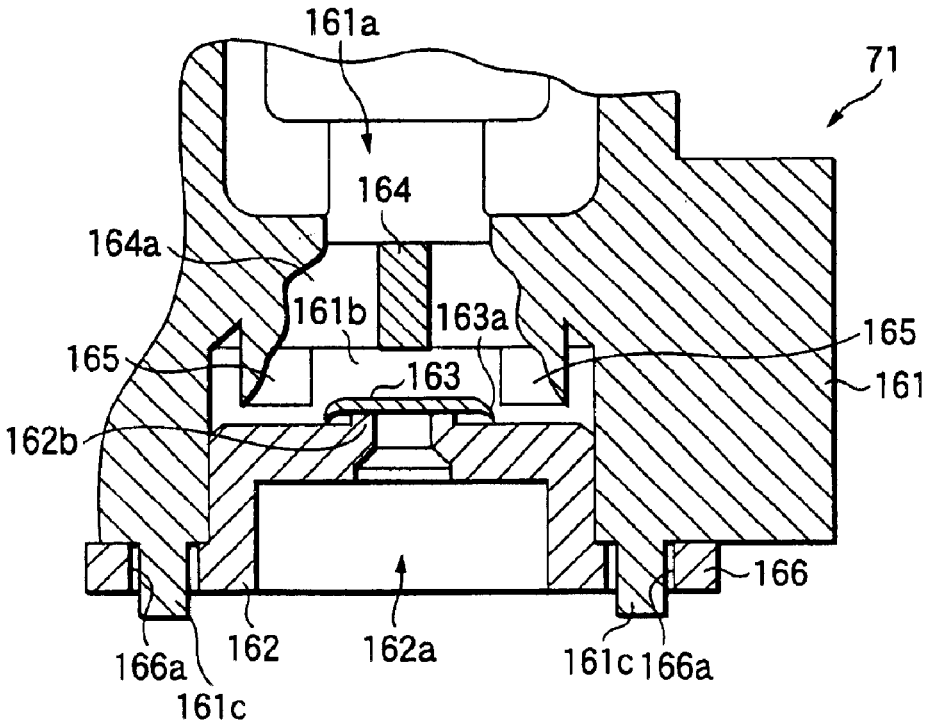
FIG. 34 is a sectional view shown in order to explain a case where a burr is produced in a second valve body and a case where the second valve body is prevented from entering between the second tube and a movement-regulating piece.

As shown in FIG. 34A, in case that such a burr 163*a* as to protrude on the ink supplied side is produced at an edge portion of the valve body 163, this produced burr 163*a* can be positioned at a space around the valve seat 162*b* in the closed state.

Figure 34B:
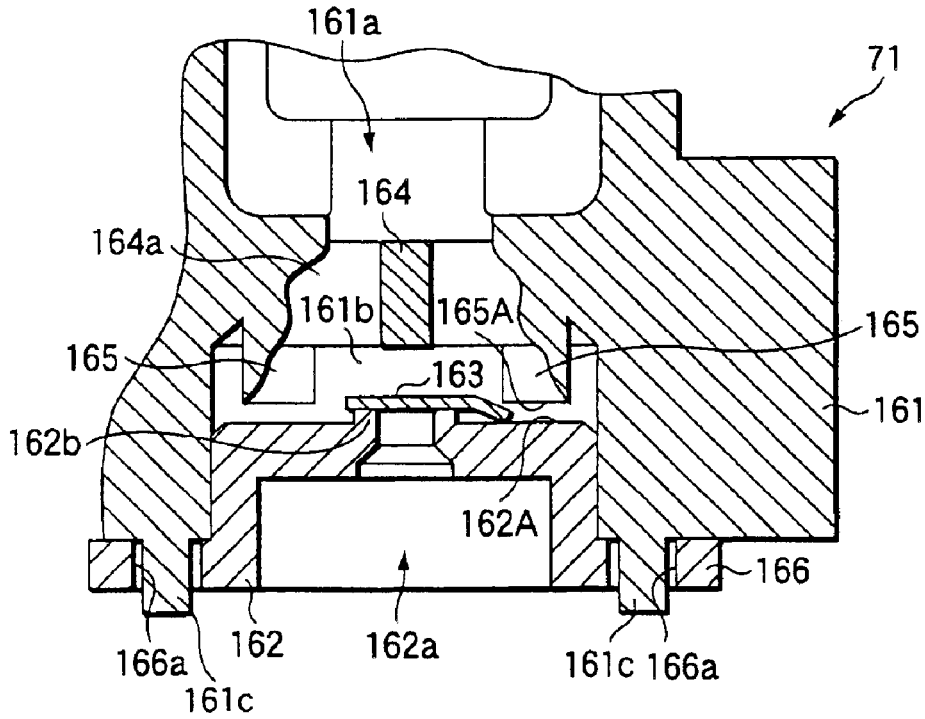

Further, for the second tube 162, two recesses 162*c* are provided, which are opened on the ink supplied side end surface, and to which the leading end portions of the both movement regulating pieces 165 face. As shown in FIG. 34B, the recesses 162*c* are so constructed as to prevent the valve body 163 from entering between the ink supplied side end surface 162A of the second tube 162 and the leading end surface 165A of the movement regulating piece. To the ink supplying side end portion of the second tube 162, a flange 166 is integrally provided, which has two insertion holes 166*a* into which the leading end portions of the both positioning protuberances 161*c* are respectively inserted, and is opposed to the ink supplying side end surface of the first tube 161.

After the ink supplied side end portion of the second tube 162 was forced into the inflow passage 161*a* of the first tube 161, the insertion end portions of the positioning protuberances 161*c* that are inserted into the insertion holes 166*a* of the flange 166 are caulked, whereby the removal of the tubes 161, 162 is prevented.

The valve body 163 is constructed by a check valve that usually closes a tube passage of the ink outlet tube 73*b* and opens it by flow of ink by the pressure applied to the ink pack 24. Further, this valve body 163 is provided so that it can reciprocate between the second tube 62 (ink supplied side end surface) in the outflow passage 162*a* and the stopper 164. And, the whole of the valve body 163 is formed by a planar circular thin plate made of metal material such as stainless or synthetic resin material such as polypropylene and polyethylene, which can seat on the valve seat 162*b*.

Figure 35A:
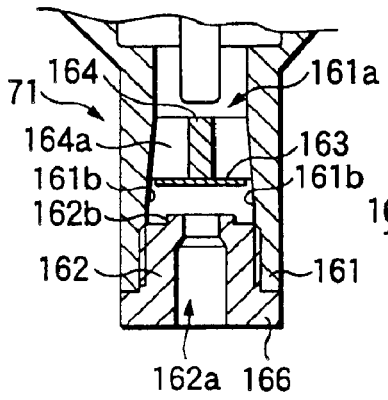
FIG. 35 is an enlarged sectional view showing an opened state of the ink cartridge in the first embodiment.
Figure 35B:
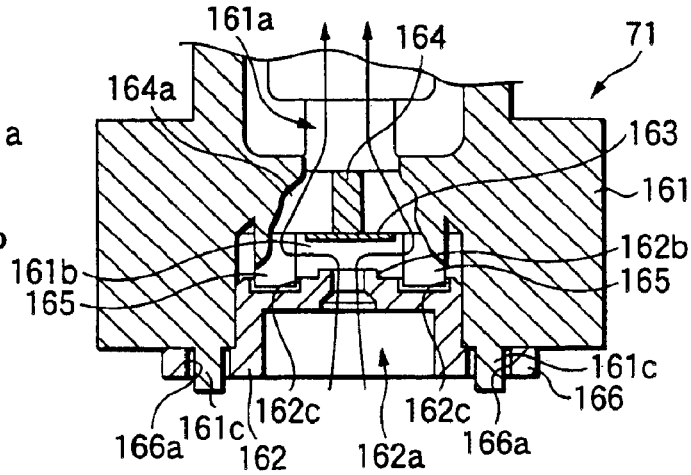

Under the above constitution, when the ink in the ink pack 24 flows to the outside of the ink pack 24 by pressure of the pressurized air pump 21 and then to the ink supplied side, the closed valve body 163 receives this flowing force in the direction where the valve body 163 separates from the valve seat 162*b*, and moves to the ink supplied side, thereby to establish the opened state as shown in FIGS. 35A and 35B.

Therefore, the first tube 161 and the second tube 162 communicate with each other, and the ink flows from the ink pack 24 into the outflow passage 162*a* and the inflow passage 161*a* as shown by arrows in FIG. 35B and is supplied to the ink inlet tube 73*b*.

In case that a user opens the valve member 71*b* by inserting a stick matter such as a screw driver into the ink outlet plug 71, or in case that a trouble is produced in the ink replenishment valve 26 at the printing time, the outflow passage 162*a* of the ink outlet plug 71 remains closed by the valve body 163.

Figure 36A:
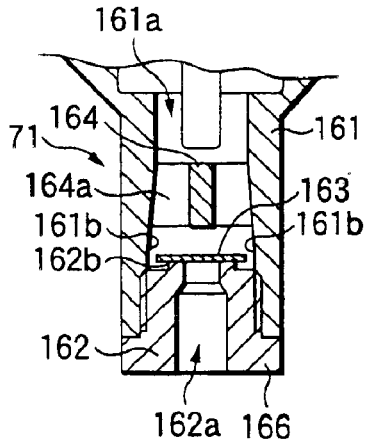
FIG. 36 is an enlarged sectional view showing a closed state of the ink cartridge in the first embodiment.
Figure 36B:
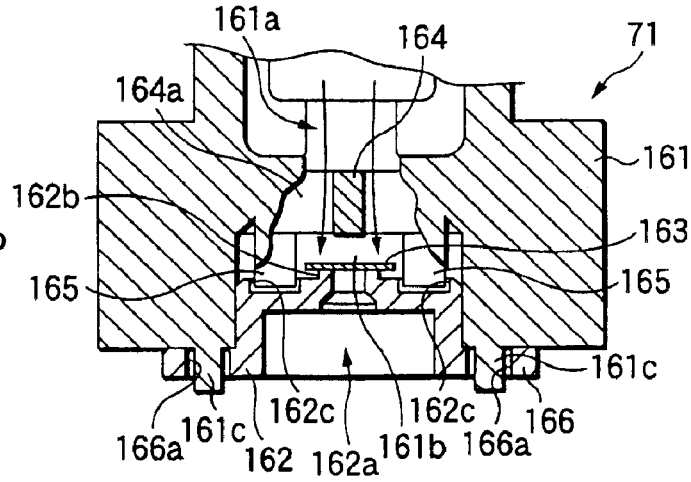

Namely, when air outside the ink outlet plug 71 and the reversely flowing ink flow in the inflow passage 161*a* toward the ink pack side as shown in FIG. 36B, the closed valve body 163 receives this flowing force in the direction where it seats on the valve seat 162*b* and maintains the closed state.

Therefore, as shown in FIGS. 36A and 36B, the first tube 161 and the second tube 162 do not communicate with each other, and the reversely flowing ink or the open air never flows into the ink pack 24.

Accordingly, in this example, it is possible to prevent the inflow of the open air and the reverse flow of ink to the ink pack 24, and to ensure degassed rate of ink and cleanness in the ink pack 24.

When the valve body 163 moves in the inflow passage 161*a* by flow of the ink, its movement to the ink supplied side in the inflow passage 161*a* is regulated by the stopper 164. Further, the movement in the radial direction (in a direction orthogonal to the axial line) in the inflow passage 161*a* is regulated by the movement regulating pieces 165 and the stopper surface 161*b*. Hereby, the valve body 163 moves in the inflow passage 161*a* along the axial line, and the smooth operation of the valve body 163 between two positions in the axial line direction in the inflow passage 161*a* is performed.

Figure 37A:
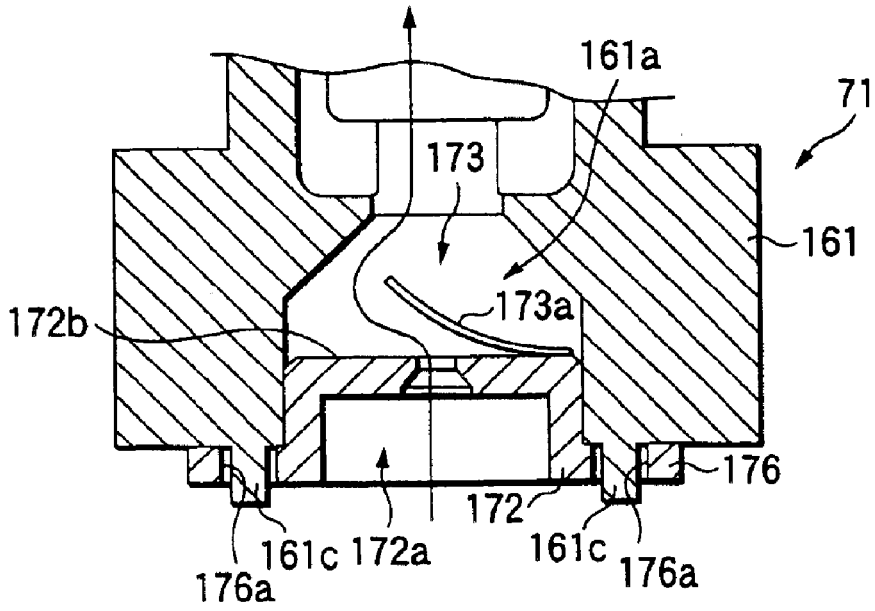
FIG. 37 is a cross-sectional view showing the opened state and closed state of an ink cartridge according to a second embodiment.
Figure 37B:
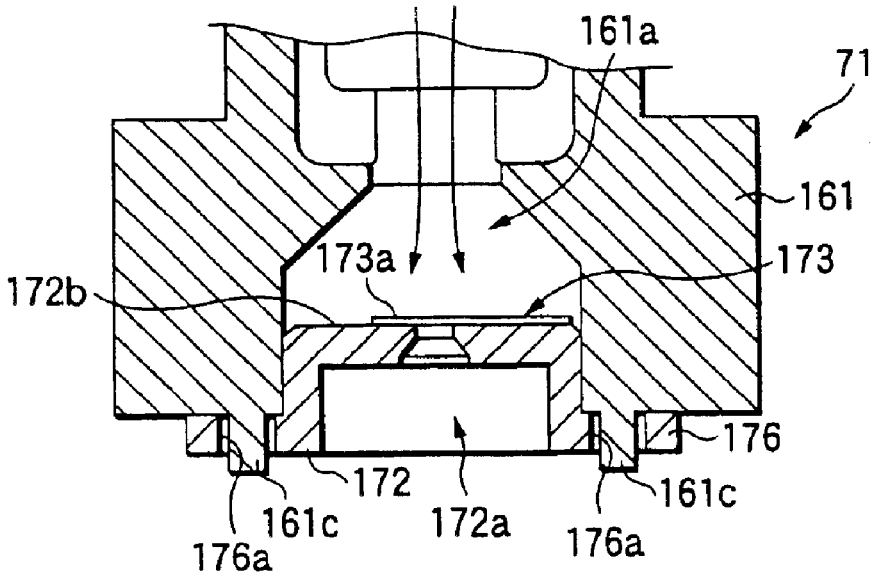

Next, the valve structure according to a second example, arranged in the ink outlet plug will be described with reference to FIGS. 37A and 37B. FIGS. 37A and 37B are cross-sectional views showing an opened state and a closed state of an ink cartridge according to the second example. In FIGS. 37A and 37B, members the same as or equivalent to those in FIGS. 31 to 36 are denoted by the same reference numerals and their detailed description is omitted.

In FIGS. 37A and 37B, the ink outlet plug 71 has a first tube 161 and a second tube 172, and is constructed so that it can be removably attached to the ink inlet tube 73*b* of the cartridge holder 8.

On an ink supplied side of this ink outlet plug 71, a valve member 71*b* (refer to FIG. 14) functioning as the first valve body is arranged, and on an ink supplying side (ink pack side), a valve body 173 (to be described later) functioning as a second valve body is arranged.

The valve member 71*b* is, as described before, constructed by an opening and closing valve that is opened by insertion of the ink outlet plug 71 into the ink inlet tube 73*b*, and closed by pulling of the ink outlet plug 71 from the ink inlet tube 73*b*.

The second tube 172 is fixed to the first tube 161 by forcing its end portion on the ink-supplied side into the aforesaid inflow passage 161*a*. In this second tube 172, there are provided an outflow passage 172*a* that can communicate with the inflow passage 161*a*, and a valve seat 172*b* extending along the opening periphery on the ink supplied side of this outflow passage 172*a*.

The outflow passage 172*a* is connected to the ink pack 24. The valve seat 172*b* is arranged on the same surface as the ink supplied side end surface of the second tube 172.

To the ink supply side end portion of the second tube 172, a flange 176 is integrally provided, which has two insertion holes 176*a* into which the leading end portions of the aforesaid positioning protuberances 161*c* are respectively inserted, and is opposed to the ink supplying side end surface of the first tube 161.

After the ink supplied side end portion of the second tube 172 was forced into the inflow passage 161*a* of the first tube 161, the insertion end portions of positioning protuberances 161*c* that are inserted into the insertion holes 176*a* of the flange 176 are caulked, whereby the removal of the tubes 161, 172 is prevented.

The valve body 173 is constructed by a check valve that usually closes a tube passage of the ink outlet tube 73*b* and opens it by flow of ink by the pressure applied to the ink pack 24. Further, the valve body 173 has a valve body portion 173*a* that can seat on the aforesaid valve seat 172*b*, and is fixed to the ink supplied side end surface (the outside of the valve seat 172*b*) of the second tube 172 by spot welding. And, the whole of the valve body 173 is made of synthetic resin material such as polypropylene and polyethylene, and formed by an elastically deformable planar circular thin piece (thin film).

Under the above constitution, when the ink in the ink pack 24 flows to the outside of the ink pack 24 by pressure applied by the pressurized air pump 21 and flows to the ink supplied side, the closed valve body 173 receives this flowing force in the direction where the valve body 173 separates from the valve seat 172*b*, and moves to the ink supplied side, thereby to establish the opened state as shown in FIG. 37A.

Therefore, the first tube 161 and the second tube 172 communicate with each other, and the ink flows from the ink pack 24 into the outflow passage 172*a* and the inflow passage 161*a* as shown by arrows in FIG. 37A and is supplied to the ink inlet tube 73*b*.

On the other, in case that a user opens the valve member 71*b* by inserting a stick member such as a screw driver into the ink outlet plug 71, or in case that a trouble is produced in the ink replenishment valve 26 at the printing time, the outflow passage 172*a* of the ink outlet plug 71 remains closed by the valve body 173.

Namely, when air outside the ink outlet plug 71 and the reversely flowing ink flow toward the ink pack side as shown by arrows in FIG. 37B, the closed valve body 173 receives this flowing force in the direction where it seats on the valve seat 172*b* and maintains the closed state.

Therefore, as shown in FIG. 37B, the first tube 161 and the second tube 172 do not communicate with each other, and the reversely flowing ink or the open air never flows into the ink pack 24.

Accordingly, in this example, similarly to the first embodiment, it is possible to prevent the inflow of the open air and the reverse flow of ink to the ink pack 24, and to ensure degassed rate of ink and cleanness in the ink pack 24.

Figure 38A:
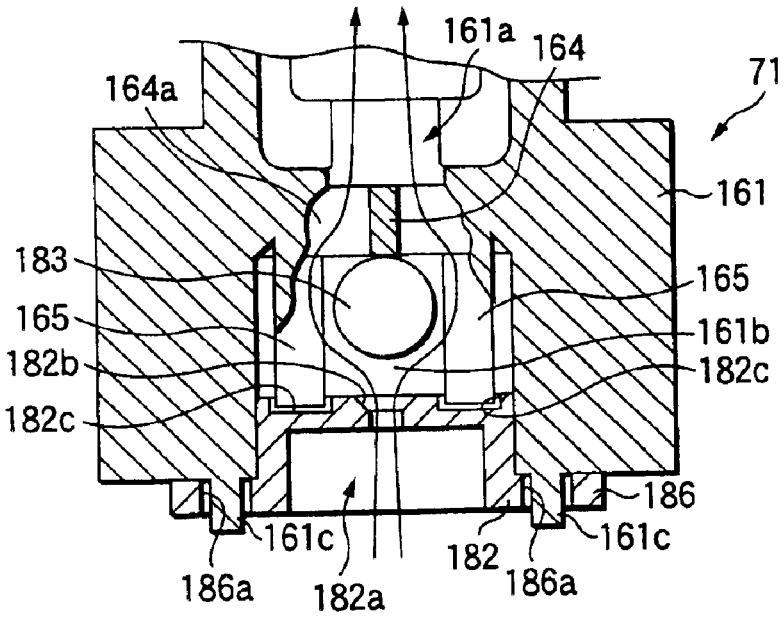
FIG. 38 is a cross-sectional view showing the opened state and closed state of an ink cartridge according to a third embodiment.
Figure 38B:
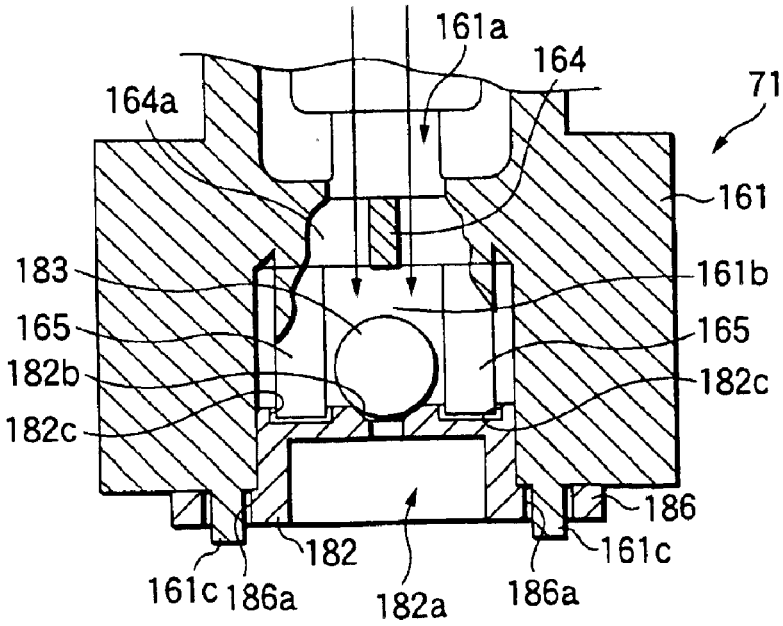

Next, the valve structure according to a third example, arranged in the ink outlet plug will be described with reference to FIGS. 38A and 38B. FIGS. 38A and 38B are cross-sectional views showing an opened state and a closed state of an ink cartridge according to the third example. In FIGS. 38A and 38B, members the same as or equivalent to those in FIGS. 31 to 36 are denoted by the same reference numerals and their detailed description is omitted.

In FIGS. 38A and 38B, the aforesaid ink outlet plug 71 has a first tube 161 and a second tube 182, and is constructed so as to be removably attached to the ink inlet tube 73*b* of the cartridge holder 8.

On an ink supplied side of this ink outlet plug 71, the aforesaid valve member 71*b* (refer to FIG. 14) functioning as the first valve body is arranged, and on the ink supplying side (ink pack side), a valve body 183 functioning as a second valve, which will be described later, is arranged.

The valve member 71*b* is, as described before, constructed by an opening and closing valve that is opened by insertion of the ink outlet plug 71 into the ink inlet tube 73*b*, and closed by pulling of the ink outlet plug 71 from the ink inlet tube 73*b*.

The second tube 182 is fixed to the first tube 161 by forcing its end portion on the ink-supplied side into the inflow passage 161*a*. In this second tube 182, there are provided an outflow passage 182*a* that can communicate with the inflow passage 161*a*, and a valve seat 182*b* extending in the circumferential direction in the ink supplied side opening portion of this outflow passage 182*a*.

The outflow passage 182*a* is connected to the ink pact 24. The valve seat 162*b* is constructed by such an inclined surface that the ink supplied side opening portion of the outflow passage 182*a* expands from the ink supplying side to the ink supplied side.

To the second tube 182, two recesses 182*c* are provided, which are opened on the ink supplied side end surface, and to which the leading end portions of the aforesaid movement-regulating pieces 165 face. To the ink supplying side end portion of the second tube 182, a flange 186 is integrally provided, which has two insertion holes 186*a* into which the leading end portions of the positioning protuberances 61 care respectively inserted, and is opposed to the ink supplying side end surface of the first tube 161.

After the ink supplied side end portion of the second tube 182 was forced into the inflow passage 161*a* of the first tube 161, the insertion end portions of the positioning protuberances 161*c* that are inserted into the insertion holes 186*a* of the flange 186 are caulked, whereby the removal of tubes 161, 182 is prevented.

The valve body 183 is constructed by a check valve that usually closes a tube passage of the ink outlet tube 73*b* and opens it by flow of ink by the pressure applied to the ink pack 24. Further, the valve body 183 is formed by a spherical body, which is provided between the second tube 182 and the stopper 164 so that it can reciprocate and revolve on its axis and so that its whole is made of metal material such as stainless or synthetic resin material such as polypropylene and polyethylene so that it can seat on the valve seat 182*b*.

In order that the valve body 183 is smoothly moved by the flow of ink, and sufficiently exhibits a function of the check valve, it is desirable that the valve body is formed from the material having the same specific gravity (about $1.06\times10^{-3}$ g/mm$^3$) as that of ink in the ink pack 24.

Under the above constitution, when the ink in the ink pack 24 flows to the outside of the ink pack 24 by pressure applied by the pressurized air pump 21 and flows to the ink supplied side, the closed valve body 183 receives this flowing force in the direction where the valve body 183 separates from the valve seat 182*b*, and moves to the ink supplied side, thereby to establish the opened state as shown in FIG. 38A.

Therefore, the first tube 161 and the second tube 182 communicate with each other, and the ink flows from the ink pack 24 into the outflow passage 182*a* and the inflow passage 161*a* as shown by arrows in FIG. 38A and is supplied to the ink inlet tube 73*b*.

On the other, in case that a user opens the valve member 71*b* by inserting a stick member such as a screw driver into the ink outlet plug 71, or in case that a trouble is produced in the ink replenishment valve 26 at the printing time, the outflow passage 182*a* of the ink outlet plug 71 remains closed by the valve body 183.

Namely, when air outside the ink outlet plug 71 and the reversely flowing ink flow toward the ink pack side as shown by arrows in FIG. 38B, the closed valve body 183 receives this flowing force in the direction where it seats on the valve seat 182*b*, and maintains the closed state.

Therefore, as shown in FIG. 38B, the first tube 161 and the second tube 182 do not communicate with each other, and the reversely flowing ink or the open air never flows into the ink pack 24.

Accordingly, in this example, similarly to the first and second examples, it is possible to prevent the inflow of the open air and the reverse flow of ink to the ink pack 24, and to ensure degassed rate of ink and cleanness in the ink pack 24.

When the valve body 183 moves in the inflow passage 161*a* by the flow of ink, its movement to the ink supplied side in the inflow passage 161*a* is regulated by a stopper 164.

Further, the movement in the radial direction (the direction orthogonal to the axial line) in the inflow passage 161*a* is regulated by a movement regulating piece 165 and a stopper surface 161*b*. Hereby, the valve body 183 moves in the inflow passage 161*a* along the axial line, and the smooth operation of the valve body 183 between two positions in the axial line direction in the inflow passage 161*a* is performed.

In the above-described first, second, and third examples, as a means for supplying ink, in any example, the constitution in which the ink in the ink pack 24 is pushed out by pressure applied by the pressurized air pump 21 is used. However, other ink supplying means shown below may be used.

For example, the following means may be used: a means in which the inside of the sub-tank 7 is pressure-reduced by a pressure-reducing pump (not shown) so that ink is sucked from the ink cartridge; or a means in which the capping means 11 is pressure-reduced by a pressure-reducing pump (not shown) to suck ink in a construction in which the sub-tank is not used.

To be brief, any ink supply means may used as long as it can generate a difference in pressure between the ink pack 24 and the sub-tank 7 or between the ink pack 24 and the recording head 6.

As described above, according to the ink cartridge of the seventh aspect of the invention, since it is possible to prevent the inflow of the open air and the reverse flow of ink to the ink pack 24, air is never fed to the head for recording apparatus at the time of ink supply and it is also possible to ensure degassed rate and cleanness of ink in the ink pack.

What is claimed is:

1. An ink cartridge comprising:

an ink outlet tube that can be removably attached to an ink inlet tube for connection to a recording apparatus head through an ink passage;

an ink pack that is connected to the ink outlet tube and sealingly stores ink therein;

a first valve body that is opened or closed by attachment and detachment of the ink inlet tube, and that is provided in the ink outlet tube; and a second valve body that is provided on an ink supplying side of the first valve body, the second valve body capable of unattachedly migrating so as to stop a flow of in or air attempting to flow from the ink outlet tube to the ink pack.

2. An ink cartridge according to claim 1, wherein the second valve body is constructed as a thin plate.

3. An ink cartridge according to claim 1, wherein the second valve body is a valve body that can move in an axial direction of the tube passage.

4. An ink cartridge according to claim 3, wherein the second valve body is constructed as a spherical member.

5. An ink cartridge according to claim 4, wherein the specific gravity of the second valve body is the same as the specific gravity of ink.

6. An ink cartridge according to claim 3, wherein a stopper is provided between the first valve body and the second valve body.

7. An ink cartridge according to claim 3, wherein a movement-regulating piece is provided sideward of the second valve body.

8. An ink cartridge according to claim 7, wherein a recess that opens to an ink supplied side is formed in the ink outlet tube, and a leading end portion of the movement-regulating piece is arranged in the recess.

9. An inkjet recording apparatus including a head mounting carriage that can reciprocate between a printing region and a non-printing region, characterized in that the ink cartridge according to any of claims 1 to 8 is used.

10. An ink cartridge according to claim 3, wherein a valve seat corresponding to the second valve body is formed projectingly to an ink supply side.

11. An ink cartridge according to claim 1, wherein the second valve body is formed from elastically deformable material.

12. An ink cartridge comprising:

an ink tank storing ink therein;

an ink outlet port having an inlet opening and an outlet opening, wherein the ink stored in the ink tank flows via the inlet opening out of the outlet opening;

a first valve body disposed between the inlet opening and the outlet opening and biased to close the exit opening; and a second valve body disposed between the inlet opening and the first valve body, the second valve body capable of unattachedly migrating in the ink flowing between the inlet opening and the outlet opening to selectively open and close the inlet opening.

13. The ink cartridge of claim 12, wherein the second valve body has a planar surface for closing the inlet opening.

14. The ink cartridge of claim 13, wherein the planar surface is circular.

15. The ink cartridge of claim 14, wherein the second valve body includes a planar circular thin plate.

16. The ink cartridge of claim 12, wherein the second valve body includes a spherical member.

17. The ink cartridge of claim 12, wherein the second valve body is linearly reciprocatable along an axial path of the flow of ink.

18. The ink cartridge of claim 17, further comprising a movement-regulating member that guides the linearly reciprocating movement of the second valve body.

19. The ink cartridge of claim 18, further comprising a stopper disposed between the first valve body and the second valve body.

20. The ink cartridge of claim 12, wherein the specific gravity of the second valve body is the same as the specific gravity of the ink stored in the in tank.

21. The ink cartridge of claim 12, wherein the specific gravity of the second valve body is approximately $1.06\times10^{-3}$ g/mm$^3$.

22. The ink cartridge of claim 12, wherein:

the ink tank includes an ink pack that seals the ink therein and a case that stores the ink pack therein.

* * * * *